US005707449A

United States Patent [19]

Ohira et al.

[11] Patent Number: 5,707,449

[45] Date of Patent: Jan. 13, 1998

[54] RING-SHAPED COATING APPARATUS

[75] Inventors: Akira Ohira; Junji Ujihara; Eiichi Kijima; Masao Asano; Nobuaki Kobayashi, all of Hachioji, Japan

[73] Assignee: Konica Corporation, Tokyo, Japan

[21] Appl. No.: 650,090

[22] Filed: May 17, 1996

[30] Foreign Application Priority Data

| | | | |
|---|---|---|---|
| May 31, 1995 | [JP] | Japan | 7-133615 |
| May 23, 1995 | [JP] | Japan | 7-123793 |
| May 26, 1995 | [JP] | Japan | 7-128023 |
| Jun. 28, 1995 | [JP] | Japan | 7-162021 |
| Sep. 26, 1995 | [JP] | Japan | 7-247867 |

[51] Int. Cl.[6] ..... B05C 3/12; B05C 3/00; B05C 19/02

[52] U.S. Cl. ..... 118/405; 118/419; 118/423

[58] Field of Search ..... 118/405, 412, 118/419, 423, DIG. 11, DIG. 12, DIG. 13

[56] References Cited

U.S. PATENT DOCUMENTS

| | | | |
|---|---|---|---|
| 1,988,628 | 1/1935 | McDonald et al. | 118/DIG. 11 |
| 2,990,577 | 7/1961 | Kraffe De Laubarede | 118/DIG. 11 |
| 3,840,384 | 10/1974 | Reade et al. | 117/8 |
| 3,965,857 | 6/1976 | Baxter | 118/405 |

FOREIGN PATENT DOCUMENTS 58-189061 11/1983 Japan .

*Primary Examiner*—Donald E. Czaja
*Assistant Examiner*—Jacqueline A. Ruller
*Attorney, Agent, or Firm*—Frishauf, Holtz, Goodman, Langer & Chick

[57] ABSTRACT

An apparatus for coating a cylinder with a solution. The apparatus has a coater which includes a body having a circular hole through which the cylinder passes. A coating surface is provided on a wall of the circular hole so as to surround an outer surface of the cylinder as the cylinder passes through the circular hole. A solution chamber is provided in the body for storing the solution, and a slit is provided in the body for distributing the solution from the solution chamber to the coating surface. A feeding port is provided on a periphery of the body, and a feeding conduit is provided in the body for connecting the feeding port and the solution chamber so that the solution is fed from the feeding port to the solution chamber. The solution chamber has a height H2 of 5 mm to 50 mm, the slit has a slit gap distance HI, and a ratio H2/H1 is 10 to 1000. In addition, the apparatus also includes a conveyor for conveying the cylinder through the circular hole of the coater so that the outer surface of the cylinder is coated with the solution when the cylinder passes the coating surface provided on the wall of the circular hole.

23 Claims, 42 Drawing Sheets

FIG. 11 ( A - 2 )
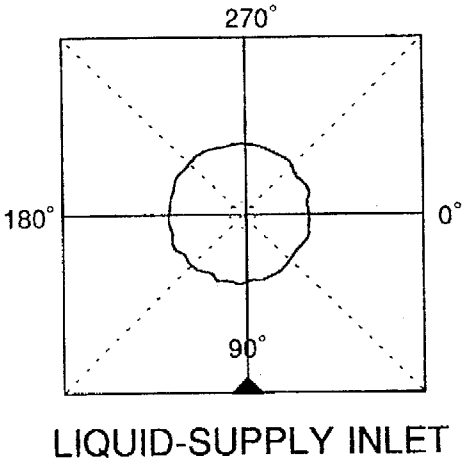
FIG. 11 ( B - 2 )
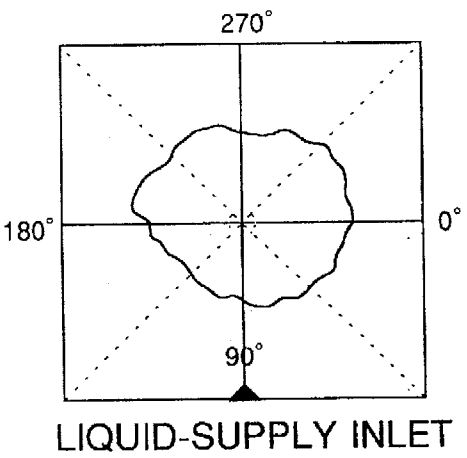
FIG. 11 ( A - 1 )
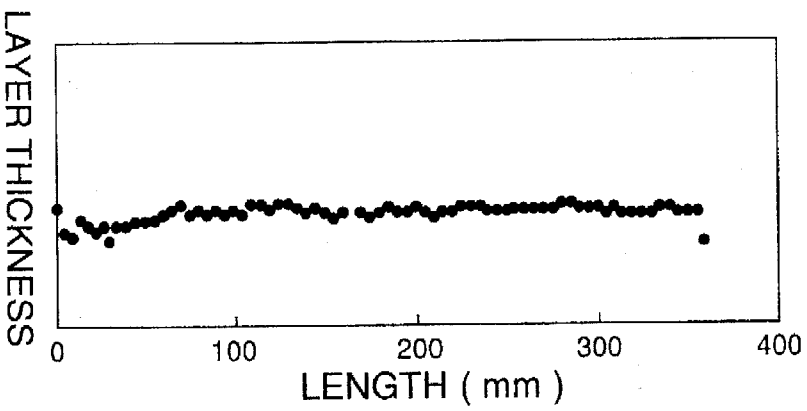
FIG. 11 ( B - 1 )
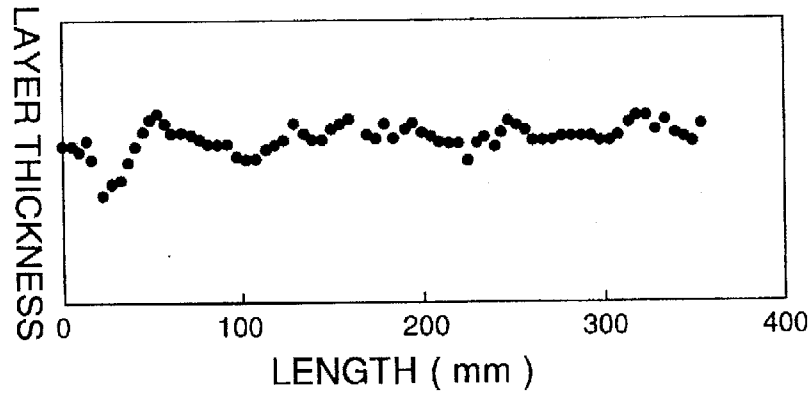

EXAMPLE OF ΔH RANGING FROM ZERO TO PLUS

COMPARATIVE EXAMPLE OF ΔH RANGING FROM ZERO TO MINUS

EXAMPLES

FIG. 20 ( A )
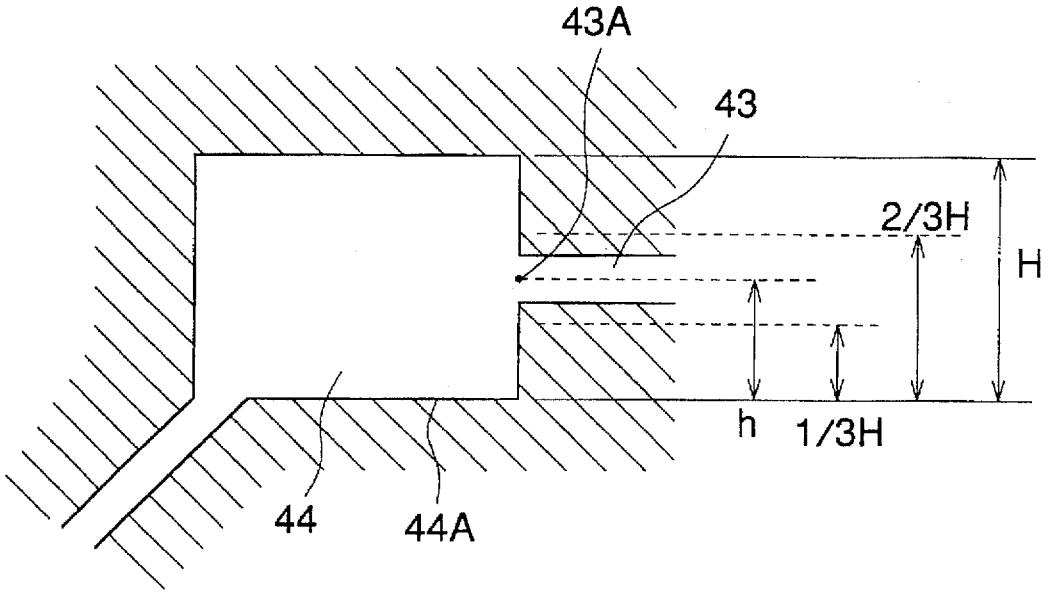
FIG. 20 ( B )
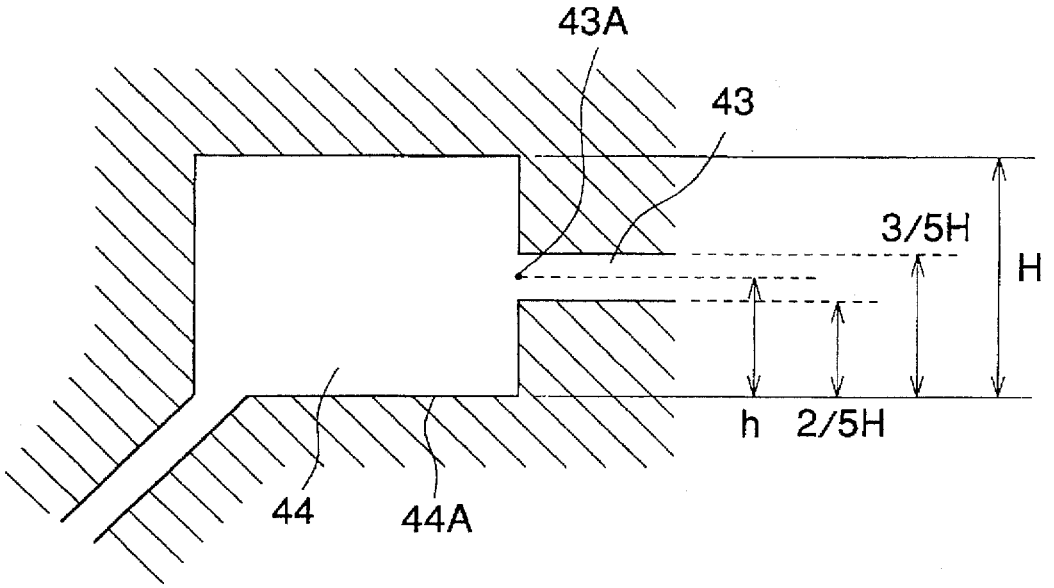

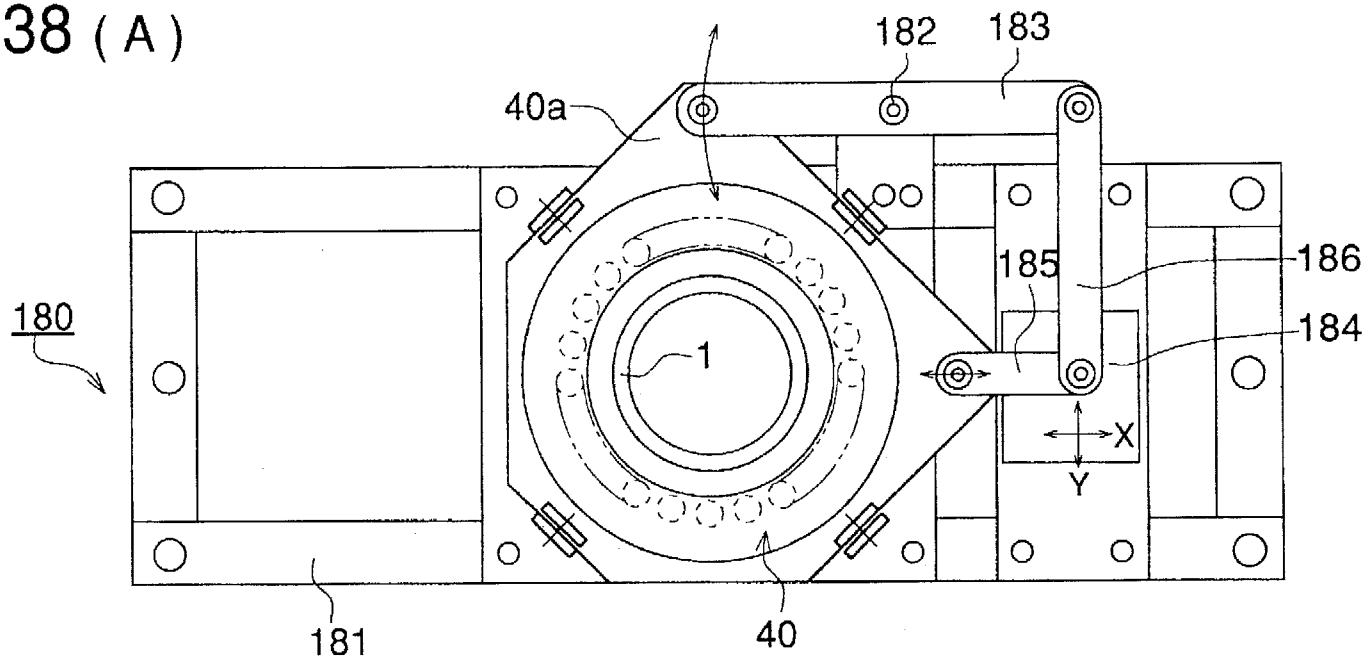
FIG. 38 ( A )
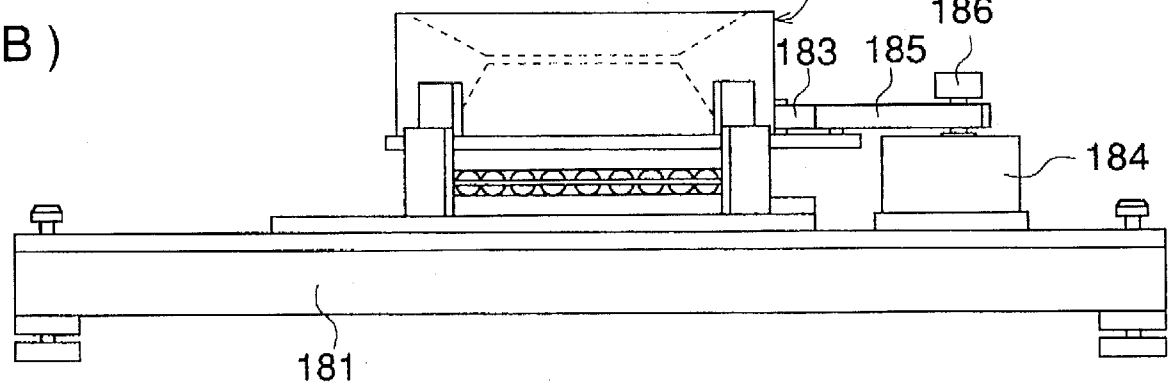
FIG. 38 ( B )

FIG. 44 ( A )
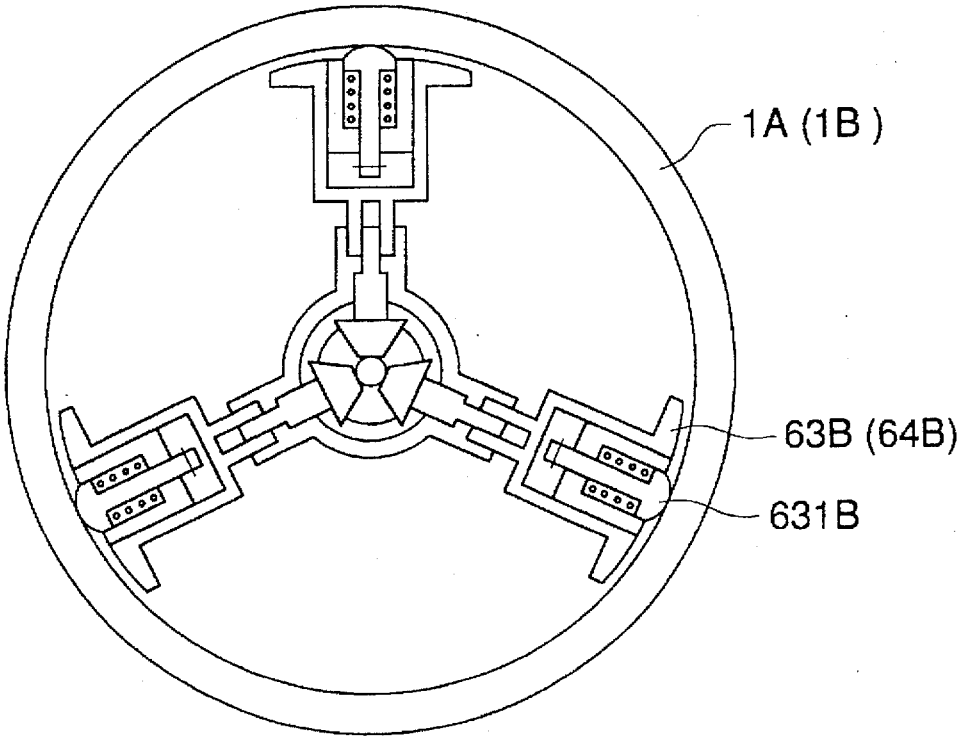
FIG. 44 ( B )
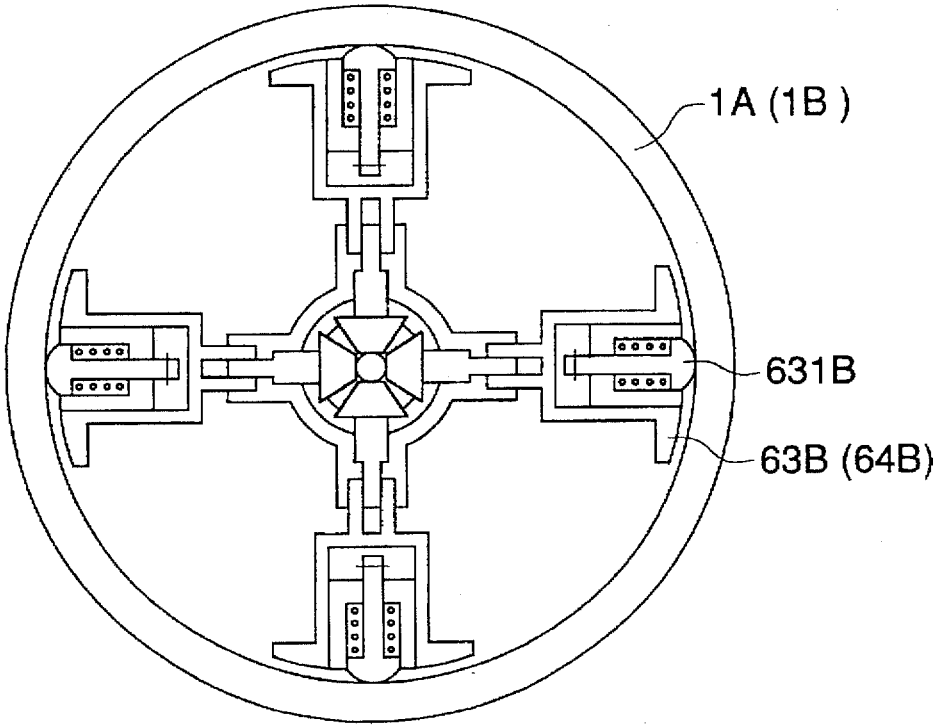

RING-SHAPED COATING APPARATUS

BACKGROUND OF THE INVENTION

The present invention relates to a coating apparatus which coats a coating solution uniformly on an external circumferential surface of a cylindrical base material having a continuous surface formed endlessly, and to a coating method.

With regard to a method for coating a thin layer uniformly on an external circumferential surface of a cylindrical base material having a continuous surface formed endlessly, there have been studied various methods such as a spray coating method, a dip coating method, a blade coating method and a roll coating method. In particular, for the coating of a uniform and thin layer such as that on an electrophotographic photoreceptor drum, development of a coating apparatus which is excellent to be manufactured is now studied.

In the spray coating method, before a drop of coating solution jetted out of a spray gun reaches the external circumferential surface of a cylindrical base material having a continuous surface formed endlessly, a solvent evaporates, and thereby solid body concentration in the drop of a coating solution rises and viscosity of the coating solution is raised accordingly. Therefore, when the drop of a coating solution reaches the surface, the drop of a coating solution does not spread on the surface, or a particle dried and solidified sticks to the surface, resulting in an impossibility of obtaining those having coated surfaces which are excellent in smoothness. Further, the rate of reaching of a drop of a coating solution to a cylindrical base material having a continuous surface is not 100% resulting in a loss of a coating solution, and it is very difficult to control a layer thickness because uniformity is partially poor. In addition, in the case of a highly polymerized solution, cobwebbing is sometimes caused, and there accordingly are restrictions for solvents and resins to be used.

In the blade coating method and roll coating method, a blade or a roll is arranged in the longitudinal direction of a cylindrical base material, for example, so that the cylindrical base material is rotated for coating, and after the cylindrical base material makes one turn, the blade or the roll is retreated. However, when the blade or the roll is retreated, viscosity of a coating solution makes a part of a coated layer to be thicker than other portions, which is a weak point that a uniform layer can not be obtained.

In the dip coating method, smoothness on the surface of a coating solution and poor uniformity of a coated layer are improved. However, control of a thickness of a coated layer is very difficult. Further a coating speed is low and an amount of solution that is not less than a certain level is required for filling a tank for a coating solution. Further weak point is that components of lower layers melt out in the case of multi-layer coating and the tank for a coating solution is easily contaminated accordingly.

With a background stated above, a circular coating apparatus of an amount regulating type (including a coating apparatus of a slide hopper type) as described in Japanese Patent Publication Open to Public Inspection No. 189061/1983 (hereinafter referred to as Japanese Patent O.P.I Publication) was developed. Through the use of this coating apparatus of a slide hopper type, it is possible to coat with a small amount of solution without contamination of a coating solution and a highly productive coating wherein control of a layer thickness is easy is feasible.

However, even when using the coating apparatus of a slide hopper type and a coating method employing the same, there have been drawbacks such as failure of forming a coating solution layer (mainly caused by eading failure), or uneven coating and great variation of layer thickness, especially a big difference of layer thickness between that in a position near the supply inlet and that in a position farthest therefrom.

The invention has been achieved in view of the problems mentioned above, and its object includes the following points. (a) To prevent failure in forming a coated layer (beading failure), uneven coating and layer thickness variation, even for a low viscosity coating solution and a high viscosity coating solution. (b) To improve coatability for simultaneous multi-layer coating wherein plural coated layers are simultaneously formed on a cylindrical base material, or for successive multi-layer coating wherein coated layers are formed from plural coating apparatus successively on a cylindrical base material.

(c) To improve the function of holding and transporting a cylindrical base material to make stable coating for a long time possible.

(d) To stabilize the function of holding and transporting a cylindrical base material to prevent deformation and damage of the cylindrical base material.

(e) To make the production processes of supplying, transporting, coating, drying and ejecting a cylindrical base material to be a continuous and stable production so that the productivity may be improved.

(f) To make aforesaid processes to be continuous and full automatic ones and thereby to prevent foreign materials such as dust from being mixed so that quality products may be obtained.

(g) To achieve a continuous coating apparatus which does not adversely affect image forming on a finished photoreceptor drum even when a vibration takes place on a cylindrical base material.

(h) To prevent, even when a vibration takes place on a cylindrical base material, that the vibration is superposed to be intense vibration, by causing the vibration to be scattered without being concentrated to the same position.

SUMMARY OF THE INVENTION

The object mentioned above can be attained by the following constitutions.

(1) A coating method comprising a supply inlet through cylinder h which a coating solution is supplied from the outside while a cylindrical base material having its continuous circumferential surface formed to be endless is moved, a ring-shaped coating solution distributing chamber, a coating solution distributing slit opened to the inside of the coating solution distributing chamber, and an endless coating solution flow out port provided on a hopper coating surface formed to be close to the entire circumferential surface of the cylindrical base material in a way to surround the circumferential surface of the cylindrical base material, through which a coating solution is caused to flow out to the hopper coating surface and thereby to be supplied continuously to the cylindrical base material and to the edge portion of the hopper coating surface so that the coating solution may be coated, wherein a height of the coating solution distributing chamber is 5–50 mm and the ratio of the height of the coating solution chamber to the gap size of the slit is 1:10–1:1000.

A coating apparatus surrounding, in a ring shape, the circumference of a cylindrical base material that moves in its longitudinal direction and comprising therein a ring-shaped coating solution distributing chamber, a supply inlet through which a coating solution is supplied to the coating solution distributing chamber from the outside, and a coating solution distributing slit that is opened to the inside of the coating solution distributing chamber, wherein a height of the coating solution distributing chamber is 5 0 50 mm and the ratio of the height of the coating solution distributing chamber to the gap size of the slit is 1/10–1/1000.

(2) The height of the coating solution distributing chamber located on the side of the supply inlet is different from that located on the side farthest from the supply inlet.

(3) A volume of the coating solution distributing chamber is 20–1000 c.c.

Operations in the constitution mentioned above will be explained as follows.

It may be preferable that the height of the coating solution distributing chamber is 5–50 mm and the ratio of the height of the coating solution distributing chamber to the gap size of the slit is 1/10–1/1000, no failure in forming a coated layer (beading failure) is caused and uneven coating in the longitudinal direction is less. When the height of the coating solution distributing chamber is less than 5 mm, beading is unstable, and when it exceeds 50 mm, a difference between a layer thickness at a location closest to the coating solution supply inlet and that at a location farthest therefrom is big. Further, when the ratio (H ratio) of the height of the coating solution distributing chamber to the gap size of the slit is less than 10, the variation of the bead is great. When it exceeds 1000, uniformity of a coating solution is lowered, layer thickness variation is great and uneven coating becomes severe because of an increased dead space.

It may be preferable that the gap of the coating solution distributing slit is 30 mm–1 mm, no failure in forming a coated layer (beading failure) is caused and uneven coating in the longitudinal direction is less. Though a gap of the slit depends on the moving speed of a base material and the flow rate of conveyed solution, the gap of the slit in the range mentioned above causes less variation of layer thickness and less uneven coating.

It may be preferable that the height of the coating solution distributing chamber located near the supply inlet is different from that located to be farthest from the supply inlet, no failure in forming a coated layer (beading failure) is caused and uneven coating in the circumferential direction is less. Pressure of a solution in an apparatus is different between the position near the supply inlet and that farthest from the supply inlet, and two solution flows hit each other at the location farthest from the supply inlet (easily understood when consider the occasion of only one solution supply inlet). Therefore, the layer thickness variation in the circumferential direction is great. Prevention of influences of the difference of solution pressure and the solution hitting was attained by the difference of a height of the coating solution distributing chamber (solution reservoiring chamber) between the position near the inlet and the position farthest from the inlet. It is preferable that the height near the inlet is shorter, and H ratio is within a range of 1.01–5.00 under the assumption of;

H ratio=Height at position farthest from inlet/Height at position near inlet

It may be preferable that the height of the coating solution distributing chamber is increased gradually at the position farthest from the supply inlet, failure in forming a coated layer (beading failure) is further diminished and uneven coating in the circumferential direction is less.

It may be preferable that the volume of the coating solution distributing chamber is 20–1000 c,c., no failure in forming a coated layer (beading failure) is caused, uneven coating is less, and coating is stable against pulsation variation of solution feeding. When the volume is smaller than 20 c.c., solution pulsation caused by a solution feeding system and by vibration is picked up, and uneven coating in the longitudinal direction and that in the circumferential direction may be caused. When the volume is greater than 1000 c.c., a difference of pulsation variation between the position near the supply inlet and the position farthest from the supply inlet is great, uneven coating in the circumferential direction is severe, and uniformity of a coating solution may be lowered and uneven coating may occur because of an increased dead space. Incidentally, the preferable volume is 30–900 c.c.

It may be preferable that the speed of flow at the supply inlet is 0.01–1.0 cm/sec., failure in forming a coated layer (beading failure) is further diminished, uneven coating is less, and coating is stable against pulsation variation of solution feeding.

(4) The inlet portion of the supply inlet is positioned at the same height as an inner opening of the slit or at the lower position than that for the coating solution distributing chamber. When the aforesaid relation is reversed, the pressure applied on the surface of a solution flowing to the coating solution distributing slit is inclined to become unstable, resulting in an unstable solution layer.

(5) The slit mentioned above is slanted upward by 10°–80° from the horizontal level from the solution reservoir chamber.

The inlet portion of the supply inlet is preferably positioned to be the lowest bottom position against the solution reservoir chamber, and the height h of the central portion of the inner opening of the slit and the height H of the solution reservoir chamber are in the relation of the following inequality.

$$\frac{1}{3} H \leq h \leq \frac{2}{3} H$$

(6) At least one air discharging port is preferably provided above the coating solution distributing chamber. The air discharging port is positioned at the location that is away from the supply inlet for the coating solution.

(7) In order to attain the object of the invention mentioned above, a continuous coating apparatus is preferably composed of a coating means in which cylindrical base materials are stacked with their axes aligned and are pushed up vertically through the inside of a ring-shaped coating apparatus to be coated continuously on their outer surfaces, a supply means for supplying cylindrical base materials to the coating means, a positioning means that aligns the center of the cylindrical base material with the center of a ring of the ring-shaped coating apparatus, a means that dries or dries and adjusts the coated cylindrical base material, and a separating and ejecting means that separates the coated cylindrical base material and takes it out, and a continuous coating method is preferably conducted by the continuous coating apparatus.

(8) An operating position for each means mentioned above preferably corresponds to the length that is a multiple of an integer.

(9) When a coating solution comes in contact with a joint of the cylindrical base materials, it may be preferable that the supply means, the step-adjusting and transporting means and the separating and ejecting means are operated simultaneously.

(10) When a coating solution comes in contact with a portion corresponding to a non-image area on the cylindrical base material, the supply means, it may be preferable that the step-adjusting and transporting means and the separating and ejecting means are operated on a staggered basis within the portion corresponding to a non-image area.

(11) For the purpose of coating continuously a coating solution on the circumferential surface of the cylindrical base material by means of the coating means while pushing upward vertically plural cylindrical base materials stacked with their axes aligned from their lower position to upper position, it may be preferable that there are provided a cylindrical base material push up means attached on a cylindrical base material supply means that pushes up a cylindrical base material vertically from its lower position to its upper position and a positioning guide member that is capable of being mounted on and dismounted from the cylindrical base material when pushing up the cylindrical base material with the cylindrical base material push up means, and is positioned between the cylindrical base material push up means and the cylindrical base material.

(12) A holding device used in the case of coating a coating solution continuously on the outer circumferential surface of the cylindrical base material, is preferably provided with two or more holding shoes an outer portion of each of which comes in contact with the outer surface of the cylindrical base material and with a hand portion holding the holding shoes mentioned above, and buffer member that operates when the holding shoes grasp the cylindrical base material is provided on a part of the holding device.

(13) In a separating/ejecting/holding device that separates and ejects while holding the inner surface of the coated cylindrical base material after coating a coating solution continuously with a vertical coating apparatus on the outer circumferential surface of each of the cylindrical base materials stacked with their axes aligned and after drying, the holding device mentioned above is preferably provided with a holding shoe whose outer portion comes in contact with the inner surface of the cylindrical base material and with a buffer mechanism that operates when the cylindrical base material is grasped.

BRIEF DESCRIPTION OF THE DRAWINGS

FIGS. 11(A-1), 11(A-2), 11(B-1) and 11(B-2) represent a layer thickness profile in the longitudinal and circumferential directions of coated drums No. C3-1 and No. C3-3.

FIGS. 20(A) and 20(B) are partial sections wherein the vicinity of the coating solution distributing chamber is enlarged.

FIGS. 38(A) and 38(B) represent a top view and a front view showing another example of the position-adjusting means.

FIGS. 44(A) and 44(B) respectively represent a sectional view of the separation/discharging/holding means of aforesaid example.

DETAILED DESCRIPTION OF THE PREFERRED EMBODIMENT

Next, the invention will be explained as follows, referring to the examples to which the invention is not limited.

Figure 1:
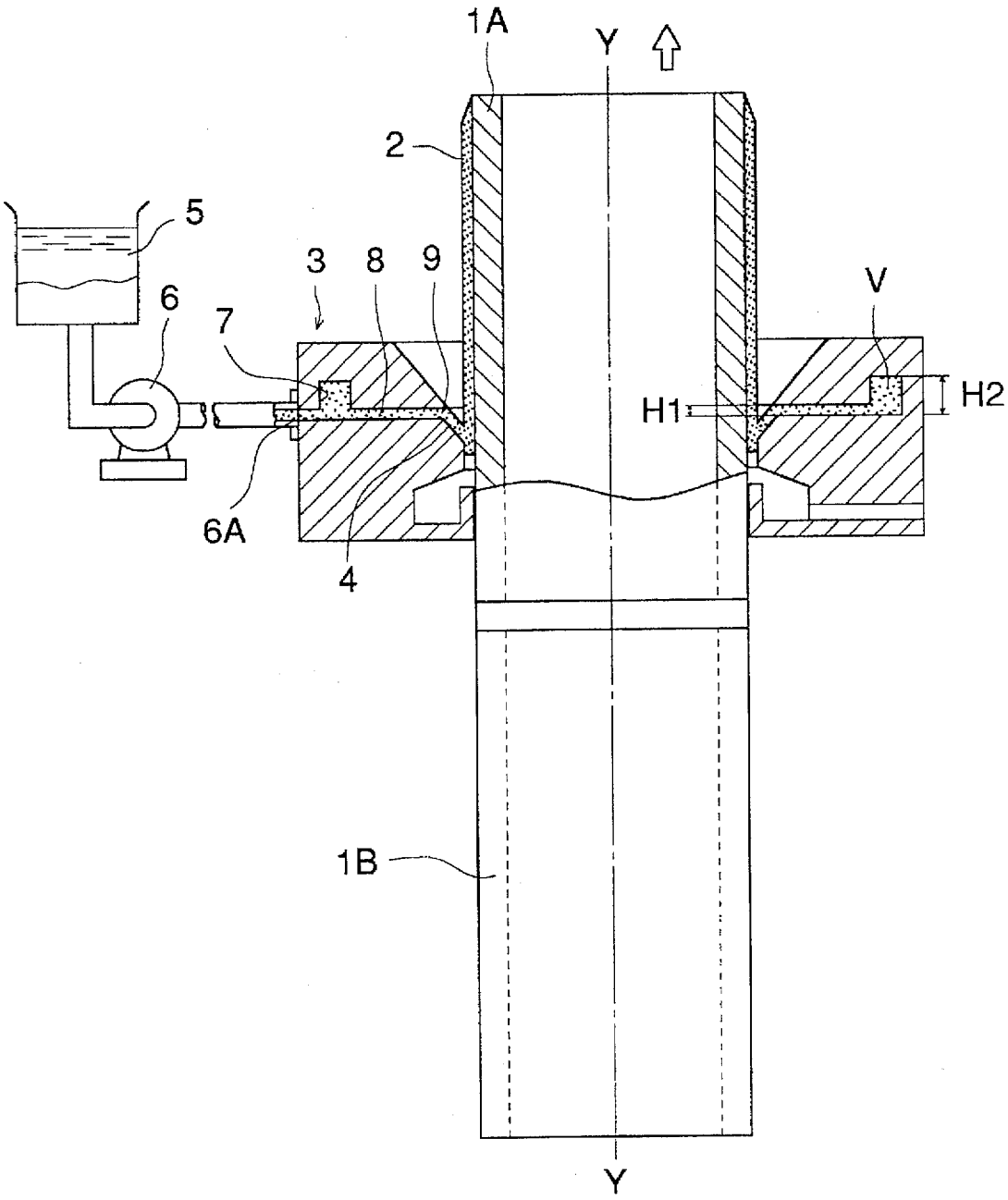
FIG. 1 is a sectional view of an example of a coating apparatus showing the example of structure of a solution distribution chamber and a slit related to the invention.

FIG. 1 is a sectional view of an example of a coating apparatus of the invention, and it shows cylindrical base materials 1A and 1B each being formed endlessly and staked vertically along center line Y and a coating apparatus which coats light-sensitive coating solution 2 successively on the cylindrical base materials 1A and 1B. As shown in the drawing, hopper coating surface 4 for coating solution 2 is formed to surround the cylindrical base materials 1A so that coating solution 2 supplied to the hopper coating surface 4 can be coated successively on the cylindrical base materials 1A. In the coating method, the coating head 3 mentioned above is fixed so that it may coat on the cylindrical base materials 1A starting from its top end, while the cylindrical base materials 1A is moved upward in the arrowed direction along the center line Y. The coating solution 2 is coated by coating head 3 which is a portion surrounding the cylindrical base material and relating directly to coating on the outer circumferential surfaces of the cylindrical base materials 1A and 1B by the coating apparatus. On the coating head 3, there is arranged horizontally narrow coating solution distributing slit (hereinafter referred to as a slit) 8 having coating solution flow out port 9 that is opened to the side of the cylindrical base materials 1A and 1B. This slit 8 is communicated with ring-shaped solution distributing chamber 7 to which the coating solution 2 in coating solution tank 5 is supplied by coating solution supply section 6A of solution supply pump 6 through a supply pipe. On the other hand, under the coating solution flow out port 9 of the slit 8, there is formed sliding surface 4 that is inclined downward continuously and is formed so that a diameter of its end portion is slightly greater than the outside diameter of the base material. There is further formed lip-shaped section that extends downward beyond the end portion of the sliding surface 4. In the course of coating by means of such coating apparatus, when coating solution 2 is pushed out from the slit 8 and is caused to flow down along the sliding surface 4 in the course of drawing up the cylindrical base materials 1A and 1B, the coating solution arriving at the end portion of the sliding surface forms a bead between the end portion of the sliding surface and the external circumferential surface of the cylindrical base materials 1A and 1B, and then is coated on the surface of the cylindrical base material. Incidentally, as cylindrical base material, a hollow drum such as, for example, an aluminum drum or a plastic drum, or a base material of a seamless belt type may also be used. In FIG. 1, G1 represents a clearance of the slit and H2 is a height of the solution distributing chamber. When the height of the solution distributing chamber H2 is 5–50 mm and the ratio of the clearance of the slit to the height of the solution distributing chamber H2 is 1:10–1:1000, it is possible to reduce blurs of coated layers and uneven coating in the longitudinal direction, which is preferable.

Figure 2:
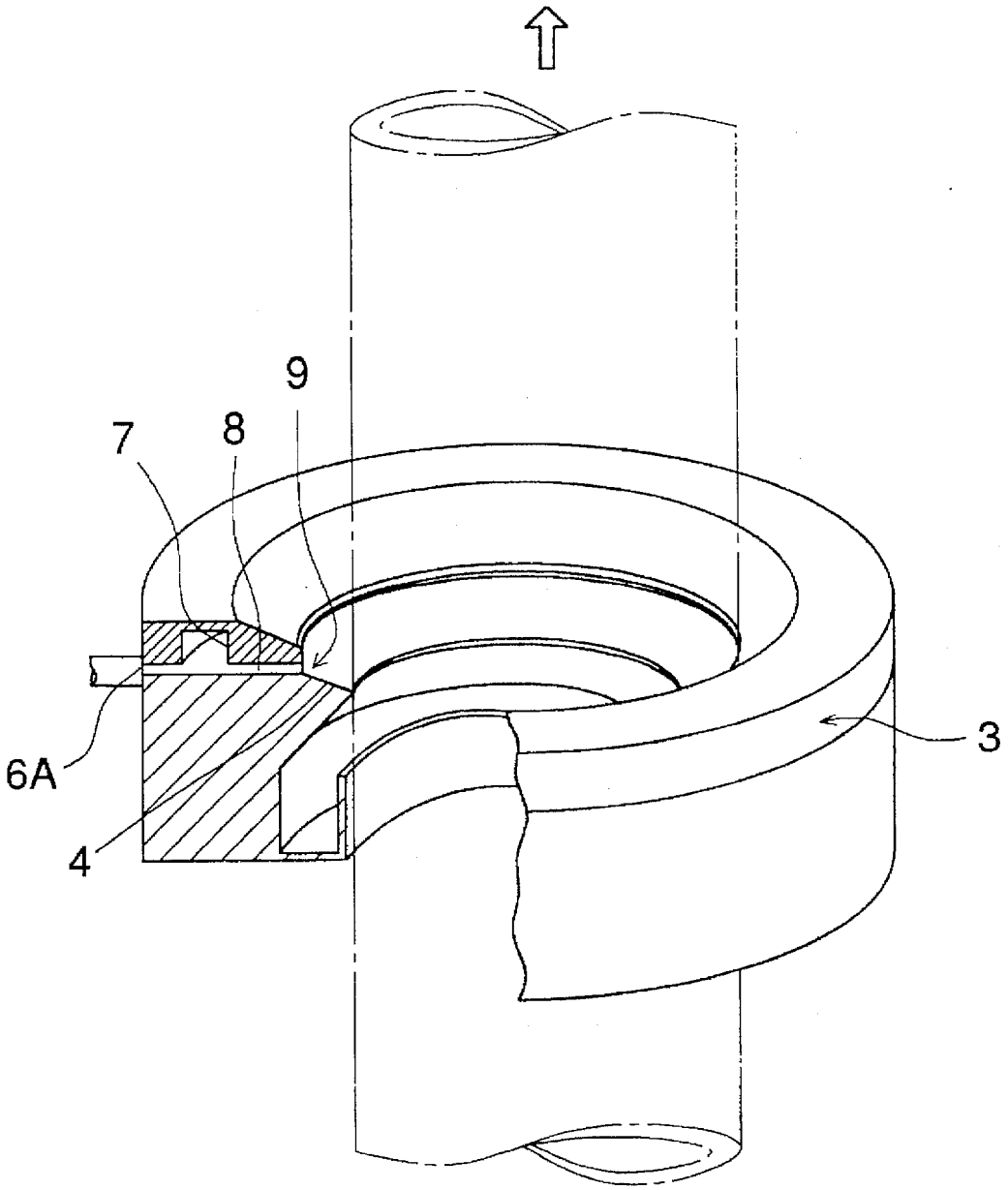
FIG. 2 is a perspective view of an example of a coating apparatus related to FIG. 1.

FIG. 2 is a perspective view showing an example of a coating apparatus shown in FIG. 1, and in particular, a perspective view showing a part of the coating apparatus that is cut open.

Figure 3:
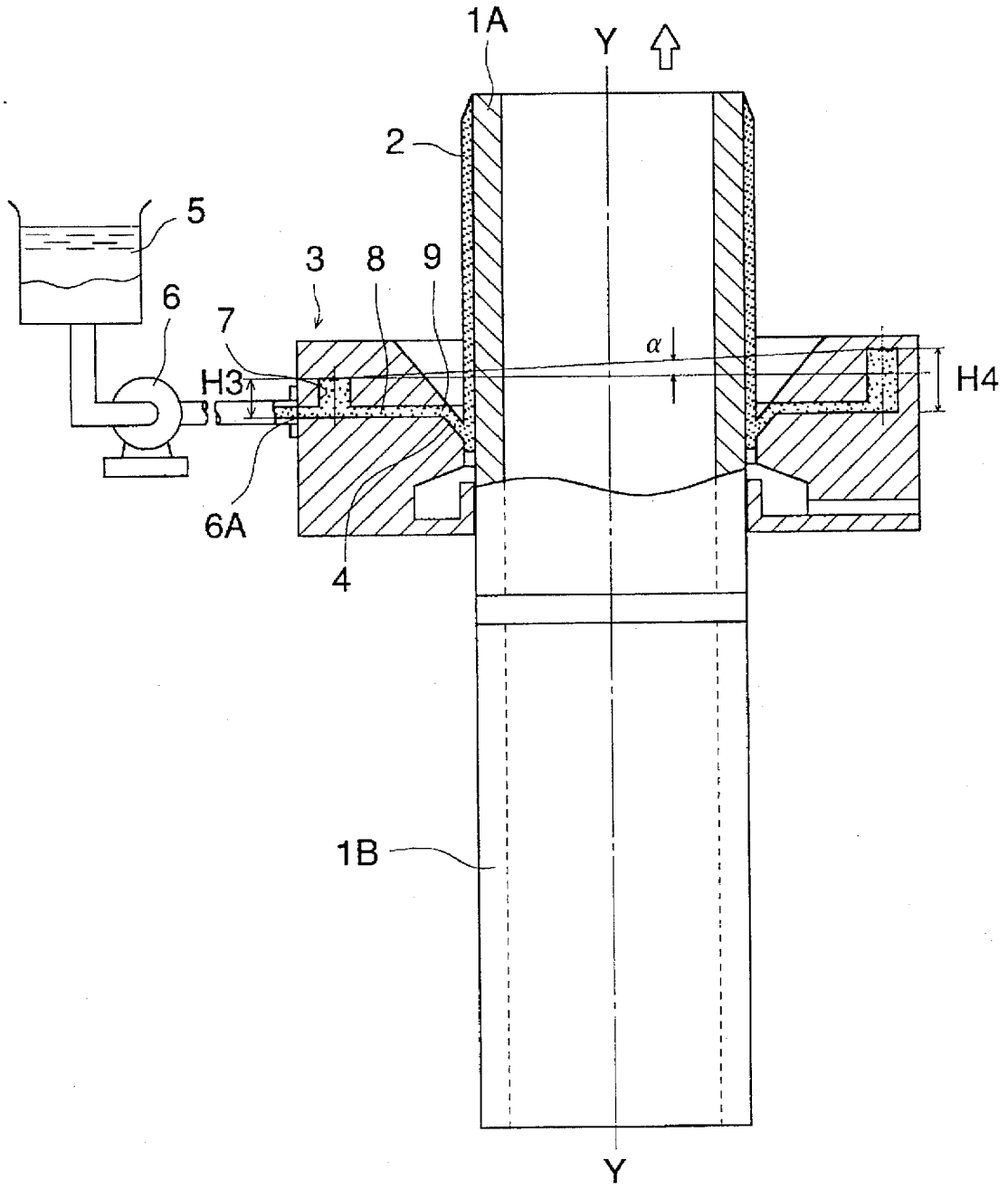
FIG. 3 is a sectional view of another example of a coating apparatus related to the invention.

FIG. 3 is a sectional view of another coating apparatus of the invention, wherein the height H3 of the solution distributing chamber 7 at the supply inlet side is different from the height H4 of the solution distributing chamber 7 at the side farthest from the supply inlet side. Incidentally, items identical to those in FIG. 1 are given the same symbols and explanation for the items which are the same mechanically and functionally as those in FIG. 1 will be omitted.

The aforementioned solution distributing chamber 7 is slanted by an angle $\alpha$ as shown in the drawing at the inlet side and the side farthest from the inlet side. The range of the angle $\alpha$ depends on a diameter of a cylindrical base material and a size of a coating apparatus, and the angle that makes the ratio of H=H4/H3 to be 1.01 to 5 is preferable. hen is coated on the surface of the cylindrical base material 1. Since the end portion of the sliding surface and the cylindrical base material are arranged to have a clearance between them, the base material is not damaged in the course of coating, and even when many layers each differing in nature from others are formed, layers already coated are not damaged. Further, even in the case of multi-layer coating of layers which are different in nature each other and are dissolved in the same solvent, the time of existence in the solvent is much less compared with that in the dip coating method. Therefore, components in the lower layers hardly flow out to the upper layer side and they do not flow out to the coated layer in the coating. A coating method of the invention can be used for an electrophotographic photoreceptor requiring a thin and uniform coated layer, manufacture of electrostatic recording material, coating on the surface of a roller, and layer forming on the external circumferential surface of an endless belt or the like, and there is no restriction for application. Namely, it is used as a coating method for coating on an external circumferential surface of a base material having a continuous surface formed endlessly. In the course of coating, a base material itself may move, a coating apparatus may move, or a cylindrical base material may further rotate.

Figure 4:
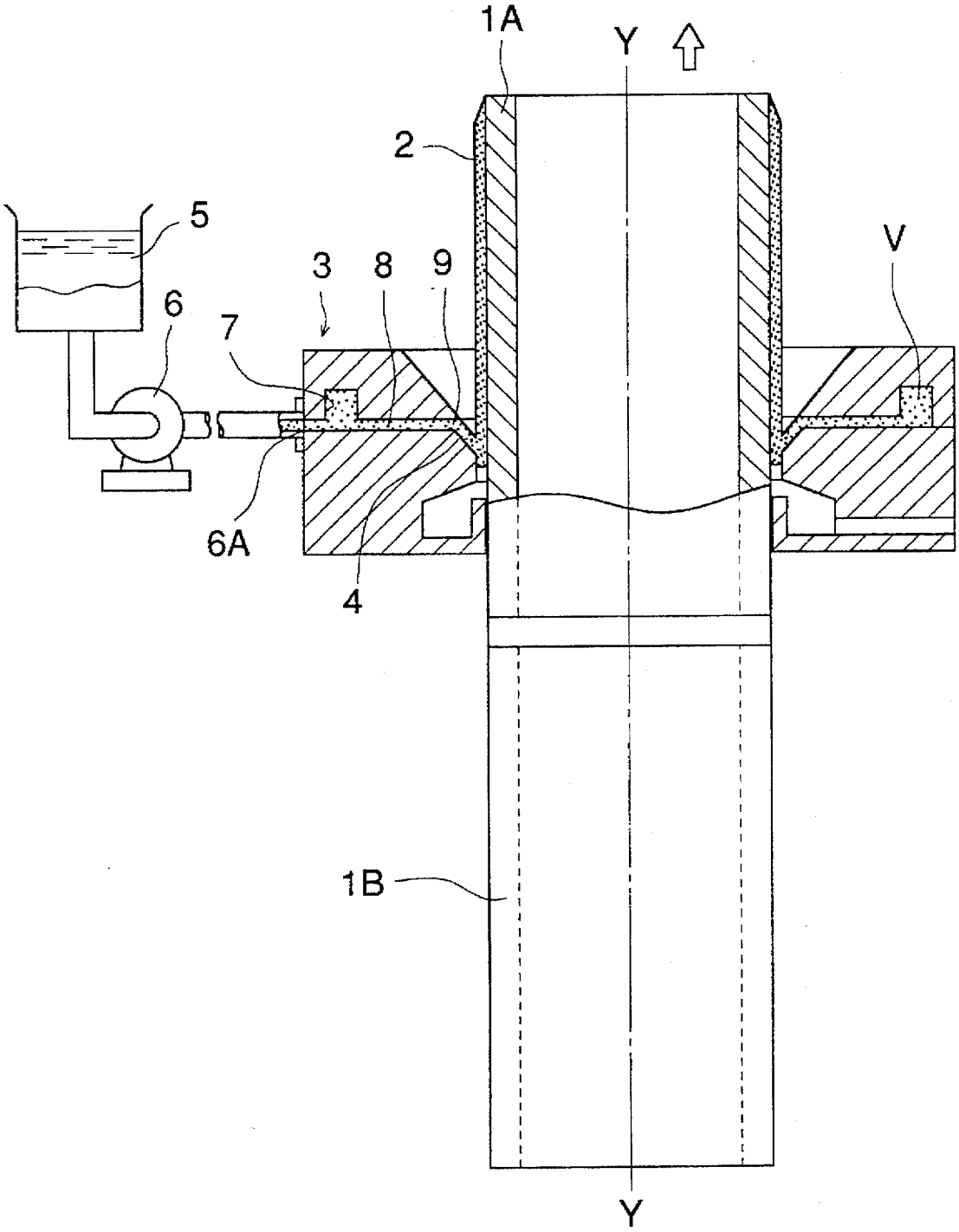
FIG. 4 is a sectional view of still another example of a coating apparatus related to the invention.

FIG. 4 is a sectional view of another example of a coating apparatus related to the invention. Incidentally, items identical to those in FIG. 1 are given the same symbols and explanation for the items which are the same mechanically and functionally as those in FIG. 1 will be omitted. It is preferable that a volume of the solution distributing chamber 7 is 20–1000 cc.

There will be shown below the examples and comparative examples wherein coating solutions 2 were coated on the cylindrical base materials 1A and 1B by the use of the coating apparatus mentioned above.

EXAMPLE 1-1

As a conductive support for cylindrical base materials hereinafter (which may be called a coated drum) 1A and 1B, a support of a mirror-finished aluminum drum having a diameter of 80 mm and a height of 355 mm was used. Coating was conducted on the aforesaid support by the use of a coating apparatus of a slide hopper type as shown in FIG. 1 after adjusting coating solution composition UCL-1 as shown below and adjusting the height and dimension ratio of the solution distributing chamber as shown in Table 1, and thereby, coated drums No. A1-1–No. A1-3 were obtained.

| UCL-1 coating solution composition | |
|---|---|
| Copolymer nylon resin (CM-8000, made by Toray) | 2 g |
| Methanol/n-butanol = 10/1 (ratio by volume) | 1000 g |
| Coating Condition | |
| Volume of solution chamber | 150 cc |
| Flow velocity at a feeding port | 0.26 cm/sec. |
| Viscossity of solution | 3 milipascal · sec |
| Coater gap | 100 μm |
| Slit gap | 50 μm |
| Coating speed | 20 mm/sec |

The results are shown in Table 1.

TABLE 1

| Coating solution drum No. | A1-1 | A1-2 | A1-3 |
|---|---|---|---|
| Solution reservoir chamber height H2 (mm) | 5 | 30 | 50 |
| Slid gap H1 (μm) | 150 | 100 | 50 |
| Dimension ratio | 33 | 300 | 1000 |
| Coatability | A | A | A |

Note: A: good, B: bad

EXAMPLE 1-2

Coating was conducted on the cylindrical lease materials used in Example 1-1 (not coated) in the same manner as Example 1-1 except that coating solution composition CGL-1 as shown below in stead of UCL-1 coating solution was coated, and thereby, coated drums No. A2-1–No. A2-3 were obtained.

| CGL-1 coating solution composition Y | |
|---|---|
| Fluorenone type disazo pigment (CGM-1) | 25 g |
| Butyral resin (Eslec BX-L, made by Sekisui Kagaku) | 10 g |
| Methyl ethyl ketone | 1430 ml |

The aforesaid coating solution compositions were dispersed by a sand mill for 20 hours.

A chemical formula of the aforementioned CGM-1 is shown below.

CGM-1

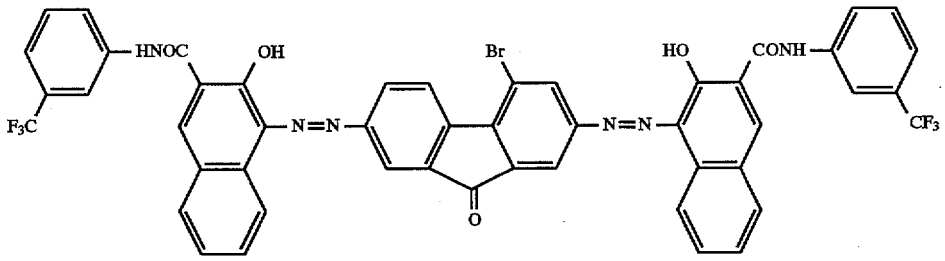

-continued

| Coating Condition | |
|---|---|
| Volume of solution chamber | 150 cc |
| Flow velocity at a feeding port | 0.48 cm/sec. |
| Viscossity of solution | 5 milipascal · sec |
| Coater gap | 100 μm |
| Slit gap | 50 μm |
| Coating speed | 20 mm/sec |

The results of the coating are shown in Table 2.

TABLE 2

| Coating solution drum No. | A2-1 | A2-2 | A2-3 |
|---|---|---|---|
| Solution reservoir chamber height H2 (mm) | 5 | 30 | 50 |
| Slid gap H1 (μm) | 150 | 100 | 50 |
| Dimension ratio | 33 | 300 | 1000 |
| Coatability | A | A | A |

Note: A: good, B: bad

EXAMPLE 1-3

Examples and comparative examples

Coating was conducted on the cylindrical base material used in Example 1-1 in the same manner as Example 1-1 except that solution composition CTL-1 as shown below in stead of UCL-1 coating solution was coated and adjusting the height and dimension ratio of the solution distributing chamber as shown in Table 3, and thereby coated drums No. A3-1–No. A3-7 were obtained.

| CTL-1 coating solution composition | |
|---|---|
| CTM-1 | 500 g |
| Polycarbonate (Z-200, made by Mitsubishi Gas) | 560 g |
| 1,2-dichloroethane | 2800 ml A |

chemical formula of the aforementioned CTM-1 is shown below.

CTM-1

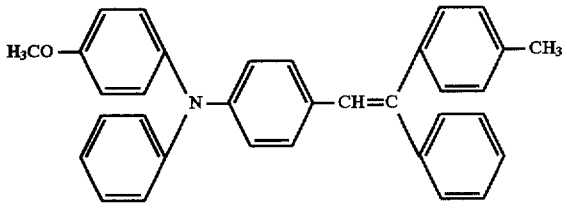

| Coating Condition | |
|---|---|
| Volume of solution chamber | 150 cc |
| Flow velocity at a feeding port | 1.0 cm/sec. |
| Viscossity of solution | 100 milipascal · sec |
| Coater gap | 100 μm |
| Slit gap | 300 μm |
| Coating speed | 20 mm/sec |

The results of the coating are shown in Table 3.

TABLE 3

| Coating solution drum No. | A3-1 | A3-2 | A3-3 | A3-4 | A3-5 | A3-6 | A3-7 |
|---|---|---|---|---|---|---|---|
| Solution reservior chamber height H2(mm) | 5 | 30 | 50 | 4 | 60 | 30 | 5 |
| Slid gap H1 (μm) | 500 | 600 | 50 | 200 | 600 | 25 | 1000 |
| Dimension ratio | 10 | 50 | 1000 | 20 | 100 | 1200 | 5 |
| Coatability | A | A | A | B Occurrence of uneven coating Great change in layer thickness in circumferential direction | B Same as the left Same as the left | B Same as the left Same as the left | B Same as the left Same as the left |

Note: A: good, B: bad

Figure 9:
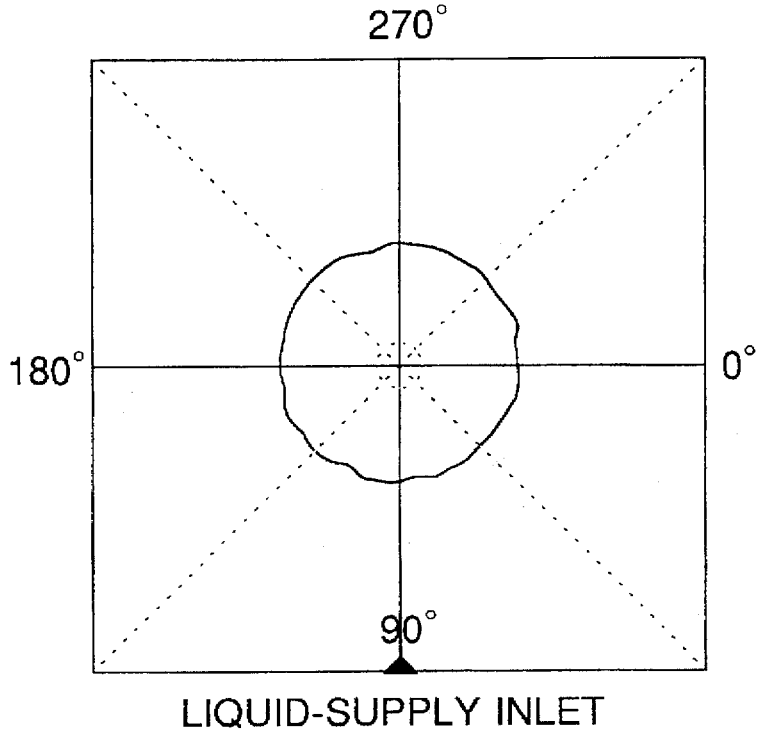
FIGS. 9(A) and 9(B) are represents a layer thickness profile in the circumferential direction of coated drums No. A3-2 and No. A3-5.
Figure 9:
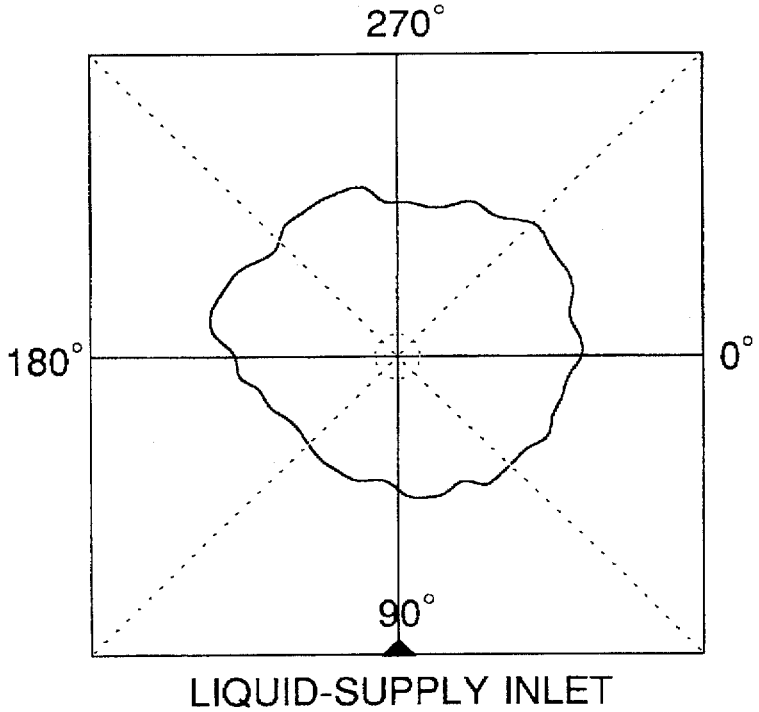

FIG. 9 shows a layer thickness profile in the circumferential direction for the coated drums Nos. A3-2 and A3-5, wherein FIG. 9(A) shows A3-2, and FIG. 9(B) shows A3-5. In the drawing, the position of 90° represents a supply inlet. As is shown in FIG. 9, the results of the samples of the invention are excellent.

EXAMPLE 1-4

Coating was conducted on cylindrical base material of Example 1-1 (not coated) in the same manner as Example 1-1 except that coating solution composition CGL-3 and CGL-4 as shown below are coated respectively in stead of UCL-1 coating solution, and thereby, coated drums No. A4-1–No. A4-6 were obtained.

| CGL-3 coating solution composition | |
|---|---|
| Y-type titanylphthalocyanine (CGM-3) | 10 g |
| Silicone resin (KR-5240, made by Shin-etsu Kagaku) | 10 g |
| T-butyl acetate | 1000 ml |

The aforesaid coating solution compositions were dispersed by a sand mill for 20 hours.

| CGL-4 coating solution composition | |
|---|---|
| Perylene type pigment (CGM-4) | 50 g |
| Butyral resin (Eslec BX-L, made by Sekisui Kagaku) | 50 g |
| Methyl ethyl ketone | 2400 ml |

The aforesaid coating solution compositions were dispersed by a sand mill for 20 hours.

Chemical formulas of the aforementioned CGM-3 and CGM-4 are shown below.

CGM-3 (Y-type titanylphthalocyanine)

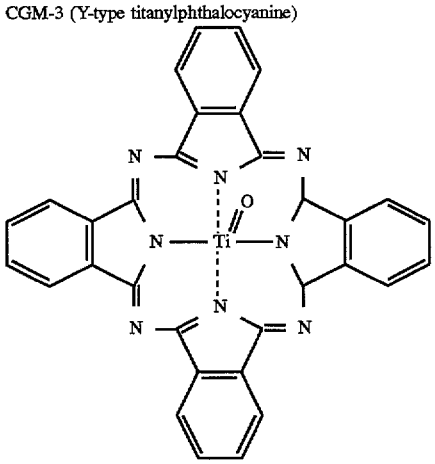

CGM-4 Mixture of (1) and (2)

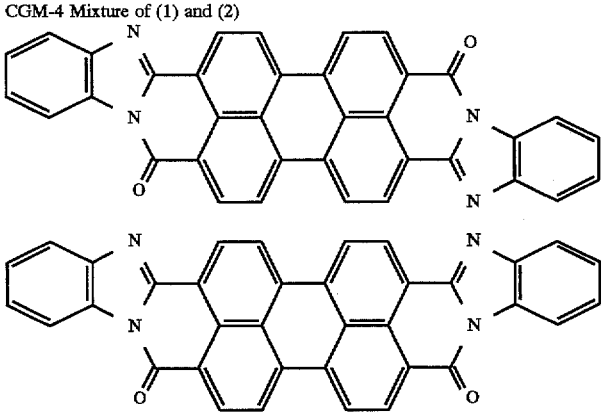

The results of the coating are shown in Table 4.

TABLE 4

| Coating solution drum No. | A4-1 | A4-2 | A4-3 | A4-4 | A4-5 | A4-6 |
|---|---|---|---|---|---|---|
| Coating solution composition | CGL-3 | CGL-3 | CGL-3 | CGL-4 | CGL-4 | CGL-4 |
| Solution reservoir chamber height H2(mm) | 50 | 30 | 5 | 40 | 20 | 30 |
| Slid gap H1 (μm) | 50 | 100 | 150 | 50 | 150 | 100 |
| Dimension ratio | 1000 | 300 | 33 | 800 | 133 | 300 |
| Coatability | A | A | A | A | A | A |

Note: A: good, B: bad

As apparent from Table 1 to 4, the coating method of the invention proved to be excellent to be free from a failure of beading of a coating solution, unevenness of coating, color unevenness and layer thickness variation, especially unevenness of coating in the circumferential direction.

Further, the solution reservoir chamber height and dimension ratio were adjusted as shown in Table 5, and CTL-2 coating solution compositions described below were coated on coated drums Nos. A4-1–A5-6, so that coated drums Nos. A5-1–A5-6 were obtained.

| CTL-2 coating solution composition | |
|---|---|
| CTM-2 | 500 g |
| Polycarbonate (Z-200, made by Mitsubishi Gas) | 560 g |
| 1,2-dichloroethane | 2800 ml |

A chemical formula of the aforementioned CTM-2 is shown below.

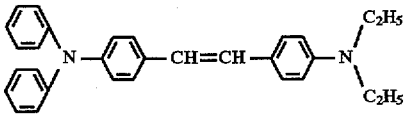

CTM-2

The results of the coating are shown in Table 5.

TABLE 5

| Coated drum No. | A5-1 | A5-2 | A5-3 | A5-4 | A5-5 | A5-6 |
|---|---|---|---|---|---|---|
| Lower layer | | | | | | |
| Lower layer coated drum No. | A4-1 | A4-2 | A4-3 | A4-4 | A4-5 | A4-6 |
| Drying of lower layer | Drying | Same as the left | Drying in drying zone | Same as the left | Same as the left | Same as the left |

TABLE 5-continued

| Coated drum No. | A5-1 | A5-2 | A5-3 | A5-4 | A5-5 | A5-6 |
|---|---|---|---|---|---|---|
| Upper layer | | | | | | |
| Height of solution reservoir chamber H2 (mm) | 20 | 30 | 50 | 50 | 20 | 30 |
| Slid gap H1 (μm) | 250 | 300 | 250 | 100 | 200 | 250 |
| Dimension ratio | 80 | 100 | 200 | 500 | 100 | 120 |
| Coatability | A Excellent multi-layer with uniform layer thickness | A Same as the left | A Same as the left | A Same as the left | A Same as the left | A Same as the left |

A: Good, B: bad

Actual photographing tests made by the use of a multi-layer organic photoreceptor incorporated as shown in Table 5 showed that excellent images without any image unevenness caused by uneven coating can be obtained in the coating method of the invention.

Examples and comparative examples

As a conductive support for cylindrical base materials (which may be called a coated drum) 1A and 1B, a support of a mirror-finished aluminum drum having a diameter of 80 mm and a height of 355 mm was used. Coating was conducted on the aforesaid support by the use of a coating apparatus of a slide hopper type (H ratio) as shown in FIG. 3 after adjusting coating solution composition UCL-1–3 as shown below and adjusting as shown in Table 6, and thereby, coated drums No. B1-1–No. B1-7 were obtained.

| | |
|---|---|
| UCL-1 coating solution composition | |
| UCL-2 coating solution composition | |
| Vinylchloride-vinylacetate copolymer (Eslec MF-10, made by Sekisui Kagaku) | 5 g |
| Acetone/cyclohexanone = 10/1 (ratio by volume) | 700 g |
| UCL-3 coating solution composition | |
| Ethylene-vinylacetate copolymer (Elbax 4260, made by Mitsui Dupont Chemical) | 50 g |
| Toluene/n-butanol = 5/1 (ratio by volume) | 2000 ml |

The results of the coating are shown in Table 6.

TABLE 6

| Coated drum No. | B1-1 | B1-2 | B1-3 | B1-4 | B1-5 | B1-6 | B1-7 |
|---|---|---|---|---|---|---|---|
| Coating solution composition | UCL-1 | UCL-1 | UCL-2 | UCL-2 | UCL-3 | UCL-3 | UCL-2 |
| H ratio (H4/H3) | 1.01 | 1.0 | 1.5 | 2.5 | 3.5 | 5.0 | 1.00 |
| Coatability | A | A | A | A | A | A | B Unevenness of coated layer in circumferential direction observed |

Note: A: good, B: bad

EXAMPLE 2-2

Examples and comparative examples

Coating was conducted on the cylindrical base materials of Example 2-1 (not coated) by the use of a coating apparatus of a slide hopper type (H ratio) as shown in FIG. 3 after adjusting coating solution composition CGL-1, -3 and -4 and adjusting as shown in Table 7, and thereby, coated drums No. B2-1–No. B2-7 were obtained.

The results of the coating are shown in Table 7.

TABLE 7

| Coated drum No. | B2-1 | B2-2 | B2-3 | B2-4 | B2-5 | B2-6 | B2-7 |
|---|---|---|---|---|---|---|---|
| Coating solution composition | CGL-1 | CGL-1 | CGL-3 | CGL-3 | CGL-4 | CGL-4 | CGL-3 |
| H ratio (H4/H3) | 1.01 | 1.0 | 1.5 | 2.5 | 3.5 | 5.0 | 1.00 |
| Coatability | A | A | A | A | A | A | B Unevenness of coated layer in circumferential direction observed Color unevenness observed |

Note: A: good, B: bad

EXAMPLE 2-3

Examples and comparative examples

Coating was conducted on cylindrical base materials of Example 2-1 (not coated) by the use of a coating apparatus of a slide hopper type (H ratio) as shown in FIG. 3 after adjusting coating solution composition CTL-1 and adjusting as shown in Table 8, and thereby, coated drums Nos. B3-1–B3-3 were obtained.

The results of the coating are shown in Table 8.

TABLE 8

| Coated drum No. | B3-1 | B3-2 | B3-3 |
|---|---|---|---|
| H ratio (H4/H3) | 1.02 | 2.5 | 1.0 |
| Coatability | A | A | B Unevenness of coated layer in circumferential direction observed |

Note: A: good, B: bad

Figure 10:
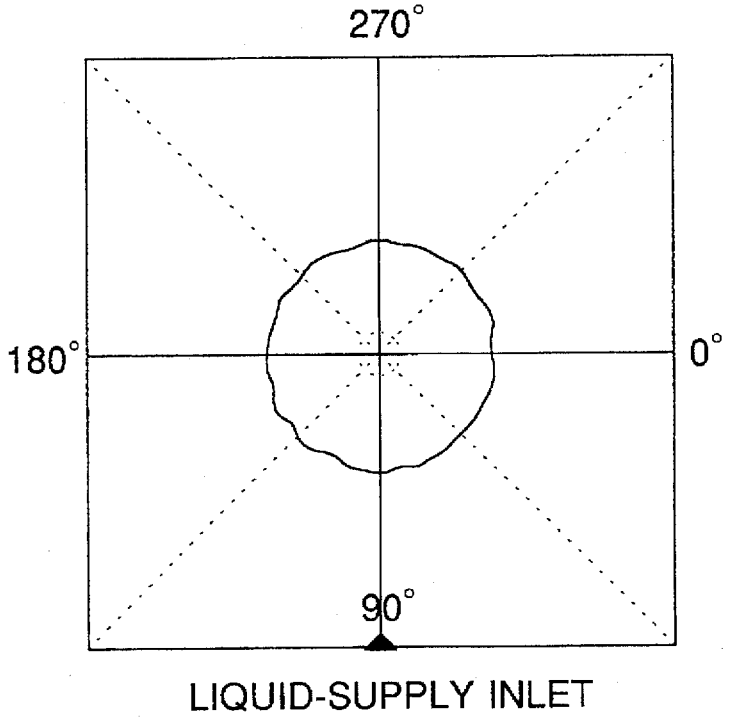
FIGS. 10(A) and 10(B) represent a layer thickness profile in the circumferential direction of coated drums No. B3-1 and No. B3-3.
Figure 10:
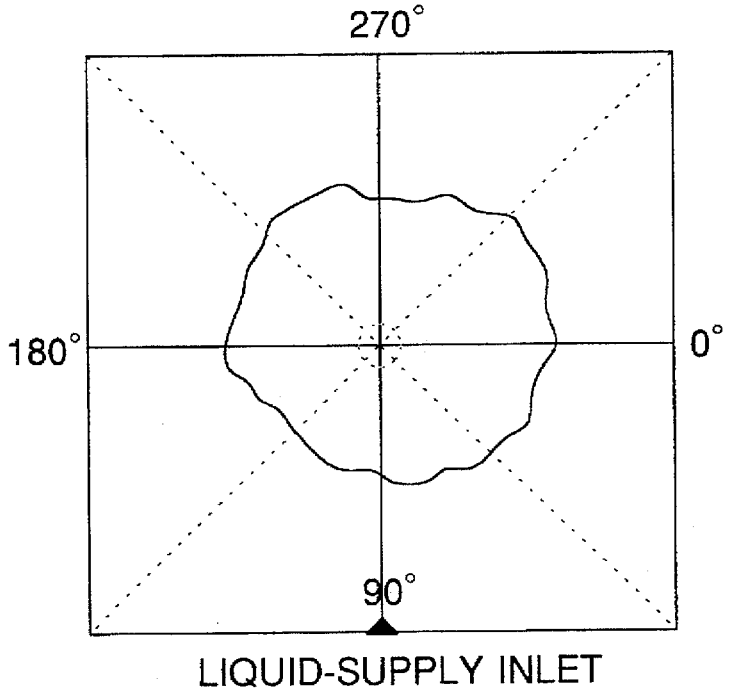

As apparent from Table 6 to 8, the coating method of the invention proved to be excellent to be free from unevenness of coating, color unevenness, blurred coated layers (failure of beading), and layer thickness variation, especially its unevenness in the circumferential direction. Further, FIG. 10 shows profiles of layer thickness in the circumferential direction of coated drums Nos. B3-1 and B3-3, in which FIG. 10(A) shows B3-1 and FIG. 10(B) shows B3-3. A3-5, wherein FIG. 9(A) shows A3-2, and FIG. 9(B) shows A3-5. In the drawing, the position of 90° represents a supply inlet. As is shown in the drawing, the results of the samples of the invention are excellent.

EXAMPLE 2-4

On the coated drums in Example 2 from No. B2-1 to No. B2-6, coating solution compositions CTL-1 in Example 2-3 were coated on a multi-layer basis successively as shown in Table 9 by the use of a slide hopper type coating apparatus (H ratio) shown in FIG. 3.

The results of the coating are shown in Table 9.

TABLE 9

| Coated drum No. | B2-1 | B2-2 | B2-3 | B2-4 | B2-5 | B2-6 |
|---|---|---|---|---|---|---|
| H ratio (H4/H3) | 1.01 | 1.2 | 1.7 | 2.0 | 2.5 | 3.0 |
| Coatability | A | A | A | A | A | A |

Note: A: good

As shown in Table 9, coatability was excellent and no unevenness in coated layer thickness in the circumferential direction was observed.

EXAMPLE 3-1

Examples and comparative examples

As a conductive support for cylindrical base materials (which may be called a coated drum) 1A and 1B, a support of a mirror-finished aluminum drum having a diameter of 80 mm and a height of 355 mm was used. Coating was conducted on the aforesaid support by the use of a coating apparatus of a slide hopper type (with changed volume of solution distributing chamber) as shown in FIG. 4 after adjusting coating solution composition UCL-1–3 and adjusting as shown in Table 10, and thereby, coated drums Nos. C1-1–C1-7 were obtained.

The results of the coating are shown in Table 10.

TABLE 10

| Coated drum No. | C1-1 | C1-2 | C1-3 | C1-4 | C1-5 | C1-6 | C1-7 |
|---|---|---|---|---|---|---|---|
| Coating solution composition | UCL-1 | UCL-1 | UCL-2 | UCL-2 | UCL-3 | UCL-1 | UCL-1 |
| Volume of solution reservoir chamber (cc) | 20 | 100 | 750 | 1000 | 750 | 10 | 1200 |

TABLE 10-continued

| Coated drum No. | C1-1 | C1-2 | C1-3 | C1-4 | C1-5 | C1-6 | C1-7 |
|---|---|---|---|---|---|---|---|
| Flow rate (cm/sec) | 0.01 | 0.05 | 0.7 | 1.0 | 1.0 | 0.005 | 0.7 |
| Coatability | A | A | A | A | A | B Uneven coated layer observed Circumferential and longitudinal direction | B Uneven coated layer observed Circumferential and longitudinal direction |

Note: A: good, B: bad

EXAMPLE 3-2

Examples and comparative examples

Coating was conducted on the cylindrical base materials of Example 3-1 (not coated) by the use of a coating apparatus of a slide hopper type (with changed volume of solution distributing chamber) as shown in FIG. 4 after adjusting coating solution composition CGL-1, -3 and -4 and adjusting as shown in Table 11, and thereby, coated drums Nos. C2-1–C2-7 were obtained.

The results of the coating are shown in Table 11.

TABLE 11

| Coated drum No. | C2-1 | C2-2 | C2-3 | C2-4 | C2-5 | C2-6 | C2-7 |
|---|---|---|---|---|---|---|---|
| Coating solution composition | CGL-1 | CGL-1 | CGL-3 | CGL-3 | CGL-4 | CGL-1 | CGL-1 |
| Volume of solution reservoir chamber (cc) | 20 | 750 | 1000 | 750 | 750 | 10 | 1200 |
| Flow rate (cm/sec) | 0.05 | 0.1 | 0.5 | 0.8 | 1.0 | 0.1 | 1.5 |
| Coatability | A | A | A | A | A | B Uneven coated layer observed Circumferential and longitudinal direction | B Same as the left |

Note: A: good, B: bad

EXAMPLE 3-3

Coating was conducted on the cylindrical base materials of Example 3-1 (not coated) by the use of a coating apparatus of a slide hopper type (with changed volume of solution distributing chamber) as shown in FIG. 4 after adjusting coating solution composition CTL-1 and adjusting as shown in Table 12, and thereby, coated drums Nos. C3-1–C3-4 were obtained.

The results of the coating are shown in Table 12.

TABLE 12

| Coated drum No. | C3-1 | C3-2 | C3-3 | C3-4 |
|---|---|---|---|---|
| Volume of solution reservoir chamber (cc) | 25 | 950 | 5 | 1200 |
| Coatability | A | A | B | B |

Note: A: good, B: bad

As apparent from Table 10 to 12, the coating method of the invention proved to be excellent to be free from blurred coated layers (failure of beading), unevenness of coating, color unevenness, and layer thickness variation, especially its unevenness in the circumferential direction and longitudinal direction. FIG. 11 shows layer thickness profiles in the longitudinal and circumferential directions for coated drums Nos. C3-1 and C3-3, wherein FIG. 11(A-1) shows the longitudinal direction of C3-1, FIG. 11(A-2) shows the circumferential direction of C3-1, FIG. 11(B-1) shows the longitudinal direction of C3-1 and FIG. 11(B-2) shows the circumferential direction of C3-1. As in the drawings, good results were obtained in those of the invention.

EXAMPLE 3-4

On the coated drums in Example 2 from No. C2-1 to No. C2-5, coating solution compositions CTL-1 in Example 3 were coated on a multi-layer basis successively as shown in Table 13 by the use of a slide hopper type coating apparatus (with changed volume of solution distributing chamber) shown in FIG. 4.

The results of the coating are shown in Table 13.

TABLE 13

| Coated drum No. of lower layer | C2-1 | C2-2 | C2-3 | C2-4 | C2-5 |
|---|---|---|---|---|---|
| Volume of solution reservoir chamber (cc) | 25 | 25 | 750 | 750 | 950 |
| Coatability | A | A | A | A | A |

Note: A: good

As shown in Table 13, coatability was excellent and no unevenness in coated layer thickness in the circumferential and longitudinal directions was observed. After the actual photographing tests made by the use of a multi-layer organic photoreceptor incorporated, excellent images without any image unevenness caused by uneven coating were obtained.

Figure 5:
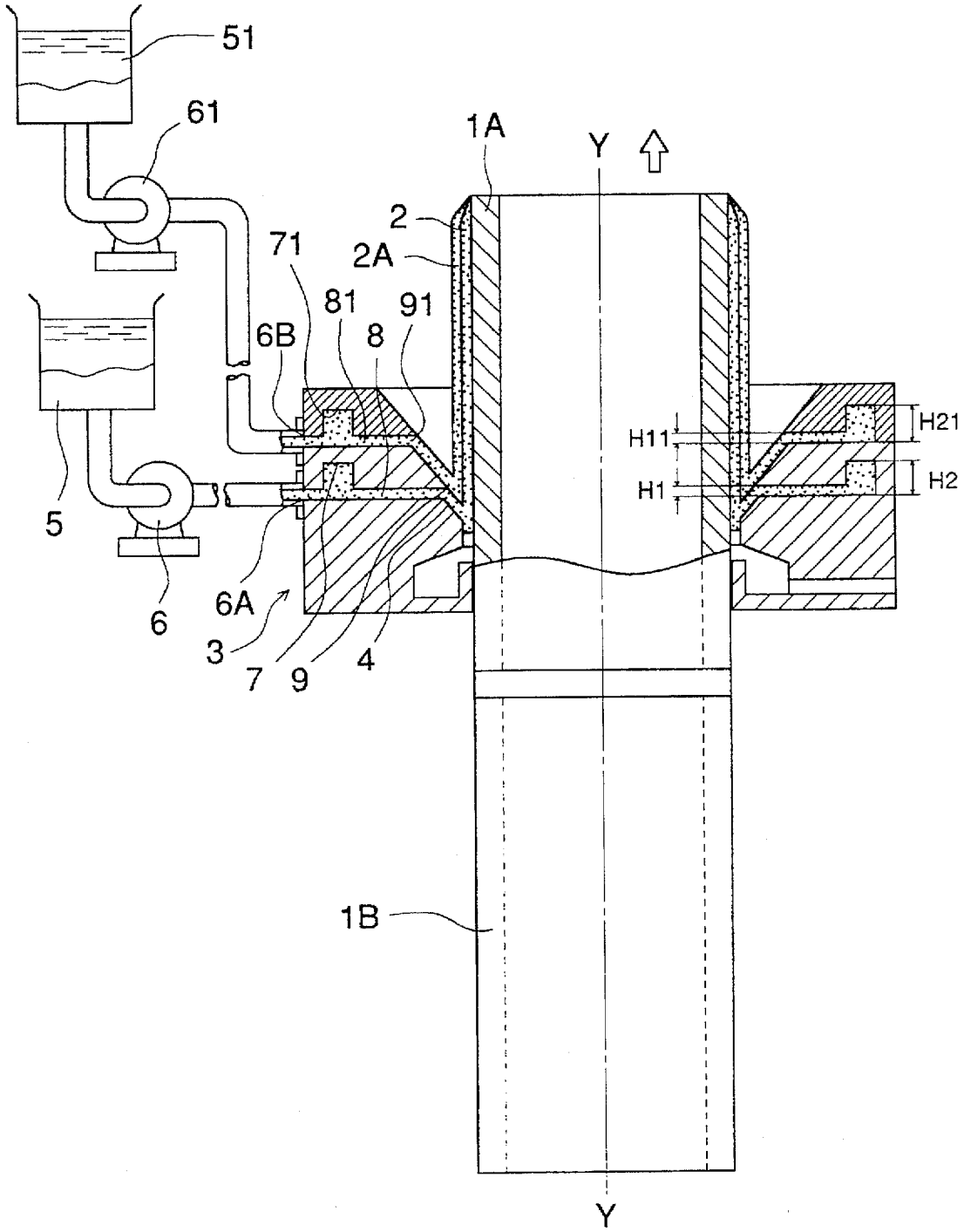
FIG. 5 is a sectional view of still more another example of a coating apparatus related to the invention.

FIG. 5 is a sectional view of another coating apparatus of the invention which, in particular, is one modified from the coating apparatus shown in FIG. 1 for the simultaneous multi-layer coating. As is shown in the drawing, hopper coating surface 4 for coating solutions 2 and 2A is formed to surround the aforesaid cylindrical base material 1A so that coating solutions 2 and 2A supplied to the hopper coating surface 4 may be coated on the cylindrical base material 1A in succession. In the coating method, the aforesaid coating head 3 is fixed, and it coats, starting from the upper end portion of the cylindrical base material 1A while the cylindrical base material is moved upward along center line Y in the arrowed direction. For the purpose of supplying coating solutions 2 and 2A to the hopper coating surface 4 of the coating head 3, coating solution supply portion 6A of solution supply pump 6 is attached on the lower position and coating solution supply portion 6B of solution supply pump 61 is attached on the upper position, both on the coating head so that coating solution tanks 5 and 51 provided outside may be respectively connected to the coating head 3 for supplying coating solutions 2 and 2A.

Then, with regard to the supplied coating solutions 2 and 2A, the coating solution 2 is supplied to ring-shaped solution distributing chamber 7 formed in the coating head 3, while the coating solution 2A is supplied to ring-shaped solution distributing chamber 71 formed in the coating head 3. The coating solution 2 thus supplied is further supplied continuously to the hopper coating surface 4 from coating solution distributing slit 8 through endless coating solution flow out port 9, first, thus the coating solution 2 is coated on the entire surface of the cylindrical base material 1A.

The coating solution 2A is further supplied to the coating solution distributing chamber 71. The coating solution 2A thus supplied is further supplied continuously on the surface of the coated coating solution 2 from coating solution distributing slit 81 through endless coating solution flow out port 91, thus coating solution 2A is multi-layer-coated on the surface of coating solution 2 coated on the entire surface of the cylindrical base material 1A, first. Incidentally, H1 and H11 represent a slit gap and H21 and H22 represent a height of a solution distributing chamber, wherein a ratio of H2 to H1 takes a prescribed value.

Figure 6:
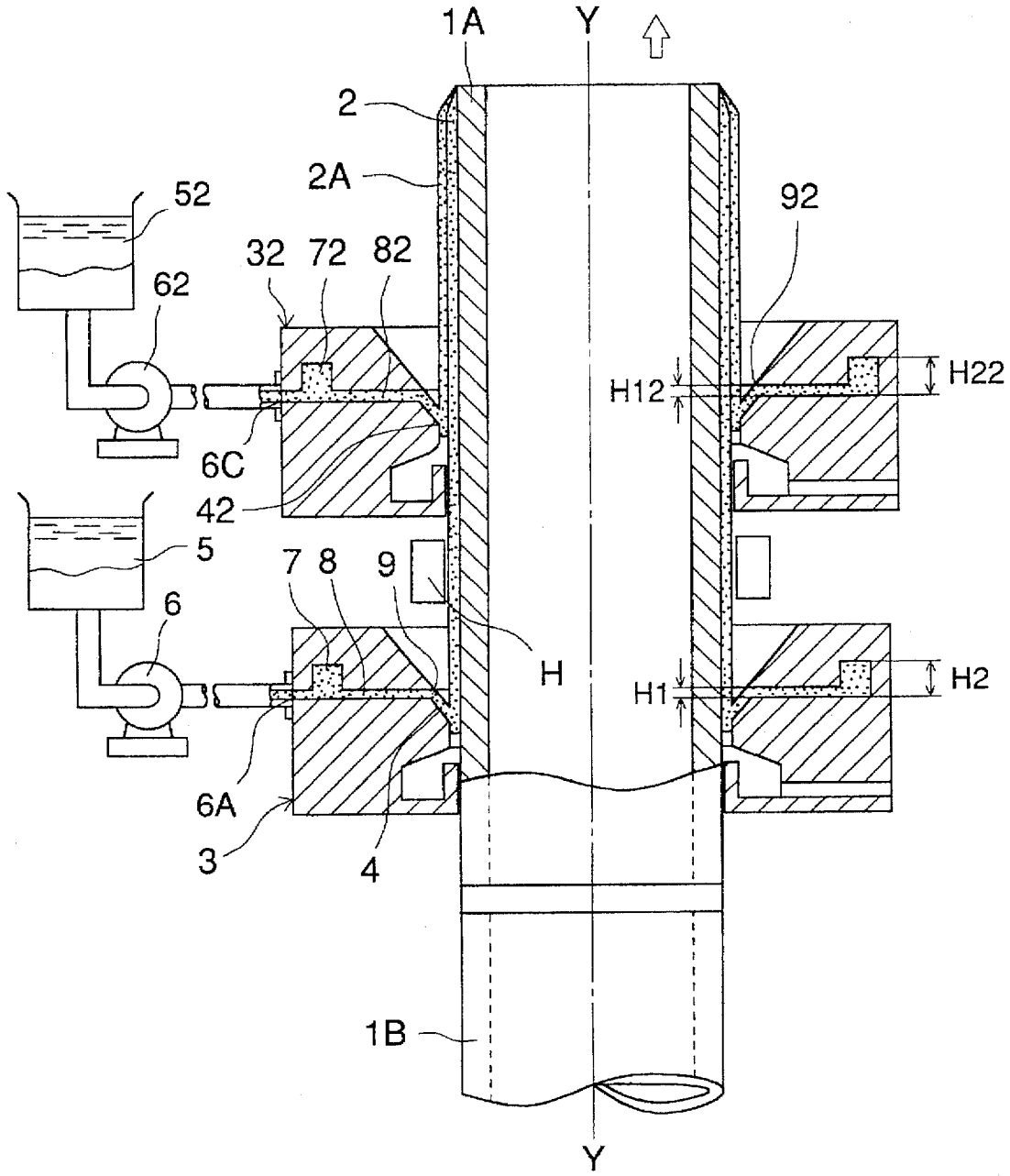
FIG. 6 is a sectional view of another example of a coating apparatus related to the invention.

FIG. 6 is a sectional view of another coating apparatus of the invention which is, in particular, a coating apparatus wherein two of the coating apparatus shown in FIG. 1 are arranged vertically to coat in succession on a multi-layer basis. In the same manner as in FIG. 1, coating solution 2 supplied to hopper coating surface 4 is coated successively on the cylindrical base material 1A.

Coating head 32 is further provided above the coating head 3, and coating solution 2 for the first layer is coated, and then is dried by heat source H, and cylindrical base material 1A is moved upward in the arrowed direction to enter the coating surface 42 of the coating head 32. Coating solution 42 supplied to the hopper coating surface 42 is coated on the coating solution 2 coated already on the cylindrical base material 1A on a multi-layer basis in succession. The aforesaid coating head 32 is fixed, at it coats, starting from the upper end portion of the cylindrical base material 1A while the cylindrical base material is moved upward along center line Y in the arrowed direction. For the purpose of supply coating solution 2A to the hopper coating surface 42 of the coating head 32, coating solution supply portion 6C of solution feeding pump 62 (0026) is attached on the coating head so that coating solution tank 52 provided outside may be connected to the coating head 32 for supplying coating solution 2A. Then, the coating solution 2A thus supplied is further supplied to ring-shaped solution distributing chamber 72 formed in the coating head 32, and is supplied continuously to the hopper coating surface 42 from the coating solution distributing slit 82 through endless coating solution flow out port 92, thus, the coating solution 2A is coated on the entire surface of the coating solution 2 coated already on the cylindrical base material 1A. Incidentally, H1 and H12 represent a slit gap, and H2 and H22 represent a height of the solution distributing chamber.

Figure 7:
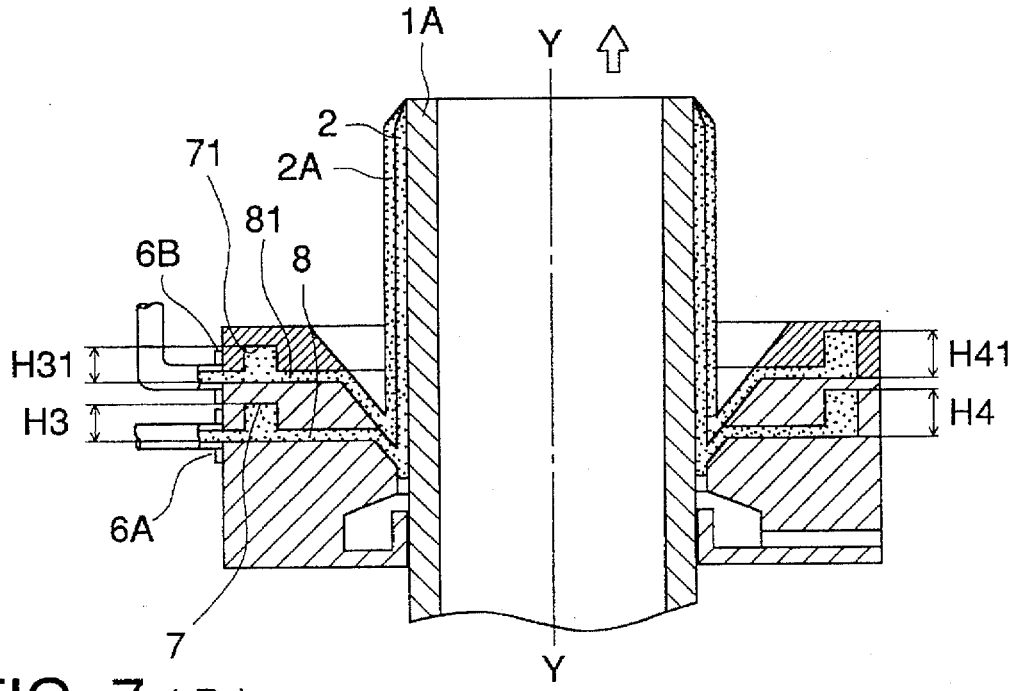
FIGS. 7(A) and 7(B) are sectional views of still another example of a coating apparatus related to the invention.
Figure 7:
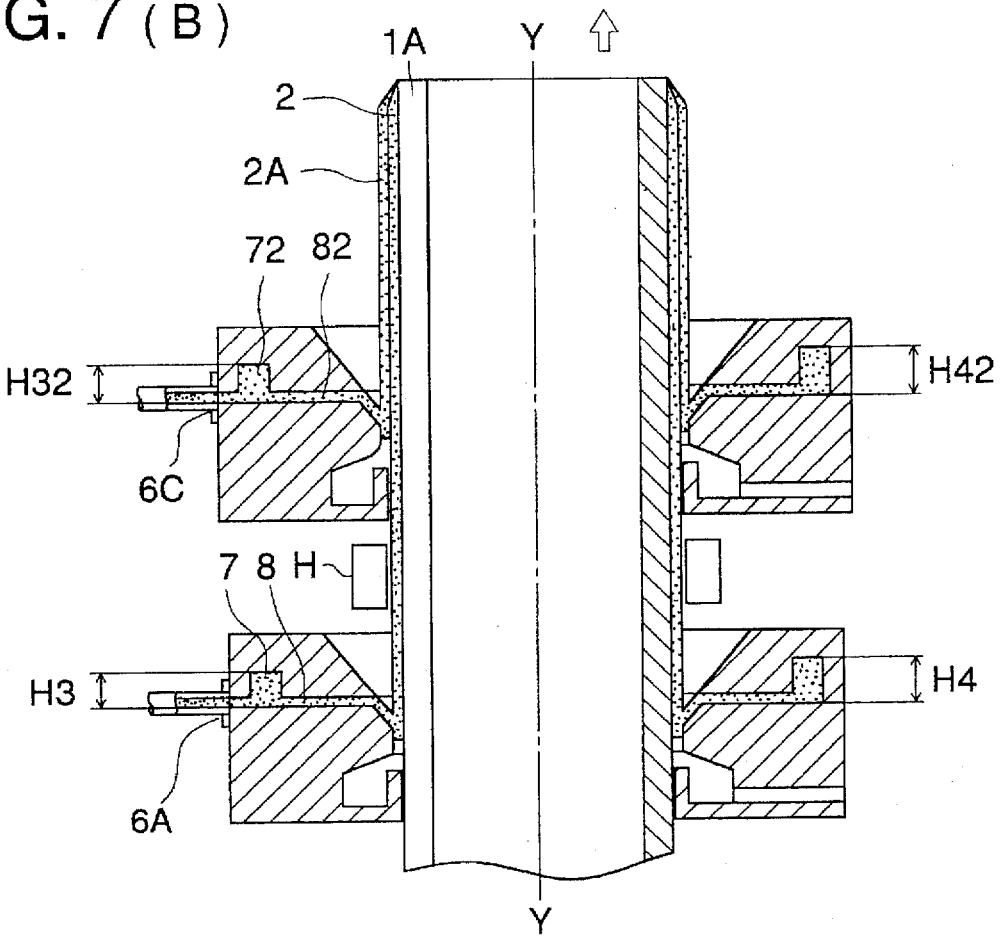

FIG. 7 is a sectional view of an example of another coating apparatus of the invention. Incidentally, members in the drawing which are the same as those in FIG. 3 are given the same symbols, and explanation of those remaining unchanged from those in FIG. 3 mechanically and functionally may be omitted. FIG. 7(A) shows an apparatus obtained by changing the coating apparatus in FIG. 3 so that simultaneous and multi-layer coating can be conducted. Coating solutions which become photoreceptors are coated on cylindrical base materials 1A and 1B simultaneously on a multi-layer basis. Ring-shaped solution distributing chambers 7 and 71 are respectively arranged to surround the cylindrical base material in a shape of a ring. H3 and H31 represent a height of a solution distributing chamber on the supply port side, while H4 and H41 represent a height of a solution distributing chamber on the side farthest from the supply port side.

H3 is different from H31 and H4 is different from H41. FIG. 7(B) shows a coating apparatus obtained by arranging two of the coating apparatus in FIG. 3 vertically so that multi-layer coating can be conducted. Coating solutions which become photoreceptors are coated on cylindrical base materials 1A and 1B simultaneously on a multi-layer basis. Ring-shaped solution distributing chambers 7 and 71 are respectively arranged to surround the cylindrical base material in a shape of a ring. Incidentally H3 and H32 represent a height of a solution distributing chamber on the supply port side, while H4 and H42 represent a height of a solution distributing chamber on the side farthest from the supply port side. H3 is different from H32 and H4 is different from H42.

Figure 8:
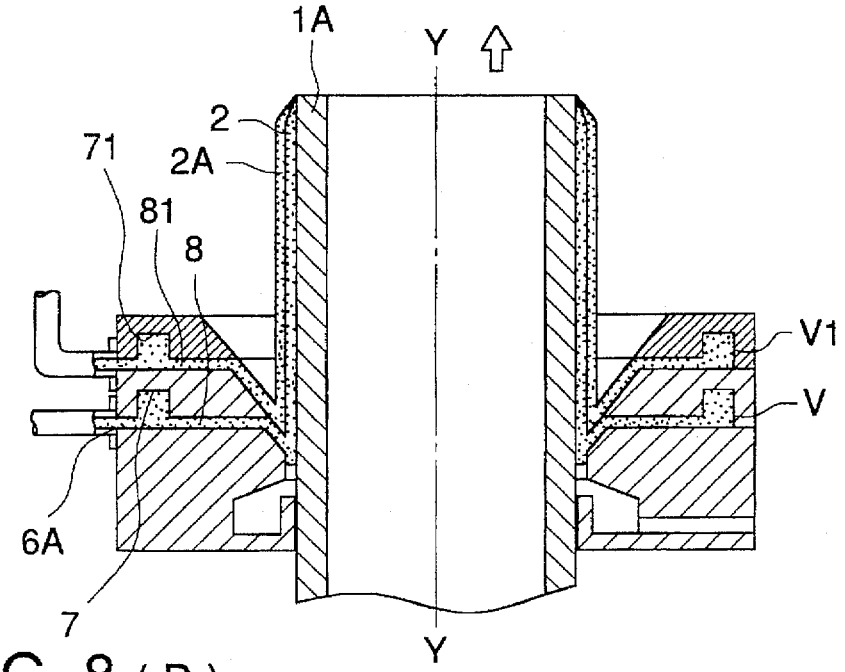
FIGS. 8(A) and 8(B) are sectional views of still more another example of a coating apparatus related to the invention.
Figure 8:
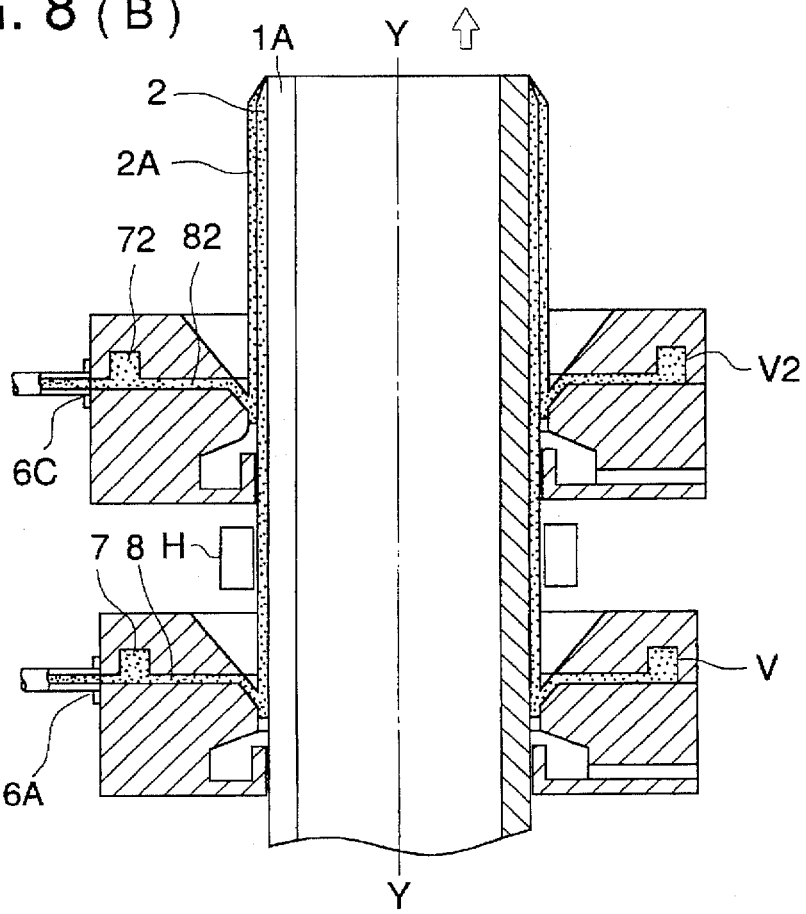

FIG. 8 is a sectional view of another example of a coating apparatus of the invention. Incidentally, members in the drawing which are the same as those in FIG. 4 are given the same symbols, and explanation of those remaining unchanged from those in FIG. 4 mechanically and functionally may be omitted. FIG. 8(A) shows an apparatus obtained by changing the coating apparatus in FIG. 4 so that simultaneous and multi-layer coating can be conducted. Coating solutions which become photoreceptors are coated on cylindrical base materials 1A and 1B simultaneously on a multi-layer basis. Ring-shaped solution distributing chambers 7 and 71 are respectively arranged to surround, in a shape of a ring, the circumference of the cylindrical base material that moves in its longitudinal direction. It is preferable that each of volumes V and $V_1$ of the solution distributing chambers is 20–1000 c.c. FIG. 8(B) shows a coating apparatus obtained by arranging two of the coating apparatus in FIG. 4 vertically so that multi-layer coating can be conducted. Coating solutions which become photoreceptors are coated on cylindrical base materials 1A and 1B simultaneously on a multi-layer basis. Ring-shaped solution distributing chambers 7 and 72 are respectively arranged to surround, in a shape of a ring, the circumference of the cylindrical base material that moves in its longitudinal direction. It is preferable that each of volumes V and $V_2$ of the solution distributing chambers is 20–1000 c.c.

The dimension ratio, H ratio and volumes of solution distributing chambers mentioned above can offer the following effects.

Neither blurred coated layer (failure of beading) nor longitudinal uneven coating occurs in coating.

Even in the simultaneous and multi-layer coating, the effects identical to the foregoing can be offered.

Even in the successive and multi-layer coating, the effects identical to the foregoing can be offered.

Figure 12:
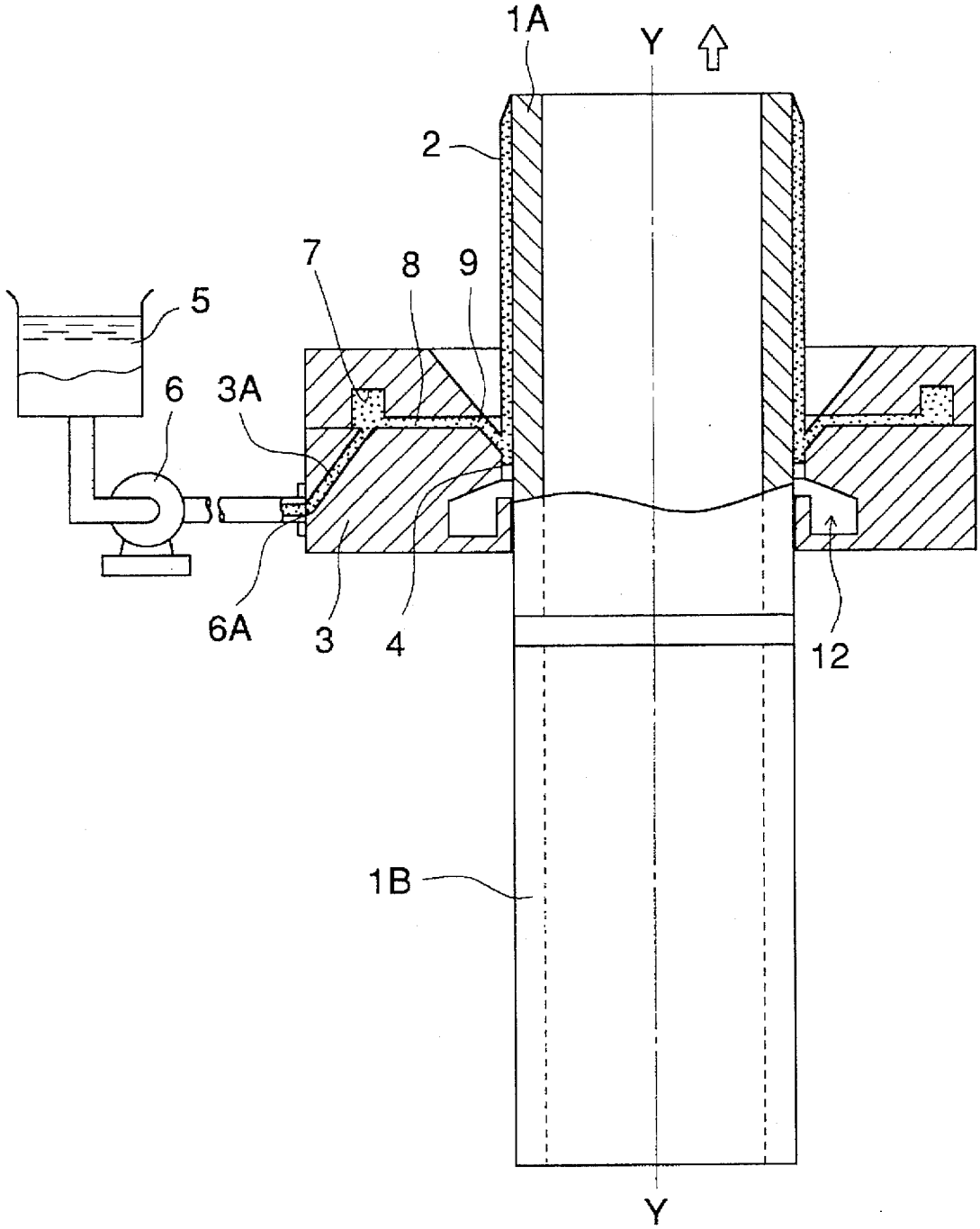
FIG. 12 is a longitudinal section showing the state of coating made by a coating apparatus whose example relating to a coating solution supply section of the invention is shown.

An explanation will be offered as follows on how the coating solution supply portion is structured. In a coating apparatus in FIG. 12, coating solution supply section 6A from the aforementioned solution supply pump 6 is provided to be positioned at the same height as coating solution distributing chamber 7, or it is positioned to be lower than the coating solution distributing chamber 7 so that communicating hole 3A is formed obliquely between the coating solution supply section 6A and the coating solution distributing chamber 7. When the supply of coating solution 2 to endless coating solution flow out port 9 from coating solution distributing slit 8 is started after the coating solution 2 is supplied to the coating solution distributing chamber 7, for the purpose of coating the coating solution 2 for photoreceptor on cylindrical base materials 1A and 1B successively, it is most preferable that the flow rate of the coating solution 2 from the coating solution supply section 6A is made to be 1–12 m/sec. Owing to the communicating hole 3A provided in the aforesaid manner, no bubbles are formed, at the start of coating, in the above-mentioned ring-shaped coating solution distributing chamber 7, the coating solution distributing slit and endless coating solution flow out port 9. It is therefore possible to prevent occurrence of failure of beading and uneven coating.

Figure 13:
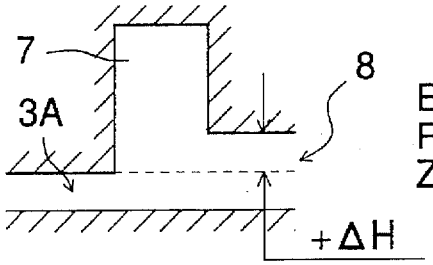
FIGS. 13(A) to 13(E) are sectional views showing a supply inlet for a coating solution in the example of coating apparatus in FIG. 12.
Figure 13:
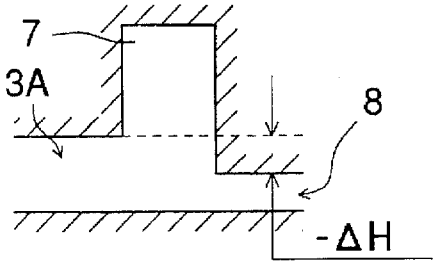
Figure 13:
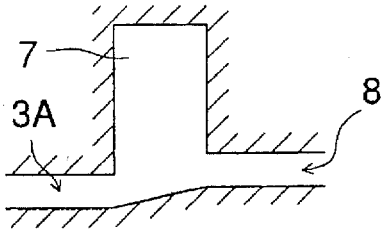
Figure 13:
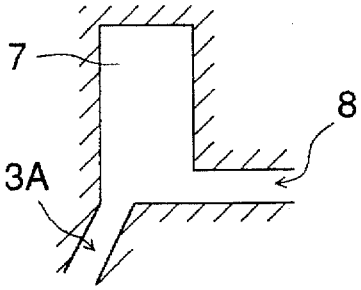
Figure 13:
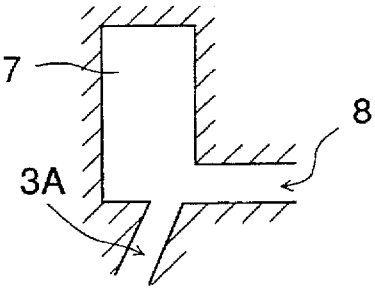

Each of FIGS. 13(A), (B), (C), (D) and (E) indicates communicating hole 3A provided between coating solution distributing chamber 7 and aforesaid coating solution supply section 6A, and positional relating between the communicating hole 3A and the coating solution distributing slit 8, wherein FIGS. 13(A), (C), (D) and (E) represent examples and FIG. 13(B) represents a comparative example.

In FIG. 13(A), the uppermost position of the communicating hole 3A is made to be lower by +ΔH than the uppermost position of the coating solution distributing slit 8. FIG. 13(B) shows a comparative example whose structure is opposite to that in FIG. 13(A), and the uppermost position of the communicating hole 3A is higher than the uppermost position of the coating solution distributing slit 8 by −ΔH. In this case, stability of a coated surface to the cylindrical base materials 1A and 1B tends to be poor, resulting in failure of beading, layer thickness variation and air inhaling, thus, coating unevenness tends to happen, and uneven layer thickness occurs in the longitudinal direction and circumferential direction of the cylindrical base materials 1A and 1B. In FIG. 13(C), the communicating hole 3A is formed to be slightly lower than the coating solution distributing slit 8. In FIG. 13(D), the communicating hole 3A is formed to be aslant upward to the coating solution distributing chamber 7 toward the coating solution distributing slit 8. In FIG. 13(D), the communicating hole 3A is formed to be aslant upward to the coating solution distributing chamber 7 toward the coating solution distributing slit 8, as in FIG. 13(D), and the communicating hole 3A is opened to both the coating solution distributing chamber 7 and the coating solution distributing slit 8. Incidentally, ΔH represents a difference between the uppermost position at an inlet of the coating solution distributing slit 8 and the uppermost position of a pipe of the communicating hole 3A.

In the comparative tests made by the inventors of the invention, when the coating solution supply section 3A is provided to be the same in height as an opening of the coating solution distributing slit 8, or provided to be lower by ΔH as illustrated, coating unevenness of a coated layer in its circumferential and longitudinal directions does not occur, and it was possible to obtain excellent effects in coating.

How the slit section is structured will be explained as follows. In the coating apparatus in FIG. 14, aforesaid slit 43 connecting the top of the slide surface 45 mentioned above, namely aforesaid coating solution flow out port 42 and the bottom portion of said coating solution distributing chamber 44 is formed to be inclined upward from the coating solution distributing chamber 44 by inclination angle θ on horizontal plane X that is perpendicular to aforesaid vertical center line Z—Z. The. inclination angle θ of aforesaid slit 43 is within a range of 10°–80°. When the inclination angle θ of aforesaid slit 43 is smaller than 10', an effect for pulsation variation is reduced. When the inclination angle θ is larger than 80°, a coating solution at hopper coating surface 41 foams excessively, and layer thickness variation rather becomes larger. Taking characteristics of a coating solution and conditions for supplying the coating solution into consideration, the inclination angle θ is preferably within a range of 20°–70°. The numeral 49 is a feeding path through which coating solution L introduced from aforesaid supply inlet 48 is fed to the coating solution distributing chamber 44.

Figure 15:
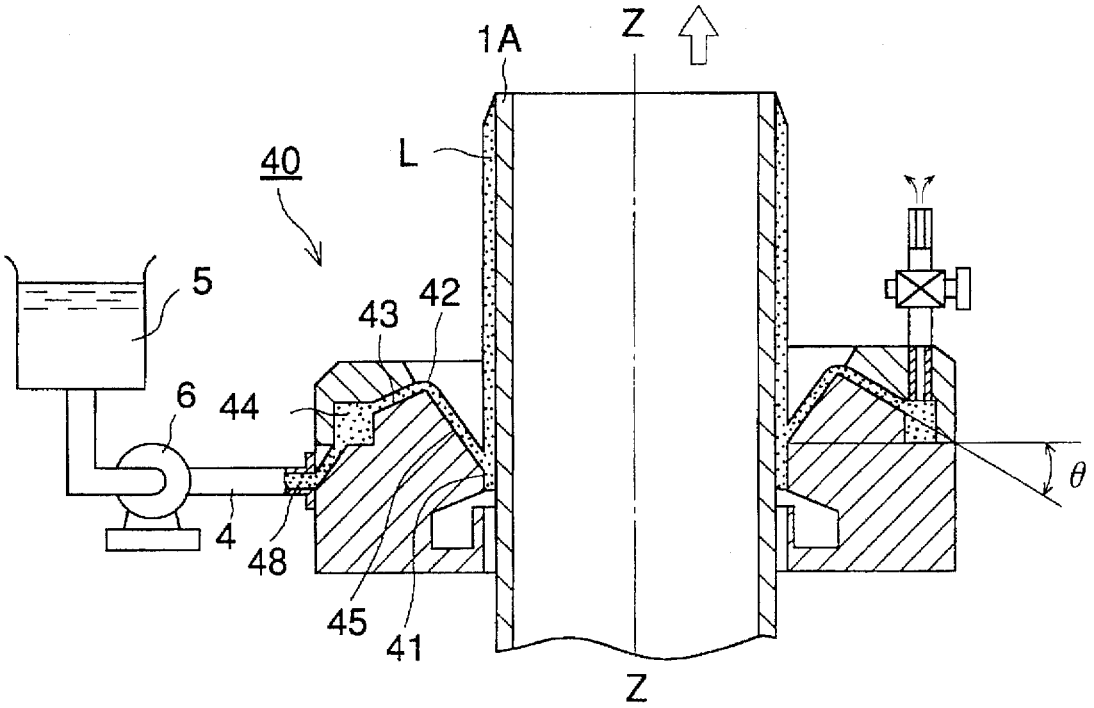
FIG. 15 is a sectional view showing another example of the coating means of the invention.

FIG. 15 is a sectional view showing another example of coating means 40 of the invention. In the drawing, slit 43 connecting coating solution flow out port 42 and the top of the coating solution distributing chamber 44 is formed to be inclined upward from the coating solution distributing chamber 44 by inclination angle θ on horizontal plane X.

Figure 16:
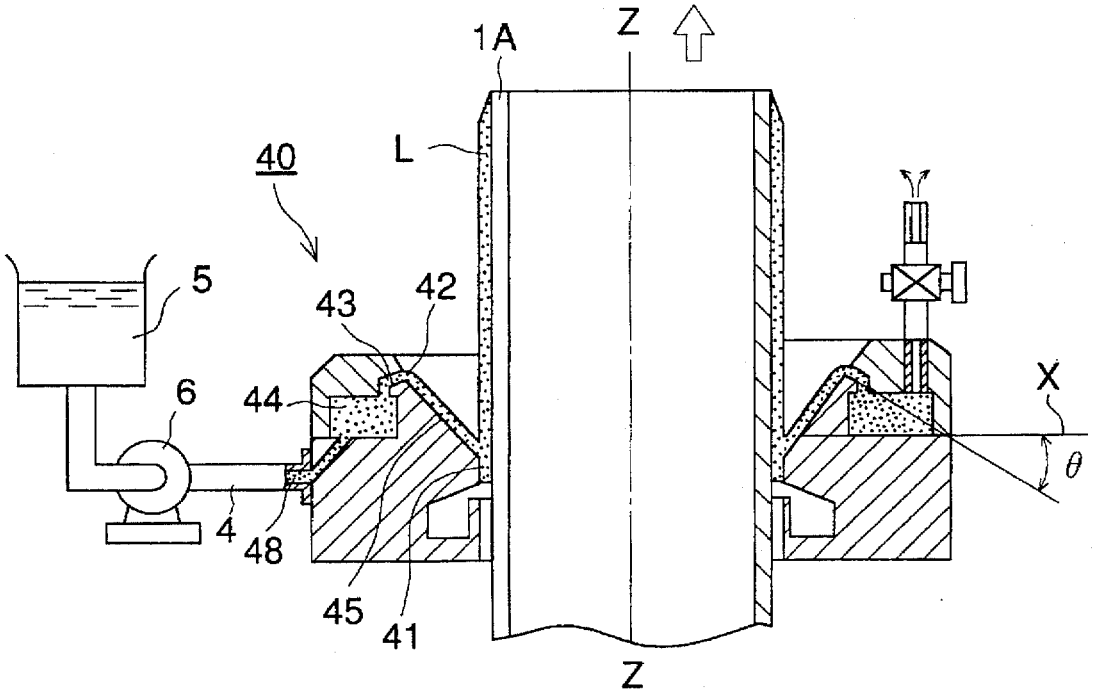
FIG. 16 is a sectional view showing still another example of the coating means of the invention.

FIG. 16 is a sectional view showing still another example of coating means 40 of the invention. Slit 43 is composed of a vertical path portion rising almost vertically from the top portion (the ceiling portion) of coating solution distributing chamber 44 and an inclined path portion that is inclined by angle θ.

Figure 14:
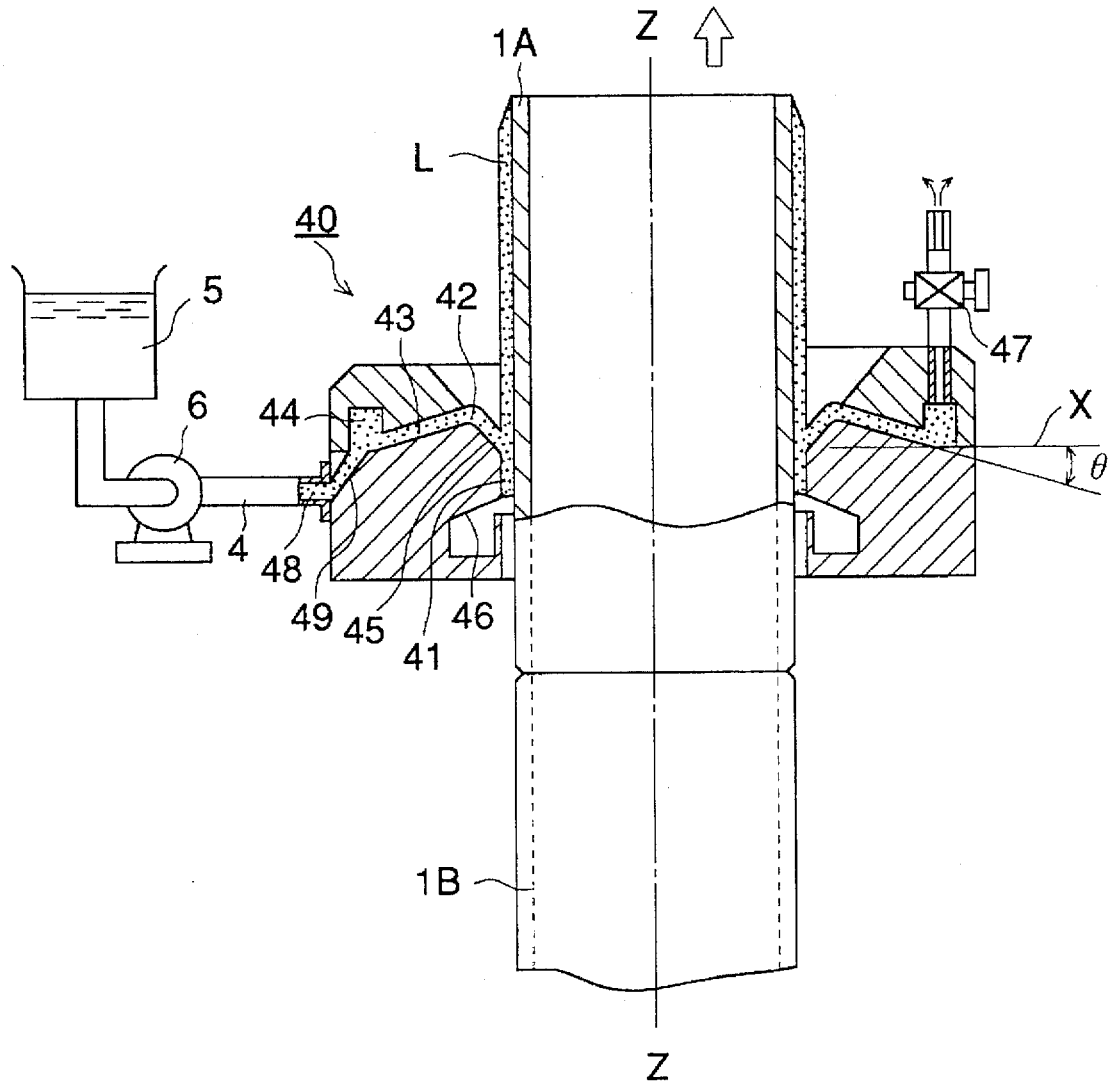
FIG. 14 is a sectional view showing an example related to the shape of a slit of a coating means of the invention.
Figure 17:
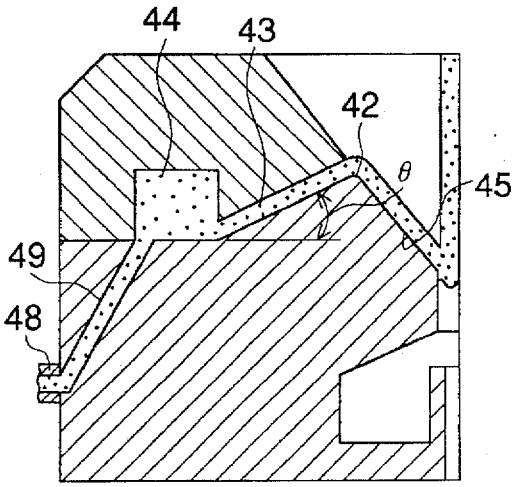
FIGS. 17(A) to 17(F) are enlarged sections showing various slit shapes of coating means 40 of the invention.
Figure 17:
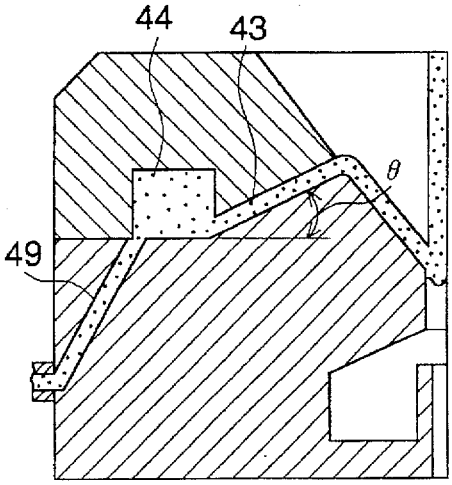
Figure 17:
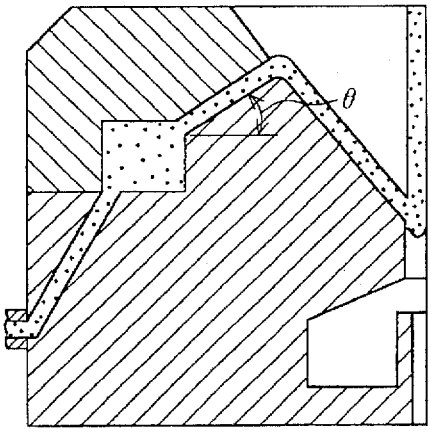
Figure 17:
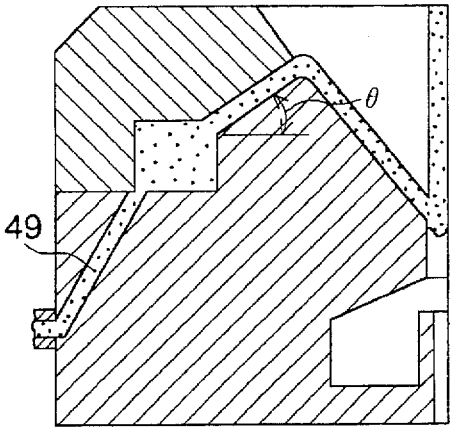
Figure 17:
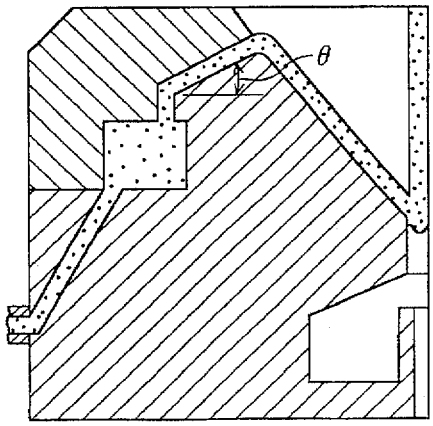
Figure 17:
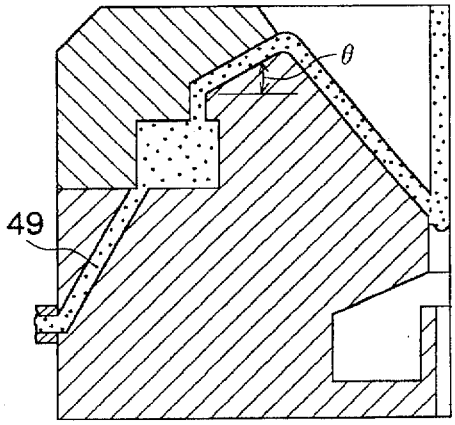

FIG. 17 is an enlarged sectional view showing various examples of coating means 40 of the invention. In FIG. 17(A), coating means 40 shown in aforesaid FIG. 14 is enlarged and inclination angle θ of slit 43 is shown in detail. FIG. 17(B) shows in detail the inclination angle θ of slit 43 in aforesaid FIG. 15. FIG. 17(C) shows in detail the inclination angle θ of slit 43 in aforesaid FIG. 16. In all of the FIGS. 17(A), (B) and (C), feeding path 49 is provided both at the bottom portion of coating solution distributing chamber 44 and at the end portion which is farthest from an inlet portion of slit 43. Only difference between FIGS. 17(D), (E) and (F) and FIGS. 17(A), (B) and (C) is a position of the feeding path 49.

Figure 18:
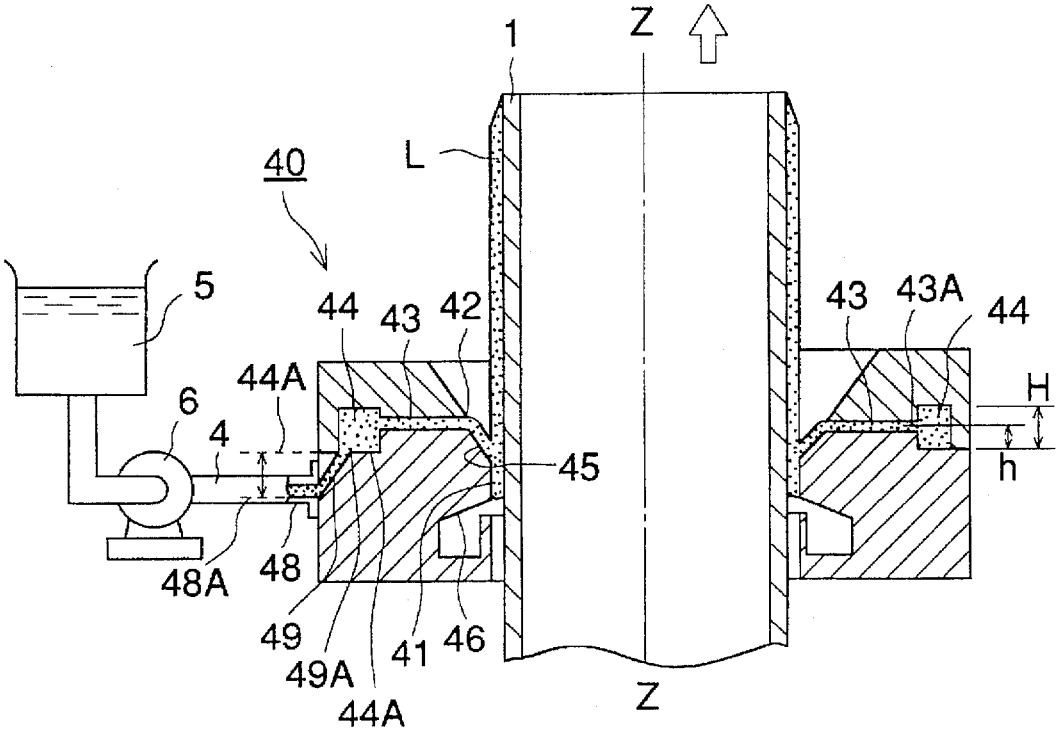
FIG. 18 is a sectional view showing an example related to structure of a solution supply inlet and a solution reservoir chamber of a coating means of the invention.

FIG. 18 is a sectional view showing an example of coating means 40 of the invention. In the drawing, an inlet portion of the feeding path 49 leading to coating solution distributing chamber 44 is positioned at the lowermost portion of the coating solution distributing chamber (solution reservoir chamber) 44. Namely, the lowermost portion 49A with a pipe inside diameter of the inlet portion of the feeding path 49 is arranged to be on the same horizontal plane on which the lowest portion 44A of the coating solution distributing chamber 44 is located, or to be lower than the horizontal plane.

Owing to the arrangement mentioned above, pulsation variation of a coating solution taking place in the course of feeding thereof is eliminated, thus, layer thickness unevenness is reduced, resulting in no occurrence of uneven density of images in multi-sheets copying.

FIG. 20 is a partial sectional view wherein enlarged coating solution distributing chamber 44 and its surroundings are shown.

In the drawing, it is arranged so that the relation of height h of center portion 43A of an inner opening of the slit 43 from the lowermost portion 44A of the coating solution distributing chamber 44 and height H of the coating solution distributing chamber 44 is satisfied by the following inequality.

$$\frac{1}{3}H \leqq h \leqq \frac{2}{3}H$$

Namely, the center portion 43A of an inner opening of the slit 43 is provided within a range o vicinity of the center excluding the upper ⅓ H and lower ⅓ H f ⅓ of height H of the coating solution distributing chamber 44, the range being located in the (see FIG. 20(A)).

When the center portion 43A is provided at the position lower than ⅓ H, there may occur the pulsation variation of a coating solution. When the center portion 43A is provided at the position higher than ⅔ H, small bubbles mixed in a coating solution enter the slit 43, and they tend to flow on the coating surface of cylindrical base material 1, causing coating defect, and when such cylindrical base material 1 coated is used, image defects tend to be caused.

Taking characteristics of a coating solution and conditions for supplying the coating solution into consideration, it is preferable that aforesaid heights H and h are set to satisfy the following relation (see FIG. 20(B)).

$$\frac{2}{5}H \leqq h \leqq \frac{3}{5}H$$

Figure 19:
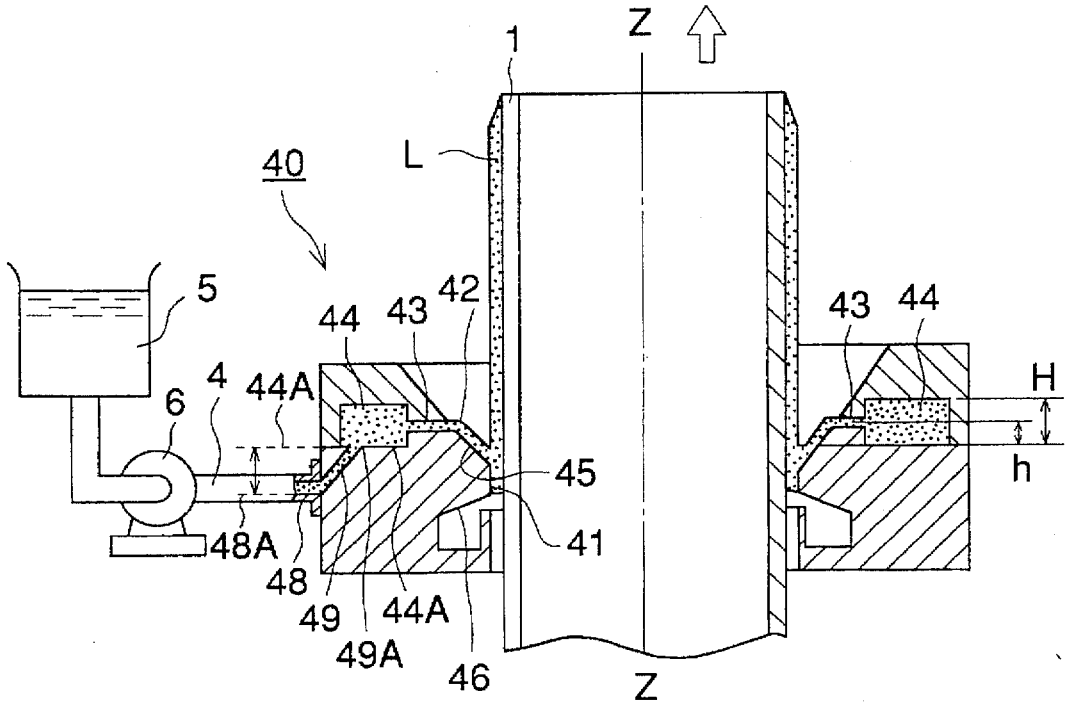
FIG. 19 is a sectional view showing another example of the coating means of the invention.
Figure 21:
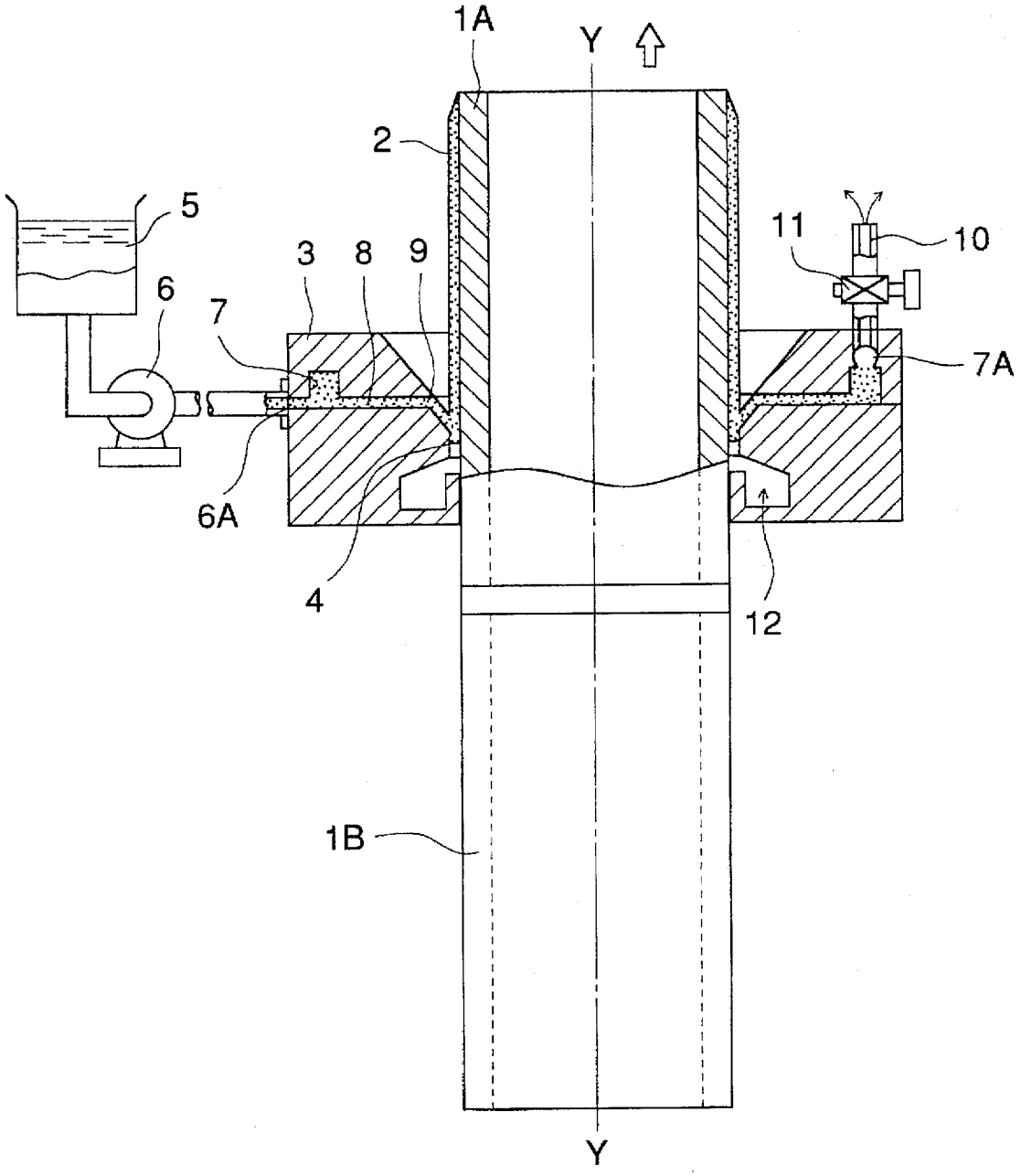
FIG. 21 is a longitudinal section showing the state of coating made by a coating apparatus equipped with an air escape.

FIG. 19 is a sectional view showing another example of coating means 40 of the invention. In this coating apparatus 40, volume of the coating solution distributing chamber 44 is expanded, and an outlet of feeding path 49 is provided at the position slightly close to the slit 43 on the bottom portion of the coating solution distributing chamber 44. Even in the case of such coating apparatus, the same effect as the foregoing can be obtained when the lowermost portion 49A with a pipe inside diameter of the inlet portion of the feeding path 49 is arranged to be on the same horizontal plane on which the lowest portion 44A of the coating solution distributing chamber 44 is located, or to be lower than the horizontal plane. Further, even in this coating solution distributing chamber 44. the same effect as the foregoing can be obtained when the aforesaid heights H and h are set to satisfy the relation mentioned above. In each of coating apparatuses mentioned above, it is preferable that air discharging member 10 that discharges air from a part of aforesaid ring-shaped coating solution distributing chamber 7 is provided, at the position farthest from coating solution supply section 6A of the solution supply pump 6, to be communicated to the outside of the coating solution distributing chamber 7, then, opening/closing valve 11 is provided on a part of the air discharging member 10 for foam-discharging as shown in FIG. 21, and air in the coating solution distributing chamber 7 is discharged by the air discharging member 10 when coating solution 2 is supplied to the coating solution distributing chamber 7 and the supply from coating solution distributing slit 8 to endless coating solution flow out port 9 is started.

Figure 22:
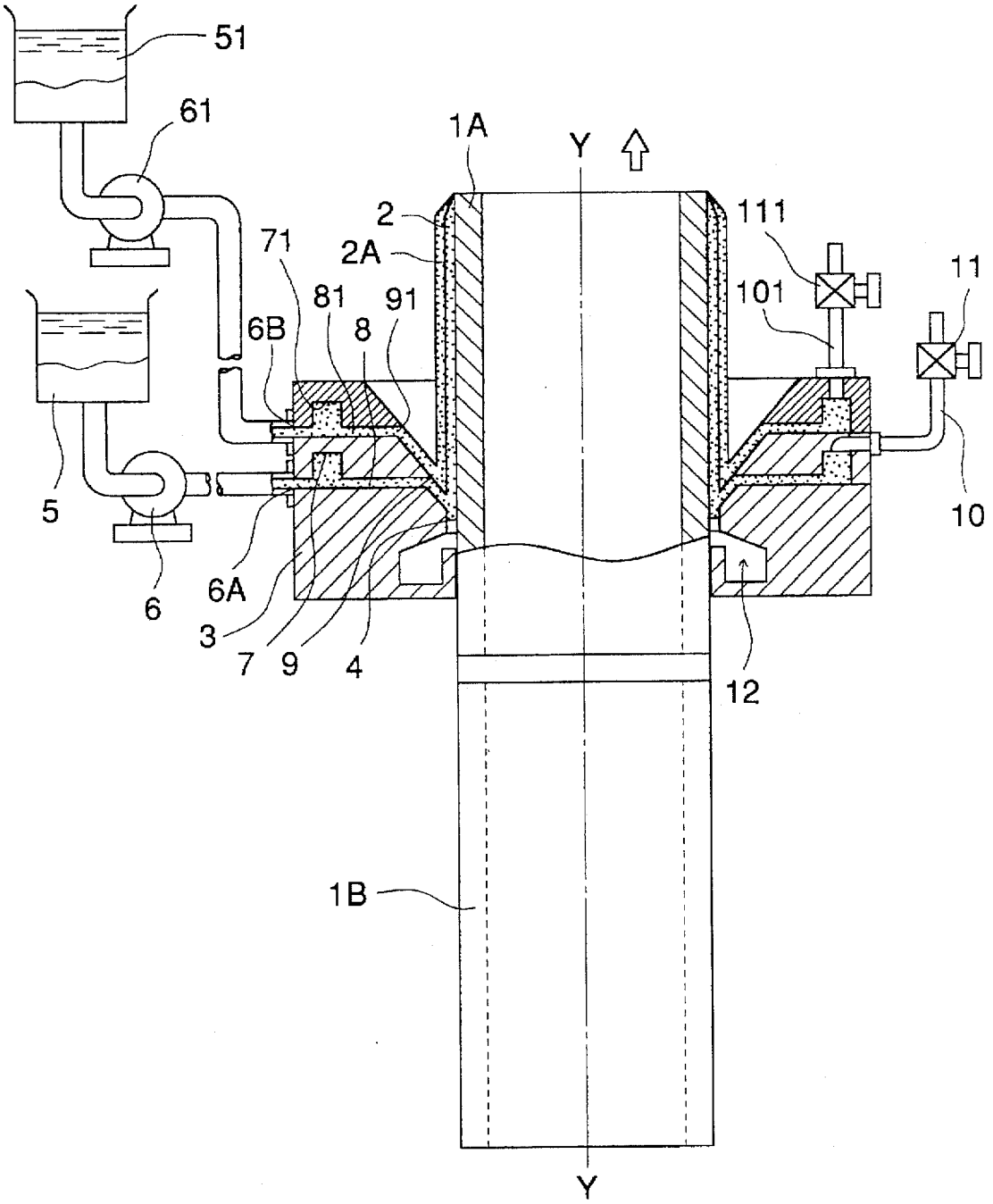
FIG. 22 is a longitudinal section showing the state of coating made by a coating apparatus equipped with an air escape.

It is further preferable that air reservoir chamber 7A is provided between the coating solution distributing chamber 7 and the air discharging member 10 so that bubbles may be reservoired in the air reservoir chamber 7A and flowing out of bubbles from the coating solution distributing chamber 7 and the coating solution distributing slit 8 can be prevented, if the amount of bubbles is small. Incidentally, in the case of a multi-layer coating apparatus in FIG. 22, air discharging member 10 is provided on each coating apparatus for each layer.

When using a coating solution having viscosity of 1–10 millipascal·sec. in aforesaid coating apparatus, it is preferable that a gap (hereinafter referred to also as a coater gap) between the surface of the base material and the tip portion of the hopper coating surface is made to be 30–200 μm and a gap of the coating solution distributing slit is made to be 50–200 μm. When the coater gap is less than 30 μm, it tends to be unstable to control to an appropriate layer thickness, resulting in great variation of layer thickness, because stable beading is not assured. Further, a coater tends to hit a base material because there is no room in a gap. When the coater gap is greater than 200 μm, beading failure tends to occur and layer thickness variation is great. When a gap of the coating solution distributing slit is smaller than 50 μm, layer thickness variation is great, resulting in lack of reliability. When the gap is greater than 200 μm, layer thickness variation is great because a solution layer on the solution slide surface tends to be disturbed.

The coating speed in using the coating solution with low viscosity can not be determined unconditionally because it depends on a moving speed of a base material and a layer thickness of a coating solution. However, it is preferable that the coating speed is determined to be within a range of 20–50 mm/sec., because that coating speed makes it possible to coat more stably.

When using a coating solution having high viscosity of 10–600 millipascal·sec., it is preferable that a gap between the surface of the base material and the tip portion of the hopper coating surface is made to be 50–500 μm and a gap of the coating solution distributing slit is made to be 50–500 μm. When the coater gap is less than 50 μm, it tends to be unstable to control to an appropriate layer thickness, resulting in great variation of layer thickness, because stable beading is not assured. When the coater gap is fluctuations of layer thickness are great. When the gap of the coating solution distributing slit is less than 50 μm, layer thickness fluctuations are great, resulting in a lack of reliability. When the gap is greater than 500 μm, layer thickness fluctuations are great because a solution layer on the solution slide surface tends to be disturbed.

The coating speed in using the coating solution with high viscosity can not be determined unconditionally because it depends on a moving speed of a base material and a layer thickness of a coating solution. However, it is preferable that the coating speed is determined to be within a range of 5–30 mm/sec., because that coating speed makes it possible to coat more stably.

Aforesaid viscosity of a coating solution is one at a temperature of 22° C. With regard to a viscometer, there are used arbitrary viscometers used commonly in laboratories and processes of work, and those called the so-called B-type viscometer are preferable because they are handy.

A coating method of the invention can be applied to a simultaneous multi-layer coating and a successive multi-layer coating equally. In the successive multi-layer coating method, it is possible to coat successively either under the condition that a lower layer is not dried, namely the lower layer is not passed through a drying zone, or under the condition that the lower layer is passed through a drying zone and is dried.

Figure 23:
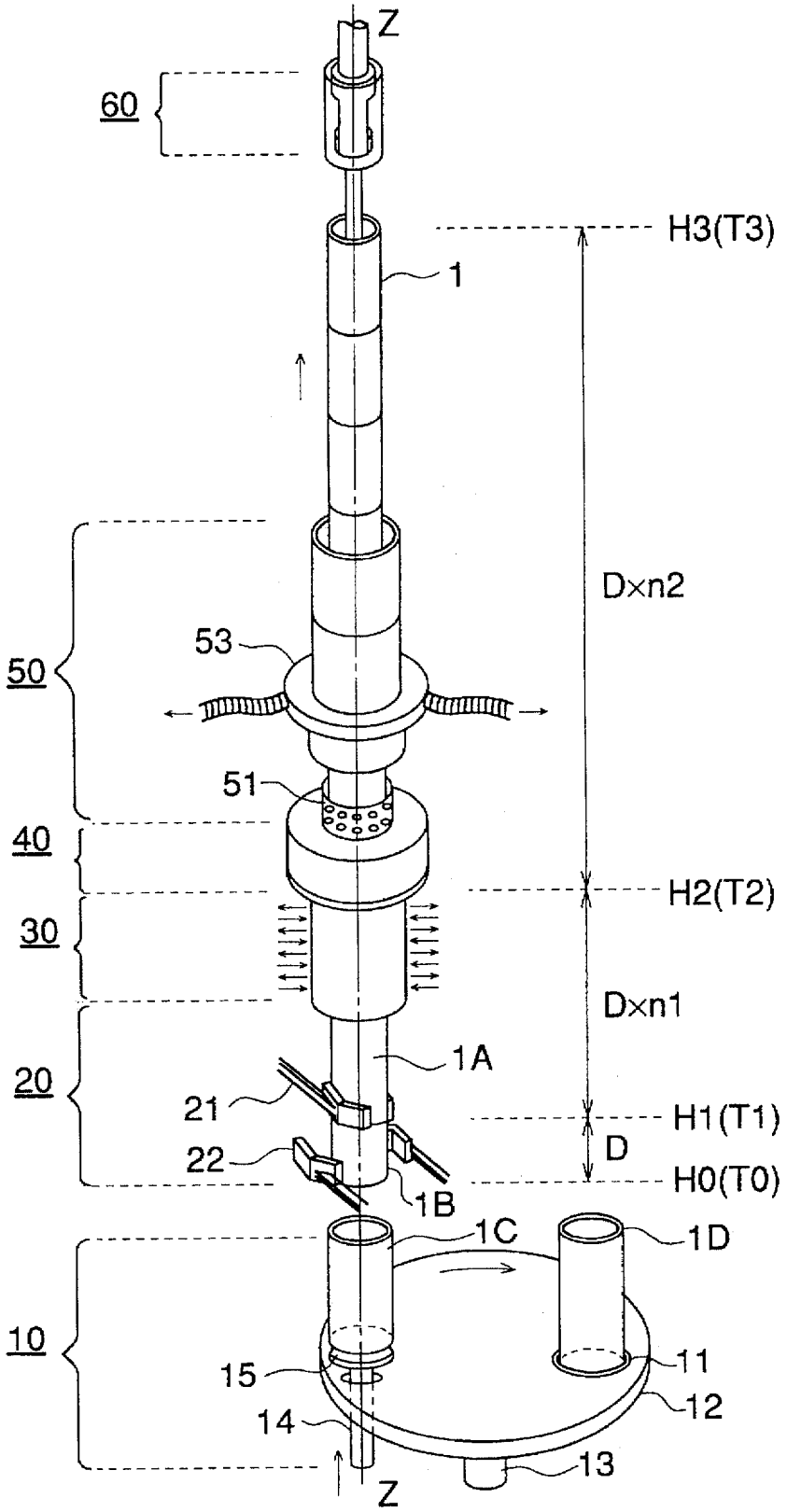
FIG. 23 is a perspective view showing the total structure of a continuous coating apparatus of the invention.

FIG. 23 is a perspective view showing a total construction of a continuous coating apparatus of the invention to which aforesaid coating apparatus can be applied. In the drawing, the numerical 10 is a feeding means which feeds cylindrical base material 1 to a predetermined position just under a coating means and then pushes it up, 20 is a transport means that holds an outer circumferential surface of the cylindrical base material 1 fed for stacking cylindrical base materials after aligning the cylindrical axes thereof and pushes them upward vertically from the bottom, 30 is a positioning means which positions the aforementioned cylindrical base material 1 to the center of a ring-shaped coating section of the coating apparatus, 40 is a coating means that coats a coating solution continuously on the outer circumferential surface of the cylindrical base material 1, 50 is a drying means that dries the coating solution coated on the cylindrical base material 1, and 60 is a separation/ejection means that separates plural stacked cylindrical base materials which are dried and transported vertically and takes them one by one to eject.

This continuous coating apparatus is of a constitution wherein the above-mentioned means are arranged continuously on vertical center line Z—Z, and it can accomplish highly accurate full-automatic production requiring no manual labor. Namely, the above-mentioned feeding means 10 is composed of turn table 12 equipped with a plurality of mounting means 11 on each of which the cylindrical base material 1 is placed, driving means 13 that rotates the turn table 12 to feed into a vertical line leading to the transport means 20, elevating means 14 that pushes up the cylindrical base material 1 which has already been held and transported upward by the transport means 20 so that is can be stacked, hand means 15 which is provided on the upper end of the elevating means 14 for feeding the cylindrical base material, and an unillustrated control means that controls the timing for the driving means 13 to rotate and for the elevating means 14 to push up. Incidentally, feeding of the cylindrical base material 1 onto the turn table 12 is conducted by a robot handle.

The transport means 20 provided above the feeding means 10 is equipped. with two paired holding means 21 and 22 which can be brought in pressure contact with and released from an outer circumferential surface of the cylindrical base material 1 and can move vertically, thus it has functions for positioning and holding the cylindrical base material 1 and transporting it upward. Details of the above-mentioned means 20, 30, 40, 50 and 60 will be stated later.

Figure 24:
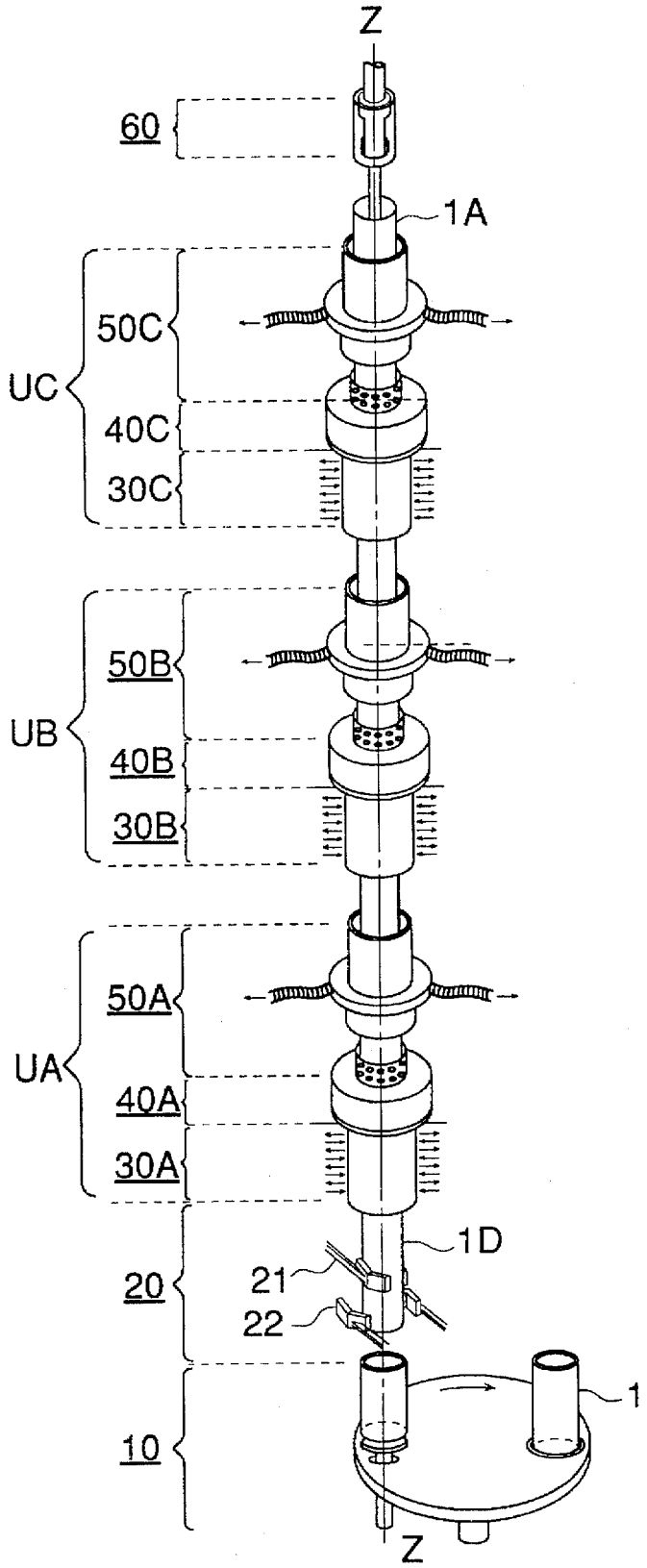
FIG. 24 is a perspective view showing another example of the continuous coating apparatus of the invention.

FIG. 24 is a perspective view showing a stepwise and continual coating apparatus that is another example of the invention. On the vertical center line Z—Z above the aforesaid transport means 20 in this example, there are vertically arranged plural sets of unit UA composed of positioning means 30A, coating means 40A and drying means 50A, unit LIB composed of positioning means 30B, coating means 40B and drying means 50B, and unit UC composed of positioning means 30C, coating means 40C and drying means 50C. On the uppermost step, there is provided the aforesaid separation/ejection means 60. Coating solutions jetted respectively from coating means 40A, 40B and 40C form multiple coated layers on the cylindrical base material 1 stepwise which are dried respectively by drying means 50A, 50B and 50C, then, cylindrical base material 1A located in the upper most position is held by the separation/ejection means 60 and is separated from the lower cylindrical base material 1B to be placed on a pallet outside the apparatus.

Figure 25:
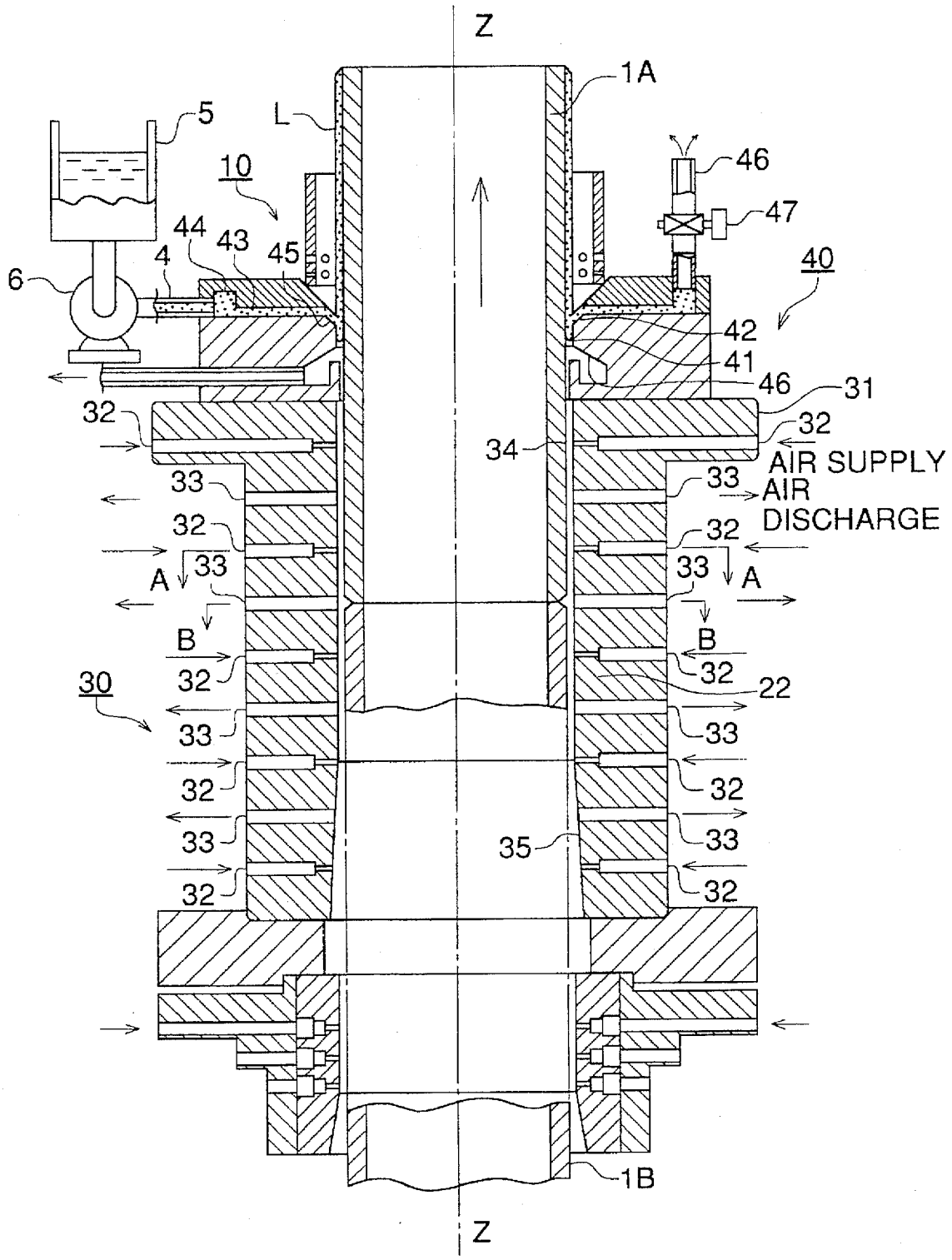
FIG. 25 is a sectional view showing a positioning means and a coating means.
Figure 26:
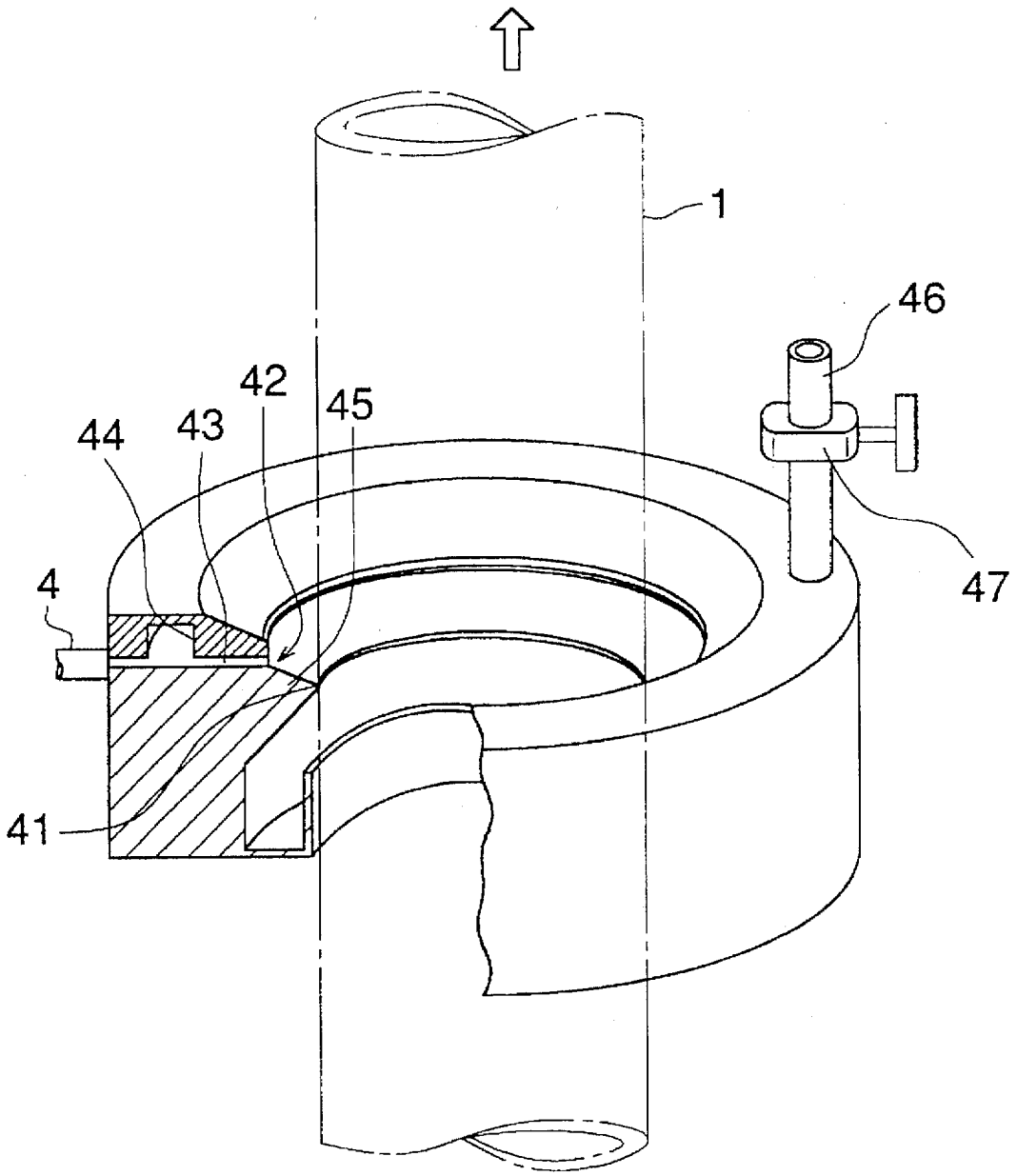
FIG. 26 is a perspective view of the coating means mentioned above.

FIG. 25 is a sectional view showing positioning means 30 and coating means 40, while FIG. 26 is a perspective view of the coating means 40.

A plurality of cylindrical base materials 1A and 1B (hereinafter referred to as cylindrical base materials 1) stacked vertically along vertical center line Z—Z as shown in FIG. 25 are moved upward continuously in the arrowed direction, and a coating solution (light-sensitive solution) L is coated on the outer circumferential surface of the cylindrical base materials 1 by portion (hopper coating surface) 41 related directly to coating in coating apparatus of a slide hopper type 40 surrounding the cylindrical base material. Incidentally, as cylindrical base material 1, a hollow drum such as, for example, an aluminum drum or a plastic drum, or a base material of a seamless belt type may also be used. On the hopper coating surface 41 mentioned above, there is formed horizontally narrow coating solution distributing slit (hereinafter referred to simply as a slit) 43 having coating solution flow out port 42 that is opened to the side of the cylindrical base material 1. This slit 43 is communicated with ring-shaped coating solution distributing chamber (coating solution reservoir chamber) 44, and coating solution L in reservoir tank 2 is supplied by force feeding pump 3 to the ring-shaped coating solution distributing chamber 44 through supply pipe 4 after being introduced from supply port 48. On the other hand, under the coating solution flow out port 42 of the slit 43, there is formed coating solution sliding surface (hereinafter referred to as a sliding surface) 45 that is inclined downward continuously and is formed so that a diameter of its end portion is slightly greater than the outside diameter of the cylindrical base material 1. There is further formed lip-shaped section 46 that extends downward beyond the end portion of the sliding surface 45. In the course of coating by means of such coating means (coating apparatus of a slide hopper type) 40, when coating solution L is pushed out from the slit 43 and is caused to flow down along the sliding surface 45 in the course of drawing up the cylindrical base material 1, the coating solution arriving at the end portion of the sliding surface 45 forms a bead between the end portion of the sliding surface 45 and the external circumferential surface of the cylindrical base material 1, and then is coated on the surface of the cylindrical base material 1. Since the end portion of the sliding surface 45 and the cylindrical base material 1 are arranged to have a clearance between them, the cylindrical base material 1 is not damaged in the course of coating, and even when many layers each differing in nature from others are formed, layers already coated are not damaged.

On the other hand, on a part of the coating solution distributing chamber 44 located at the farthermost position from a coating solution supply section of the aforementioned force feeding pump 3, there is provided air escape means 47 for extracting bubbles in the coating solution distributing chamber 44. When coating solution L in the reservoir tank 2 is supplied to the coating solution distributing chamber 44 and is further supplied to the coating solution flow out port 42 from the coating solution distributing slit 43, an opening/closing valve is opened so that air in the coating solution distributing chamber 44 may be extracted by the air escape means 47.

Under the coating means 40 mentioned above, there is affixed positioning means 30 which positions a cylindrical base material in its circumferential direction. On positioning means main body 31 of the positioning means 30 for the cylindrical base material 1, there are formed a plurality of air inlets 32 and a plurality of air outlets 33. These plural air inlets 32 are connected to an unillustrated air supply pump to force-feed a fluid such as air. An end of each air inlet 32 positioned on the side facing the external circumferential surface ice of the cylindrical base material 1 is connected to orifice 34. The orif34 faces the external circumferential surface of the cylindrical base material 1 while keeping a predetermined clearance between them. The clearance is 20 μm–3 mm, and preferably is 30 μm–2 mm. When this clearance is smaller than 20 μm, even a small deviation of cylindrical base material 1 makes itself to come into contact with an inner wall of main body 31, so that the cylindirical base material tends to be damaged. When the clearance is greater than 3 mm, accuracy of positioning cylindrical base material 1 is lowered. The orfice 34 mentioned above is a nozzle with a small diameter of 0.01–1.0 mm, and its diameter is preferably 0.05–0.5 mm.

An internal circumferential surface at the bottom of an inner wall of the positioning means main body 31 is formed to be tapered surface 35 whose inlet side is greater in diameter. This tapered surface 35 is a conical surface whose length in its axial direction is, for example, 50 mm and its inclination angle at one side is 0.5 mm. Due to this tapered surface provided, a tip portion of the cylindrical base material 1 is prevented from touching an inner circumferential surface of the inner wall when the cylindrical base material 1 enters the inner wall of the main body 31.

A fluid that is force-fed from the air supply pump is introduced to the inside of the positioning means main body 31 from a plurality of air inlets 32, and then is jetted from a plurality of orifices 34 to form a uniform fluid layer together with the external circumferential surface of the cylindrical base material 1A (1B). The fluid after being jetted is ejected out of an apparatus through a plurality of air outlets 33.

A diameter of an opening of the aforesaid orifice 34 is 0.01–1 mm and preferably is 0.05–0.5 mm, and for example, it is formed to be a circle of 0.2–0.5 mm. An opening of the air outlet 33 is 1.0–10 mm, preferably is 2.0–8.0 mm, and it is formed to be a circle with a diameter of 3–5 mm, for example.

A preferable fluid to be supplied to the air inlet 32 is air and an inert gas such as nitrogen gas. The fluid is preferably clean gas ranked at class 100 or higher in Federal Standard 209D (Clean Room and Work Station Requirments Controlled Evironments).

Incidentally, as a vertical coating apparatus connected to the positioning means of the invention, various apparatuses such as those of a slide hopper type, an extrusion type and a ring coater type are used.

Above the aforementioned coating means 40, there is provided drying means 50 composed of drier hood 51 and drier 53.

Figure 27:
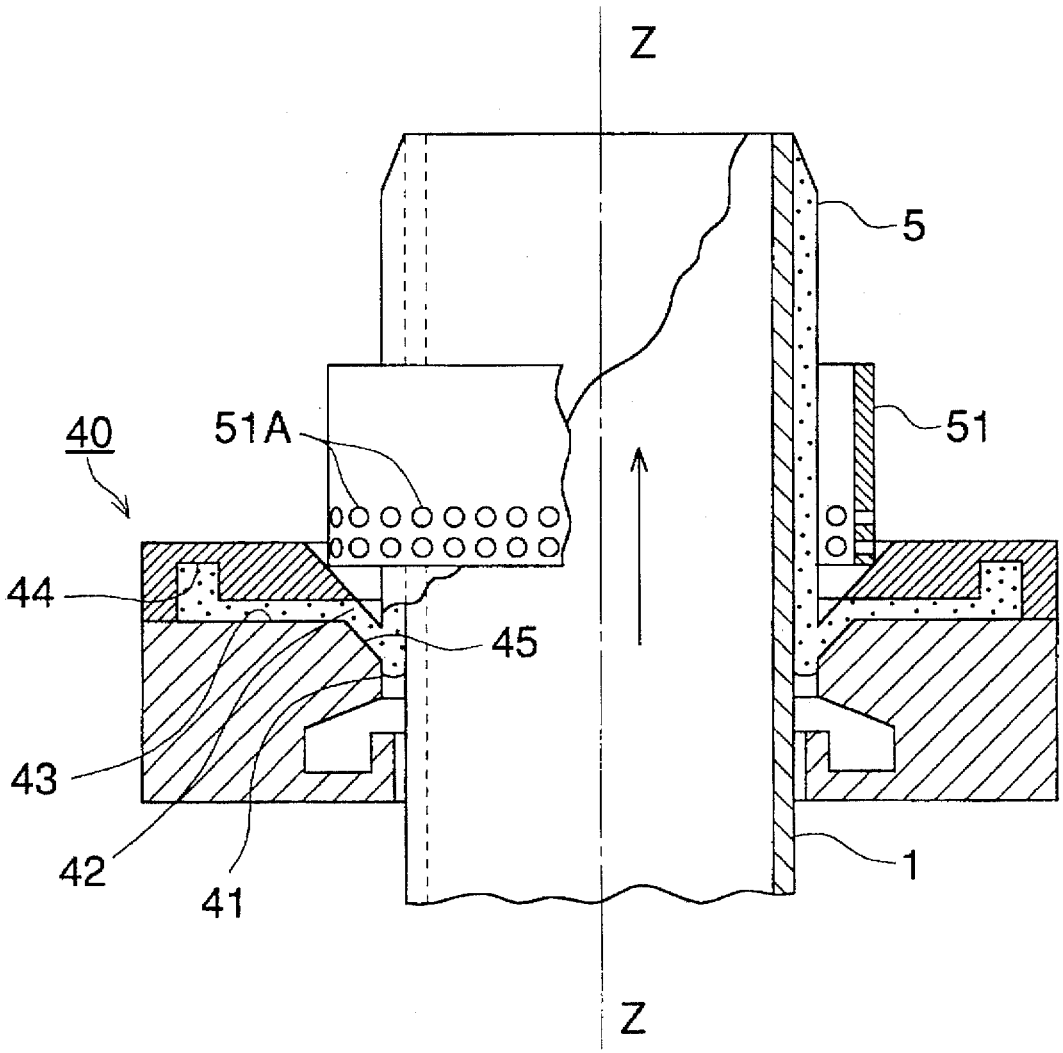
FIG. 27 is a sectional view showing aforesaid coating means and a drying hood.

FIG. 27 is a sectional view of the drying means 40 and the drier hood 51 provided above the drying means 40. The drier hood 51 has a ring-shaped wall surface on which a large number of openings 51A are formed. While the cylindrical base material 1 is raised in the arrowed direction, coating solution L is coated by hopper coating surface (coating head) 41 of the coating means 40, and thereby light-sensitive layer 5 is formed. The light-sensitive layer 5 formed on the cylindrical base material 1 passes through the inside of the drier hood 51 to be dried gradually. This drying is attained when solvents contained in the coating solution L are discharged out of the wall surface through the aforesaid numerous openings 51A. The light-sensitive layer 5 formed by coating solution L on the cylindrical base material 1 with coating means 40 is surrounded, immediately after coating, by the drier hood 51, and solvents are discharged through only openings 51A. Therefore, the speed of drying the light-sensitive layer 5 immediately after coating is mostly proportional to the total area of the openings 51A.

Figure 28:
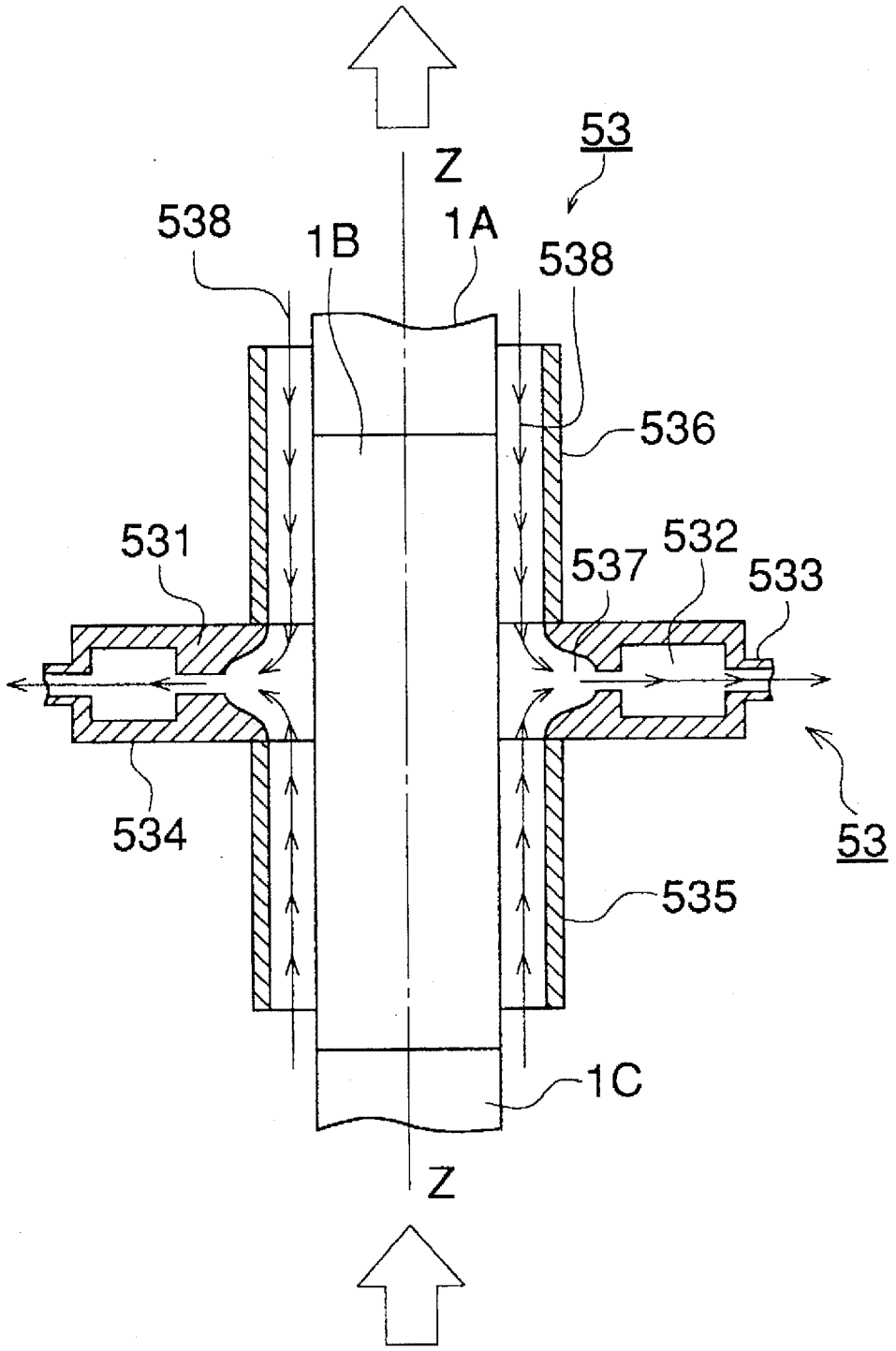
FIG. 28 is a sectional view of a drier.

FIG. 28 shows a sectional view of drier 53 of the invention. In the drier 53, cylindrical member 535 and cylindrical member 536 are connected on a coaxial basis respectively to the upper side and the lower side of suction slit member 534 having thereon suction slit 531, suction chamber 532 and suction nozzle 533.

Suction is conducted through the plural suction nozzles 533, and suction air uniformalized in its circumferential direction by suction chamber 532 that is uniform in its circumferential direction and suction slit 531 that is uniform in its circumferential direction flows, and further, disturbance of an air flow between the inner surfaces of suction slit member 534 and its upper and lower cylindrical members 536 and 535 and the outer surface of the coated cylindrical base material 1 is minimized by buffer space 537, thus, a uniform flow of suction air shown with 538 for drying is created.

When the coated cylindrical base material 1 is transported to this drying zone in the arrowed direction, the coated layer on the coated cylindrical base material is dried.

Next, the steps in the continuous coating apparatus mentioned above will be explained as follows.

The cylindrical base material 1 is moved by an unillustrated supply robot from a cylindrical base material housing chamber to the position of base drum 1A located on turn table 12, and is placed. The drum 1A advances to the position of 1B when the turn table 12 rotates in the arrowed direction. In this case, elevating means (supply arm) 14 pushes up cylindrical base material 1B which is fed to the position of hand means 15. It is preferable that when the supply arm 14 finishes pushing up, a buffer mechanism operates and thereby shock generated by connection with cylindrical base material 1B is eliminated. Through the aforesaid step, the cylindrical base material 1B is brought into the position of a holding and transporting means of 1C.

The numeral 20 shows a transport means. By means of holding means (transport hands) 21 and 22, the joint portion between cylindrical base material 1C and that 1D is held and is transported upward to be brought to positioning means 30.

The numeral 30 shows a positioning means, and ring-shaped positioning devices disclosed in Japanese Application Nos. 125230/1991 and 125231/1991 as well as those disclosed in Japanese Patent O.P.I Publication No. 280063/1991 are preferably used.

The cylindrical base material positioned accurately as in the foregoing is moved to coating means of a vertical type 40 to be coated thereon. The numeral 40 shows a coating means any types such as (1) slide hopper type, (2) a protrusion type, (3) a ring coater type and (4) a spray coater type can be used provided that the coating means is one wherein drums are stacked and moved upward or downward relatively to be coated thereon. However, a coater of the (1) slide hopper type is preferable because highly reliable, continuous and stable coating can be obtained, and its details are disclosed in Japanese Patent O.P.I Publication No. 189061/1983.

In the following method, coating composition (1) UCL-1 is coated on cylindrical base material 1. The coated cylindrical base material 1 is moved to drying means 50. In the drying means 50, both drier hood 51 and suction type drier 53 may be stacked to be used together as shown in FIG. 23, or only the hood or only the suction type drier may be used alone depending on solvents in a coating solution or a layer thickness. These are described in Japanese Patent Application No. 216495/1993 or in Japanese Patent Application No. 99559/1993. Further, for a certain coating solution, natural drying can be employed without providing the aforementioned drying means in particular.

After this, the cylindrical base material is moved to the separation/ejection means 60. Those described in Japanese Patent O.P.I Publication No. 43917/1995 in detail are preferable. In addition, those described in Japanese Patent O.P.I Publication Nos. 120662/1986 and 120664/1986 are also preferable.

Figure 29:
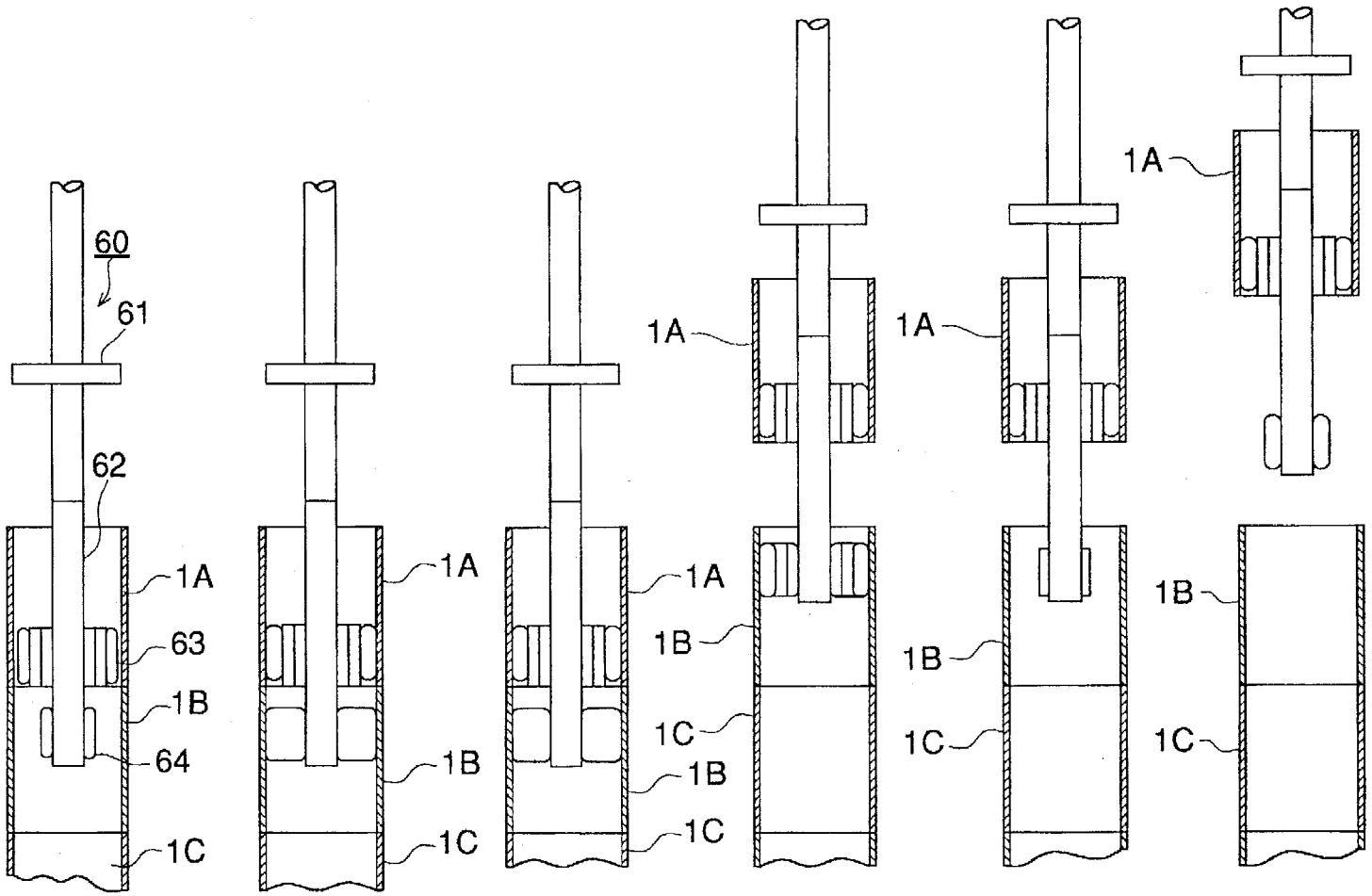
FIGS. 29(A) to 29(F) are diagrams showing the state of separation made by a separating means.

Steps for separating the cylindrical base materials (base drums) 1A, 1B, 1C . . . on which coating and drying of the coated layers have been conducted will be explained as follows, referring to the state drawings of separating processes in FIG. 29.

The separation/ejection means 60 is composed of vertical movement robot stage 61, air cylinder 62, upper chuck (upper holder) 63 and lower chuck (lower holder) 64.

The coated cylindrical base materials 1 are stacked upward from the bottom to the top, and are moved upward to arrive at the position for separation as shown in FIG. 29(A). At this occasion, a vertical robot starts operating to move the total separating means which is coaxial with cylindrical base materials 1 to be separated and moved at the speed identical to that of the cylindrical base material. First, at the position shown in FIG. 29(B), the lower holder 64 holds cylindrical base material 1B that is adjacent to cylindrical base material 1A to be separated. Next, at the position shown in FIG. 29(C), the upper holder 63 holds cylindrical base material 1A to be separated. Owing to air cylinder 62, the upper holder 63 moves upward while holding the cylindrical base material 1A to be separated to be located at the position shown in FIG. 29(D). At this moment, a coated layer covering the cylindrical base material 1B that is adjacent to cylindrical base material 1A to be separated is torn off, thus, the cylindrical base material 1A and the cylindrical base material 1B are separated from each other as shown in FIG. 29(D). For ejecting the separated cylindrical base material 1A, the lower holder 64 is released as shown in FIG. 29(E), and then, the vertical movement robot stage 61 rises promptly with the cylindrical base material 1A to be separated held by the upper holder 63 as shown in FIG. 29(F) so that the separated cylindrical base material 1A may be placed at a separating means located far above the position of adjacent cylindrical base material 1B, then, the upper holder 63 is released and the step ends. Then, for separating the following cylindrical base material 1B, the vertical movement robot stage 61 goes down and the air cylinder 62 goes down to return to the position of the initial condition in FIG. 29(A).

As an another method, it is also effective that the cylindrical base material 1A to be separated is lifted while it is rotated when the cylindrical base material 1A to be separated is separated from adjacent cylindrical base material 1B. In this method, a force applied to a layer to be separated is not a tensile force but a shearing force, and thereby, there can be lessened a phenomenon that a coated layer profile in the vicinity of separation in a wet layer is thinned. The phenomenon is also lessened by scattered small pieces of a coated layer produced in cutting of the coated layer drawn into an inner surface of the cylindrical base material 1.

In FIG. 23, let it be assumed that HO represents the position where the top end of cylindrical base material 1C pushed up by elevating means 14 of supply means 10 is jointed with the bottom end of cylindrical base material 1B held by holding means 21 and 22 of transport means 20. When the cylindrical base material 1C and the cylindrical base material 1B are jointed with each other at this position of HO, holding means 22 grasps at this position of HO, and the holding means 21 holding both cylindrical base materials 1B and 1A at position H1 is released. The expression of H1−H0=D (length of cylindrical base material) is naturally satisfied.

The cylindrical base material 1A is moved up by the holding means 22 in FIG. 23 in the manner mentioned above. For enhancing the accuracy, it is preferable to provide positioning means 30. As this positioning means 30, a ring-shaped positioning device is used preferably in addition to a positioning means described in Japanese Patent O.P.I. Publication No. 280063/1991.

The cylindrical base material 1 positioned accurately in the aforesaid manner is moved to a coating apparatus of a vertical type 40 and then is coated thereon. When assuming that the H2 represents the position where the cylindrical base material 1 is coated, the relation of H2−H1=n1×D (n1 is an integer satisfying n1 ?? 1) is satisfied. In the present example, n1=3 was used in the slide hopper type coating apparatus 40 described below.

When assuming that the H3 represents the position where separation is started by separating and ejecting means 60, the relation of H3−H2=n2×D (n2 is an integer satisfying n2≧3) is satisfied. In the present example, n2=10 was used. The separated cylindrical base material 1 is moved by an ejecting robot to a containing chamber, a drying chamber or to the next step.

By positioning various means (10–60) of the invention respectively at H0, H1, H2 and H3 (each of them being a multiple of cylindrical base material length D and an integer) as in the foregoing, there was no coating defect such as uneven coating, uneven layer thickness, scratches, dust and drum damages caused by vibration and shock generated mainly in the course of jointing, holding, coating and separating, and coated drums properly coated were obtained. Moreover, it has becom possible to produce quality products which are free from entrance of dust and motes, because of ability of stable and continuous coating for many materials for a long time and full automation.

Figure 30:
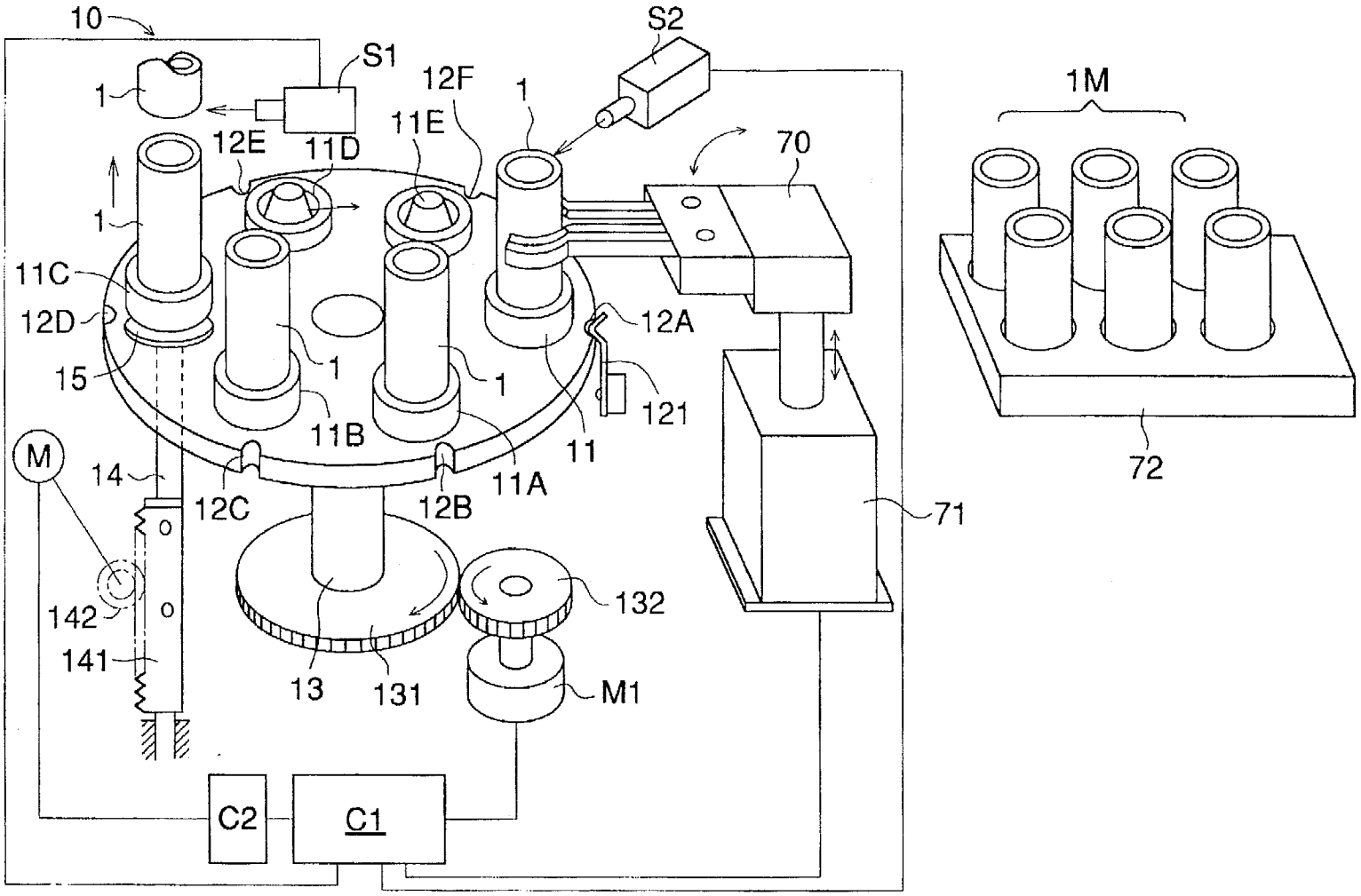
FIG. 30 is a perspective view showing the total structure of a cylindrical base material supply device of the invention.

FIG. 30 is a detail drawing of cylindrical base material supply means 10 of the invention. The symbol 1M represents cylindrical base materials, and a plurality of cylindrical base materials 1M are placed on supply stand 72 of a pallet type on which each cylindrical base material 1M can be placed independently, so that they may be supplied to the cylindrical base material supply means 10. The cylindrical base material 1M is conveyed by conveyance member 70 which is provided on automatic conveyance apparatus 71 and holds and conveys the cylindrical base material 1M, and the conveyance member 70 is provided so that it can move vertically and can rotate. By the automatic conveyance apparatus 71, on the other hand, there is arranged turn table 12 that rotates clockwise. and on the turn table 12, there are provided, in the rotary circumferential direction of the turn table 12, a plurality of spacers 11 which are guide members for placing a cylindrical base material (hereinafter referred to as a spacer) on each of which cylindrical base material 1M is placed. A piece of cylindrical base material 1M is held by the conveyance member 70 and is moved by the rotation thereof to the position of the cylindrical base material 1 as shown in the drawing, and is placed on the spacer 11. Detection means S2 detects how the cylindrical base material 1 is placed, and when the cylindrical base material 1 is placed correctly, control means C1 sends to conveyance member 70 of the automatic conveyance apparatus 71 the retreat signals which make the conveyance member 70 to retreat from the cylindrical base material 1. When the retreat is completed, the control means C1 starts servo-motor M through rotation control means C2. At this moment, cylindrical base material 1 is already placed on each of spacers 11A, 11B and 11C. Being actuated by the start of the servo-motor M mentioned above, pinion 142 starts lifting elevating mender 14 through rack 141. On the top of the elevating member 14, there is provided pushing up member 15 through spring S which is a shock-absorbing means. and the pushing up member 15 pushes up bottom portion 113 of the spacer 11. In order for the spacer 11 to be pushed up accurately, the cylindrical base material pushing up member 15 is formed to be in a cone shape, and the bottom portion 113 of the spacer 11 is formed to be concave so that it may be engaged with the cone of the cylindrical base material pushing up member 15.

Figure 31:
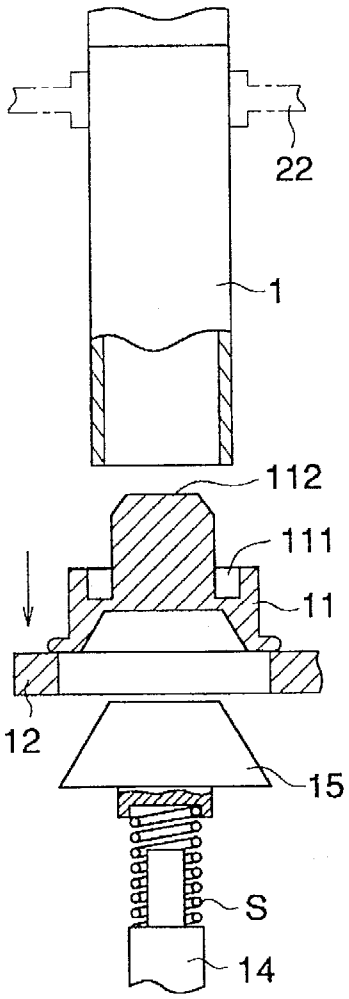
FIGS. 31(A) to 31(C) are illustrations showing how a cylindrical base material is pushed out by a pushing out means of the cylindrical base material supply device of the invention.
Figure 31:
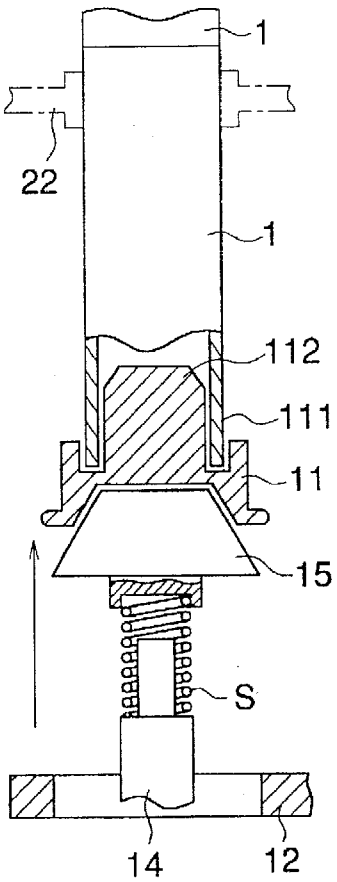
Figure 31:
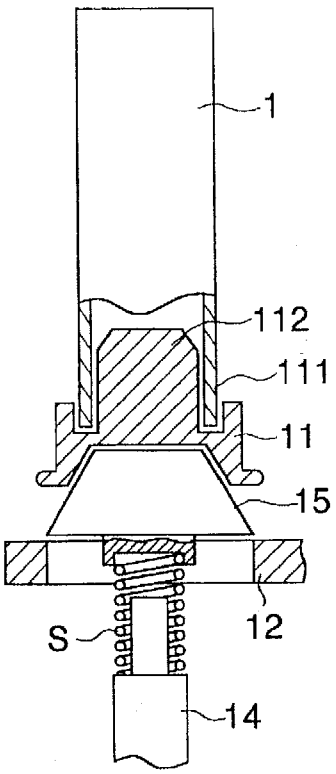

Further, on the upper portion of the spacer 11, there is formed circular groove 111 which can be engaged loosely with cylindrical base material 1. Procedures of operations for pushing up the bottom portion 113 of the spacer 11 by the use of the pushing up member 15 formed in aforesaid manner will be explained as follows, referring to FIG. 31. In FIG. 31(A), the bottom portion 113 starts rising in the Z—Z direction in FIG. 1 together with cylindrical base material 1B which is caused by the rise of the elevating member 14 to be engaged loosely with the circular groove 111 on the spacer 11C. Next, FIG. 31(B) shows how the leading edge of the cylindrical base material 1 is in contact with the cylindrical base material 1 which has been lifted first at constant speed, to be coated with a coating solution while that cylindrical base material is rising. With regard to the rising speed of the elevating member 14, the rotation of the servo-motor M is controlled by the control means C1 and the rotation control means C2 so that the speed in the start of rising is 1.5–5 times the speed for coating, and immediately before the leading edge of cylindrical base material 1 hits the cylindrical base material 1 which has risen in advance, aforesaid speed in the start of rising is lowered to the speed that is 1.0–1.5 times the speed for coating. When the leading edge of the following cylindrical base material 1 hits the preceding cylindrical base material 1 which has risen in advance, even in the case that the elevating member 14 keeps on rising slightly, the movement is absorbed by spring S and thereby no shock is given to a plurality of cylindrical base materials 1 which are rising at the coating speed to be coated as shown in FIG. 1, resulting in no occurrence of uneven coating. Incidentally, under six spacers 11, 11A, 11B, 11C, 11D and 11E arranged in the rotary circumferential direction of the turn table 12, there are formed holes for pushing up. For the spring S, a metal spring, an air spring, a rubber spring and an oil pressure spring can be used, and those preferable in particular are springs among which a metal coil spring is preferable for accurate coating used for the invention and for the natural frequency and durability of the supporting system.

After aforesaid operations are completed, cylindrical base material 1B is held first by conveyance holding member 22 as shown in FIGS. 31(B) and (C). Then, as shown in FIG. 31(B), descending motion by means of servo-motor M is started by the control made by control means C1 and rotation control means C2, and pinion 142 and rack 141 make the elevating member 14 to go down together with the spacer 11C. In that case, the cylindrical base material 1 can easily be disengaged from circular groove 111 of the spacer 11, in the arrangement. The elevating member 14 goes down to the position of the turn table 12 and stops there to stand ready for the following rising action, while the spacer 11C stays on the turn table 12. Then, after detecting member S1 detects that the cylindrical base material 1 is held firmly by aforesaid conveyance holding member 22, control means C2 actuates drive motor M1 so that it rotates the turn table 12 clockwise together with shaft 13 through gears 132 and 131, and stops after moving following cylindrical base material 1 and spacer 11B onto cylindrical base material pushing up member 15. Aforesaid operations are repeated in succession so that cylindrical base materials 1 are supplied to coating means 40. Incidentally, for stopping the turn table 12 accurately, notches 12A, 12B, 12C, 12D, 12E and 12F for stop use are formed at positions where six spacers 11, 11A, 11B, 11C, 11D and 11E are placed on the turn table so that click 121 for stop use can stop the turn table to the supplying position and pushing up position for the cylindrical base materials. Further, aforesaid control motor M1 may also be controlled for stopping. Materials which do not cause scratches and damages on the cylindrical base material 1 and can hold it vertically are preferable for the spacers 11, 11A, 11B, 11C, 11D and 11E used in the invention. Among them, engineering plastic is preferable. Due to this, cylindrical base materials 1 can be held vertically and supplied. Therefore, the cylindrical base materials 1 can surely and easily be held and conveyed, resulting in no occurrence of erroneous operations. Further, it is possible to cope with a change in a diemeter of cylindrical base materials 1 easily and quickly.

Figure 32:
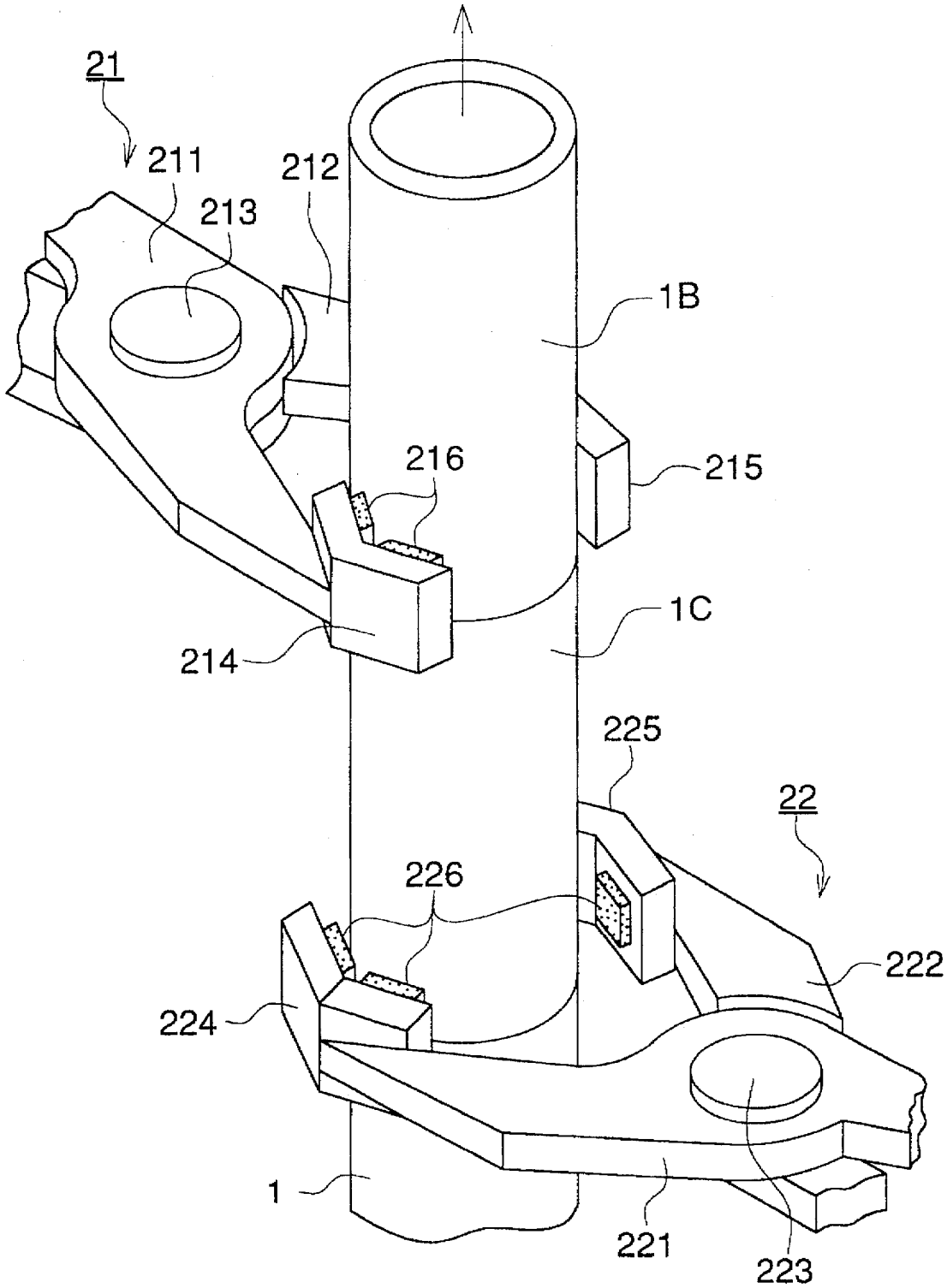
FIG. 32 is a perspective view showing a holding and transporting device for a cylindrical base material of the invention.

Holding and transporting devices 21 and 22 of transporting means 20 will be explained as follows, referring to FIG. 32. First of all, holding section 214 of transporting hand 211 of the holding and transporting device 21 provided at an upper position and holding section 215 of transporting hand 212 are supported to be able to rotate freely around shaft 213. Both of them hold cylindrical base material 1 lifted first to the upper position and cylindrical base material 1 lifted first similarly at the position where both cylindrical base materials are jointed, by adjusting the step of the joint, and they lift both cylindrical base materials at the coating speed in the arrowed direction. Holding section 224 of transporting hand 221 of the holding and transporting device 22 provided at a lower position and holding section 225 of transporting hand 222 are supported to be able to rotate freely around shaft 223. Both of them hold cylindrical base material 1 and cylindrical base material 1 lifted newly at the position where both cylindrical base materials are jointed, by adjusting the step of the joint, Then, after completion of holding, the cylindrical base materials are lifted in the arrowed direction at the coating speed which is the same as that of the holding and transporting device 21. The numerals 216 and 226 represent respectively an antislipping member glued on the tip of the holding section and a pressure absorbing member for protecting the surface of cylindrical base material 1.

Figure 33:
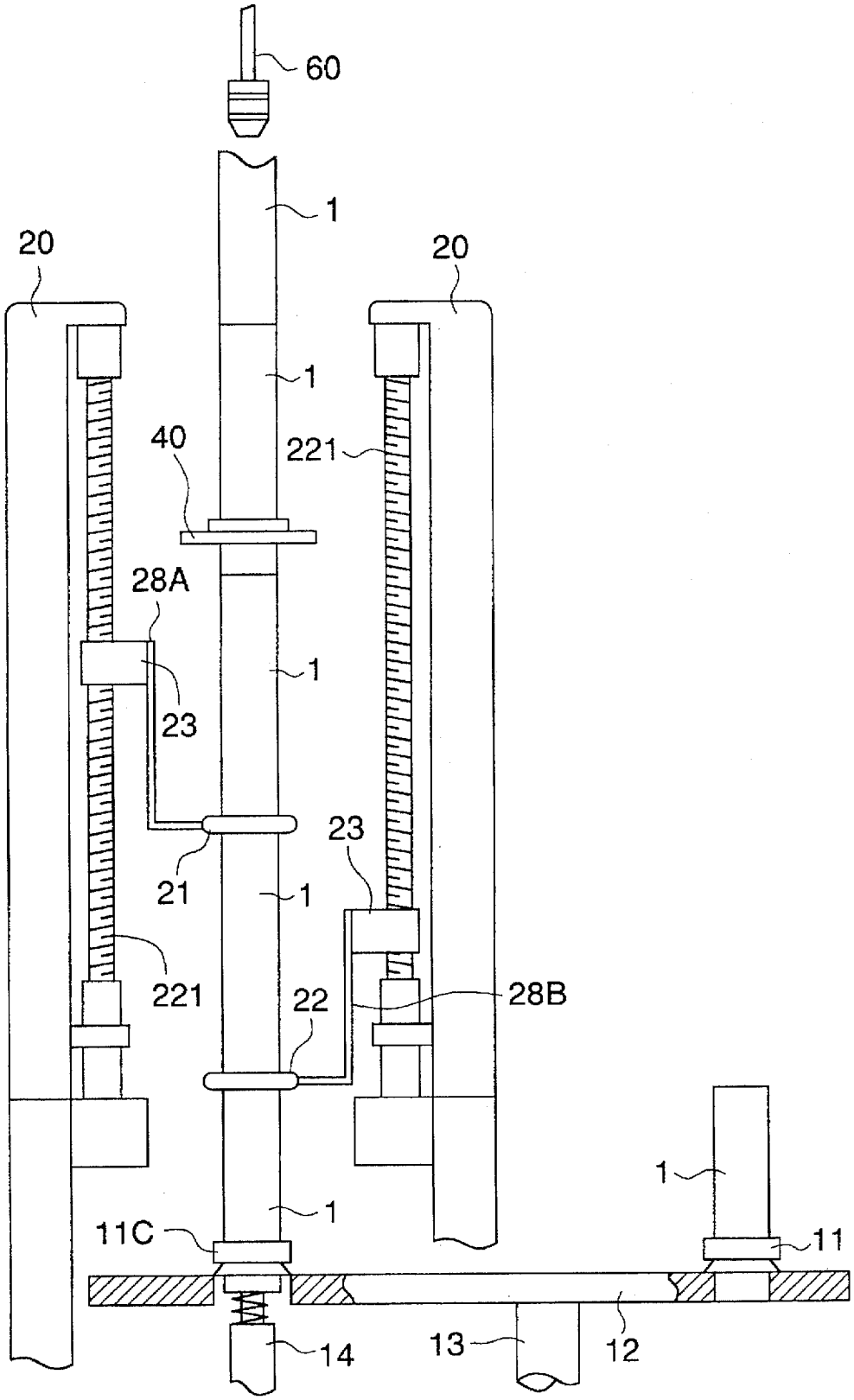
FIG. 33 is a front view showing a transport means of the holding and transporting device of the invention.

Next, transporting means 20 for the holding and transporting devices 21 and 22 will be explained as follows, referring to FIG. 33. The transporting mean 20 is provided for each of the holding and transporting devices 21 and 22, and there is provided vertical movement member 23 that engages with screw rod 221 which is provided in the longitudinal direction of the transporting means 20 to be able to rotate freely. Each of the holding and transporting devices 21 and 22 is connected with the vertical movement member 23. In the constitution, when the screw rod 221 is rotated at the constant speed by the use of a rotation drive unit such as a motor and reduction gears, for example, the vertical movement member 23 makes the holding and transporting devices 21 and 22 to move upward at the constant speed, namely the coating speed with which coating solutions are coated on a plurality of cylindrical base materials 1.

Figure 34:
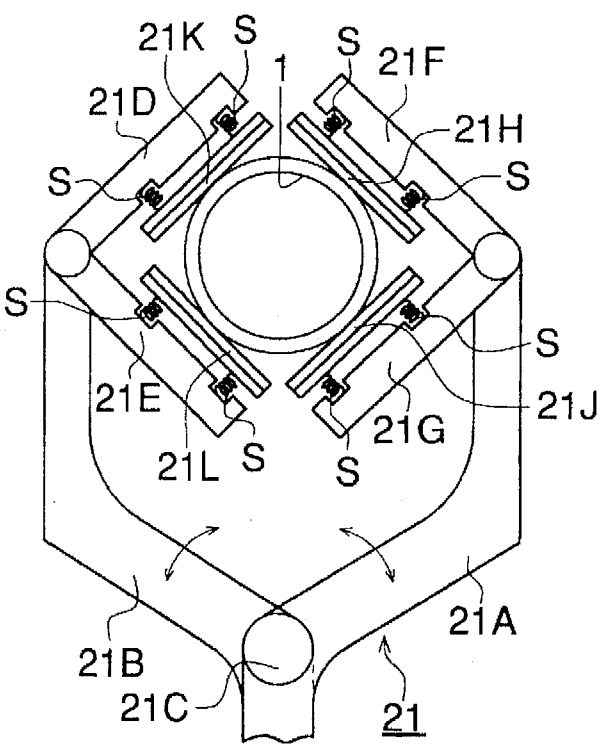
FIGS. 34(A) to 34(C) are perspective views showing a holding and transporting device for a cylindrical base material of the invention.
Figure 34:
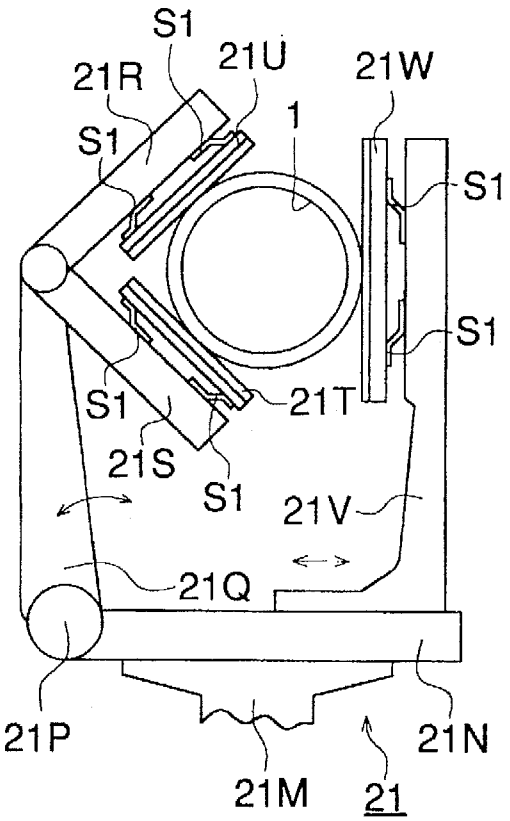
Figure 34:
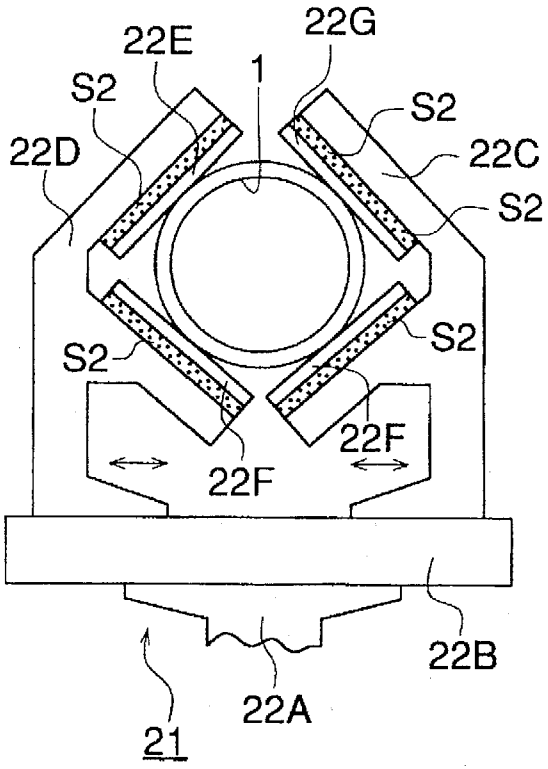

In holding and transporting devices 21 in FIG. 34(A), an antislipping member and pressure member 21H and 21J are provided on V-shaped holding shoes 21F and 21G provided on hand section 21A through coil spring S, and further, pressure buffer members 21K and 21L are provided on V-shaped holding shoes 21D and 21E provided on hand section 21B through coil spring S having buffer function, The hand section 21A and hand section 21B are supported to be able to rotate freely around shaft 21C. Thus, the pressure buffer members 21H, 21J, 21K and 21L provided on the V-shaped holding shoes 21F and 21G and V-shaped holding shoes 21D and 21E through coil springs S hold cylindrical base material 1 by adjusting the step of the joint of the cylindrical base materials 1 and thereby by sandwiching them.

In holding and transporting devices 21 in FIG. 34(B), hand section 21Q is provided on mounting section 21N of base portion 21M with shaft 21P, and on V-shaped holding shoes 21R and 21S provided on the hand section 21Q, there are provided pressure members 21U and 21T through leaf springs S1 each having buffer function, and further, plate-shaped pressure member 21W is provided on the end portion of hand section 21V arranged movably on the mounting section 21N through leaf spring S1. The aforementioned V-shaped holding shoes 21R and 21S as well as holding shoe 21W hold cylindrical base material 1 with the pressure members 21U, 21T and 21W through leaf springs S1 by adjusting the step of the joint of the cylindrical base materials 1 and thereby by sandwiching them, In holding and transporting devices 21 in FIG. 34(C), hand sections 22C and 22D each having a V-shaped portion formed on one end thereof are movably attached on mounting section 22B of base portion 22A. Pressure members 22H and 22G are provided on the V-shaped portions of the aforementioned hand section 22C through elastic sponges S2 each having buffer function, and further, pressure members 22E and 22F are provided on the V-shaped portions of the hand section 22D provided movably on the mounting section 22B through elastic sponges S2. The pressure members 22E, 22F, 22G and 22H hold cylindrical base material 1 through the elastic sponges S2 by adjusting the step of the joint of the cylindrical base materials 1 and thereby by sandwiching them.

When buffer means such as the aforementioned coil springs S, leaf springs S1 and elastic sponges S2 are used as stated above, holding actions are stable and neither deformation of the cylindrical base material 1 nor scratch on the surface thereof is caused.

Figure 35:
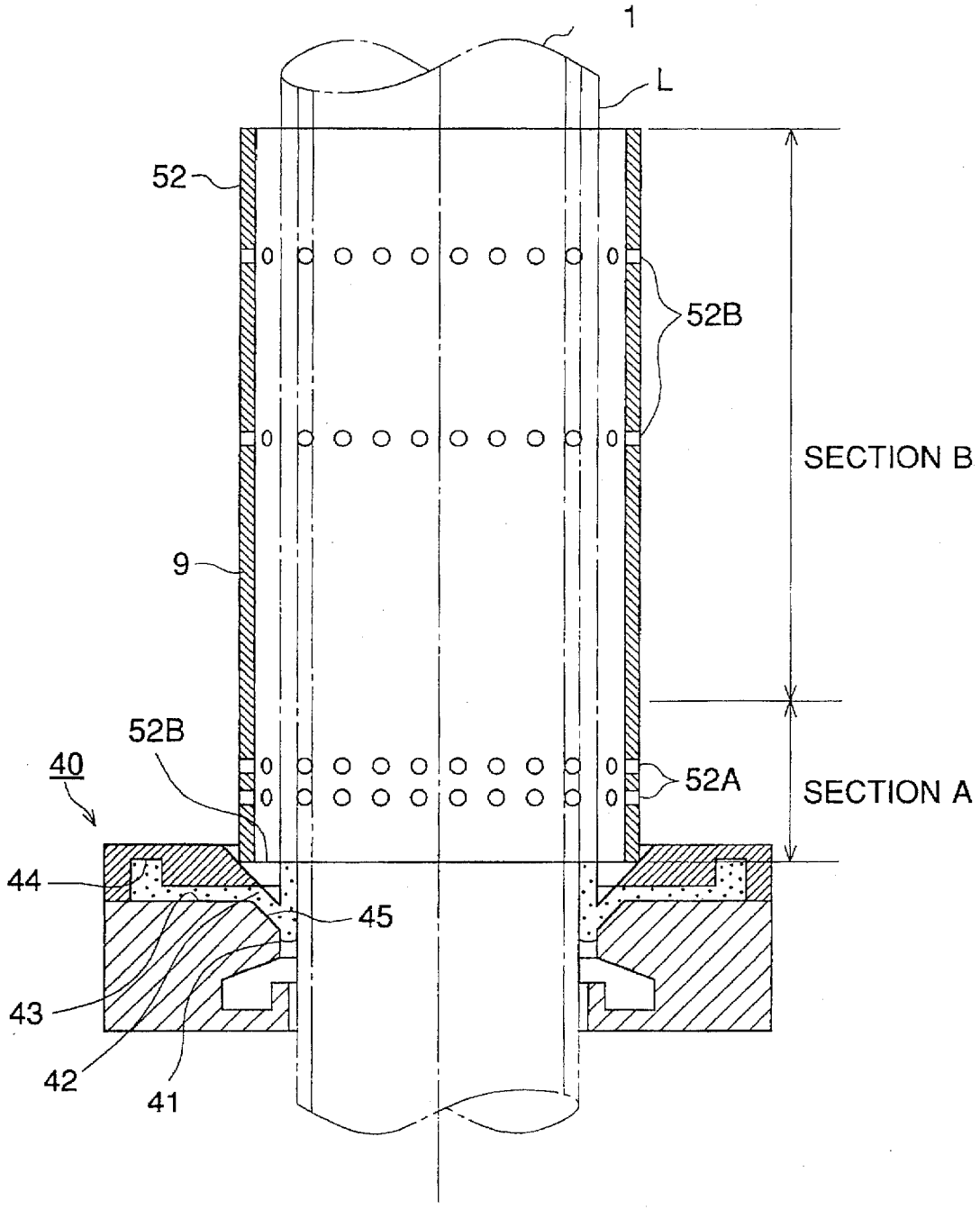
FIG. 35 is a perspective view showing another example of the drying hood.

FIG. 35 is a sectional view showing another example of a drier hood. This drier hood 52 is obtained by extending the upper portion of drier hood 51 (A section) in FIG. 27 so that portion B is formed on this drier hood. On section A, there are formed a plurality of 52A, and on section B, there are formed a plurality of 52B. When this drier hood 52 is provided over coating means 40, solvent vapor density of coating solution L coated on the external surface of cylindrical base material 1 is controlled. Therefore, it is possible to realize uniform coated layers through controlled coated layer drying speed. Further, when the aforesaid drier hood 52 is provided, solvent vapor density at the beading portion is high. Therefore, rapid cooling is prevented and thereby failure in beading can be prevented.

Figure 36:
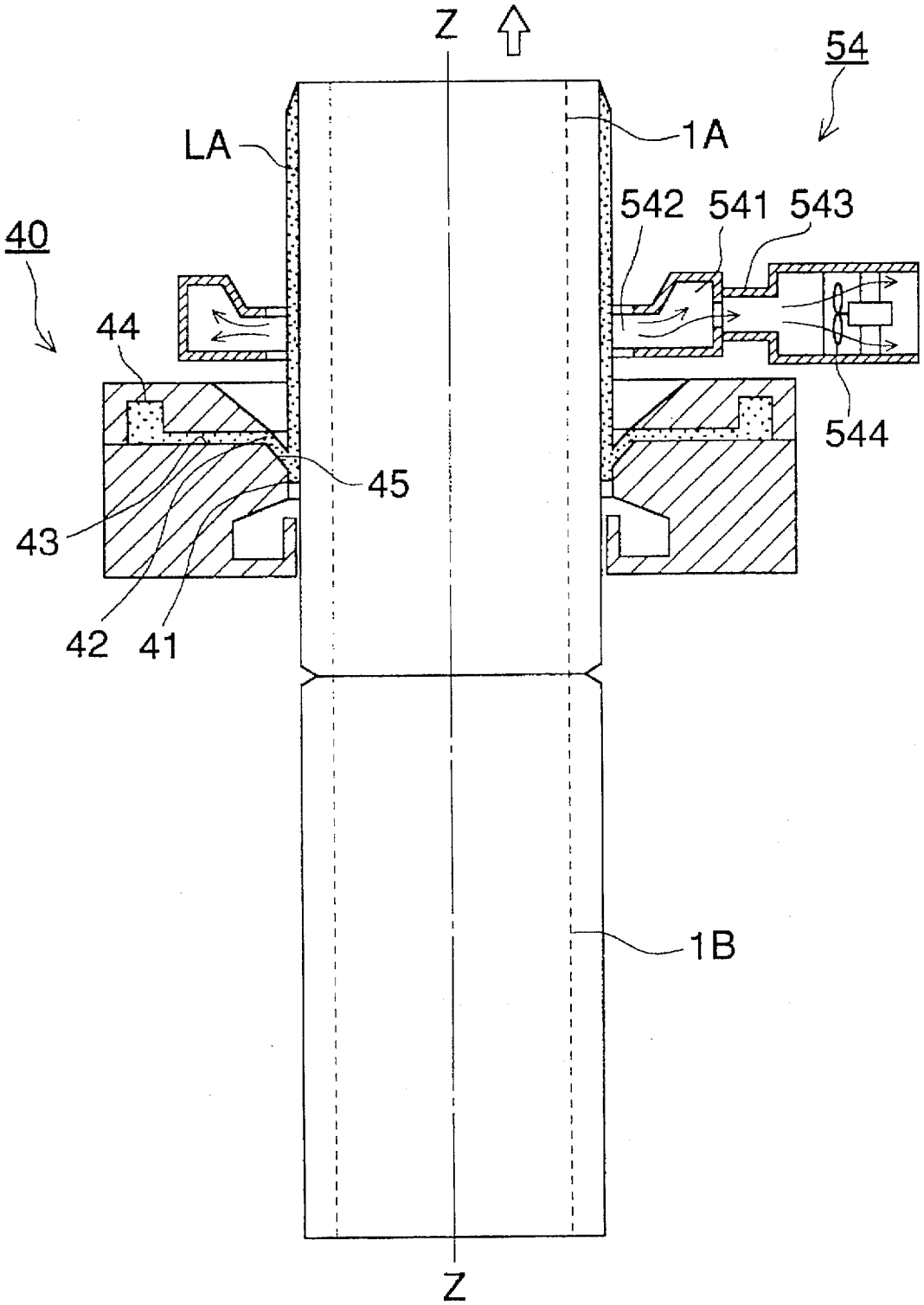
FIG. 36 is a perspective view of an air exhausting and drying device an another example of the drying means.
Figure 37:
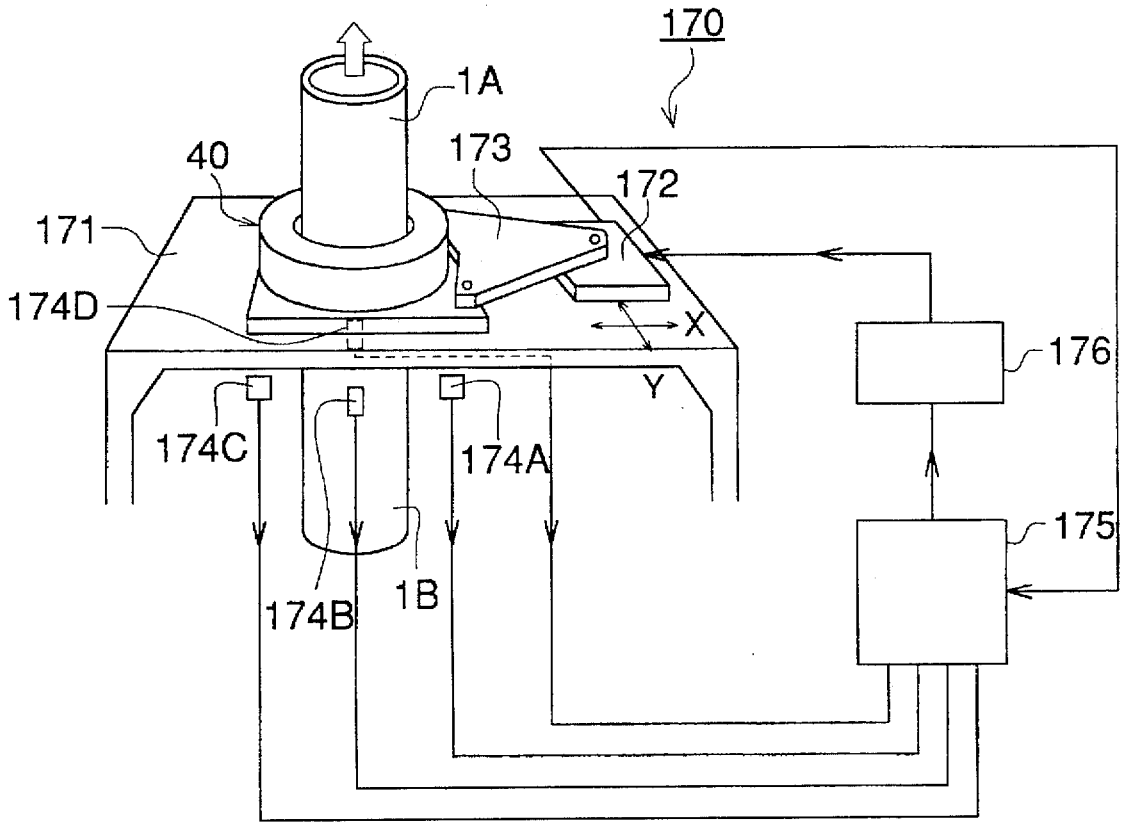
FIG. 37 is a perspective view a position-adjusting means.

FIG. 36 represents an exhaustion drying apparatus 54 as another example of a drier means in FIG. 23. As stated above, a coating solution (light-sensitive solution) L is coated on cylindrical base materials 1A and 1B by cylindrical coating apparatus of a slide hopper type 40, and thus, light-sensitive layer LA is formed. The aforesaid exhaustion drying apparatus 54 sucks in solvent evaporating from light-sensitive layer LA immediately after coating, and further dries, and it is located right above the coating apparatus 40. The numeral 541 is a suction duct formed in a ring shape, and suction inlet 542 is formed toward the aforementioned light-sensitive layer LA from the suction duct 541. On a part of the suction duct 541, there is connected exhaustion pipe 543, thus, solvent evaporated from the light-sensitive layer LA is sucked by exhaustion fan 544 provided in the exhaustion pipe 543 to be ejected forcibly to the outside for drying. Since solvent vapor evaporated from light-sensitive solution L is exhausted immediately after light-sensitive solution L is coated by coating apparatus 40 as stated above, it is possible to stop the flowing down of a large amount of light-sensitive solution L coated on cylindrical base materials 1A and 1B. In that case, it is preferable that exhausted air speed caused by the exhaustion fan 544 is 0.5–5 m/sec, and the suction inlet 542 is deviated from the position of the coating head 41 by 300 mm or less. Then, the cylindrical base materials 1A and 1B are kept to be jointed until the solvent in the light-sensitive solution L evaporates by 30% or more, and after they are separated, light-sensitive layer LA is dried completely. By operating aforesaid exhaustion drying apparatus 54, it is possible to eject quickly the solvent from the neighborhood of light-sensitive layer LA even when coating solution L is coated on a large number of cylindrical base materials jointed, and it is possible to control forcibly the flow down of light-sensitive solution L on coated layer and thereby to prevent an occurrence of the thin layer and a solution pool on the light-sensitive layer LA. Incidentally, a plurality of the exhaustion fans 544 may also by provided on the suction duct 541.

FIG. 38 shows another example of a position adjusting means, wherein FIG. 38(A) is a top view of position adjusting means 80, while FIG. 38(B) is a front view of the position adjusting means 80.

As illustrated, on stand 81, there is provided supporting shaft 82 with which first arm 83 is engaged, and one end of the first ann 83 is linked with flange portion 40*a* of coating apparatus 40. On the other hand, on the stand 81, there is arranged X-axis control table 84 so that it may move freely in both X-axis direction and Y-axis direction, and second arm 85 and third arm 86 are linked with the X-axis control table 84, and the third arm 86 is linked with the first arm 83.

Due to the position adjusting means in the present example, it is possible to move the coating apparatus 40 as the X-axis control table 84 moves in the X-axis direction or in the Y-axis direction.

Figure 39:
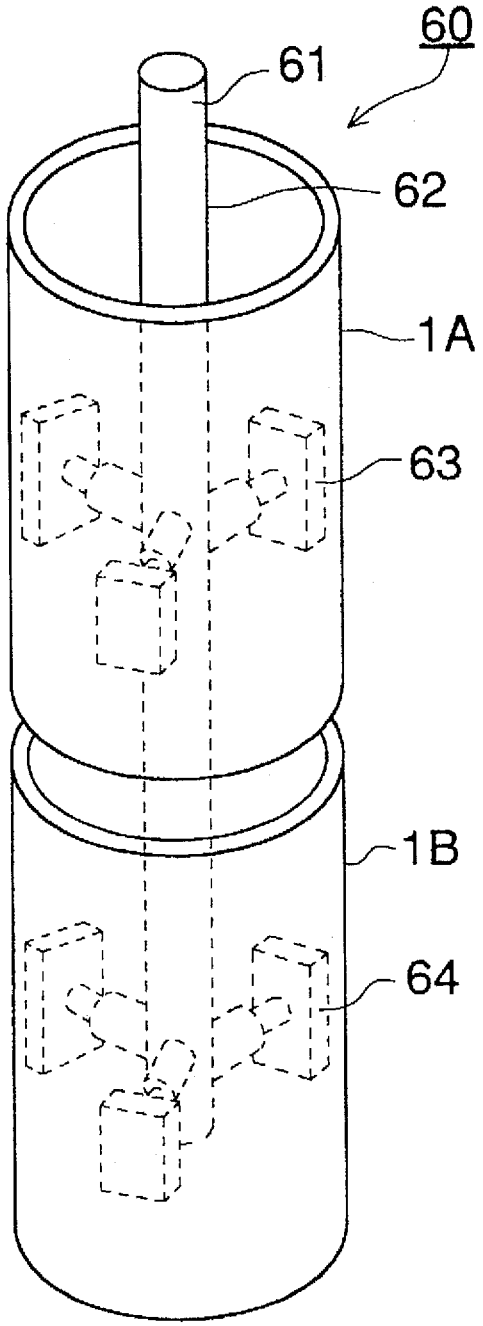
FIG. 39 is a perspective view showing an example of a separation/discharging/holding means.

FIG. 39 is a perspective view of the separating/ejecting means shown in FIG. 24, and its concrete structure will be explained as follows.

A separating/ejecting/holding equipment of the invention has a buffer device which operates when a holding shoe grasps a cylindrical base material. FIG. 9 shows an example wherein a reduction mechanism is provided as a buffer device. On the internal surface of air-cylinder 62A or on the axis thereof, there are provided two servomotors 65A which each of which makes each of upper holding shoe 63A and lower holding shoe 64A to grasp or to be released, and on axis 66A of each servomotor 65A, there is provided bevel gear 67A. On the same circumference of a circle of the air-cylinder 62A, there are arranged holding shoe guides 621A each of which guides longitudinal movement of each of upper upper holding shoe 63A and lower holding shoe 64A in the radial direction, at equal intervals of 3–6 divisions. There is further provided distance-changing means 622A on the air-cylinder 62A so that the distance between the upper holding shoe 63A and lower holding shoe 64A can be changed. This distance-changing means 622A can alsc be structured so that the distance can be changed with an addition of a returning motion, in spite of the linear distance change. In the function of the bevel gear 67A mentioned. above, there is provided rotation-transmitting member 68A which penetrates the holding shoe guide 621A and is provided, on its one end, with bevel gear 681A engaging with the belvel gear 67A and with screw portion 682A on the other end, and the screw portion 682A is in the relation of screw engagement with a screw portion provided inside holding arm 631A or 641A provided on the upper holding shoe 63A or lower holding shoe 64A, thus the upper holding shoe 63A or lower holding shoe 64A is moved forward or backward in the radial direction by the right-handed rotation or left-handed rotation of the servomotor 65A. Further, in the present example, each of two servomotors 65A is provided, on its axis, with torque meter 69A.

In the present example, drive control of servomotor 65A is made in accordance with output from torque meter 69A, and since a torque is generated when the upper holding shoe 63A or lower holding shoe 64A comes in touch with the inner surface of a cylindrical base material, the torque is detected for speed control. ling of the servomotor 65A, and speed reduction control is made in a way wherein the servomotor 65A is stopped when the torque arrives at a predetermined value. Incidentally, though the torque meter 69A is used in the present example, it is also possible to use a motor having characteristics wherein servomotor 65A changes its rotation speed in accordance with load variation and it stops at the certain load, without using a torque meter. It is further possible to use a pulse motor capable of being digital-controlled and thereby to reduce the speed immediately before the holding shoe comes in contact with the inner surface of the cylindrical mase material under the predetermined condition.

Figure 40:
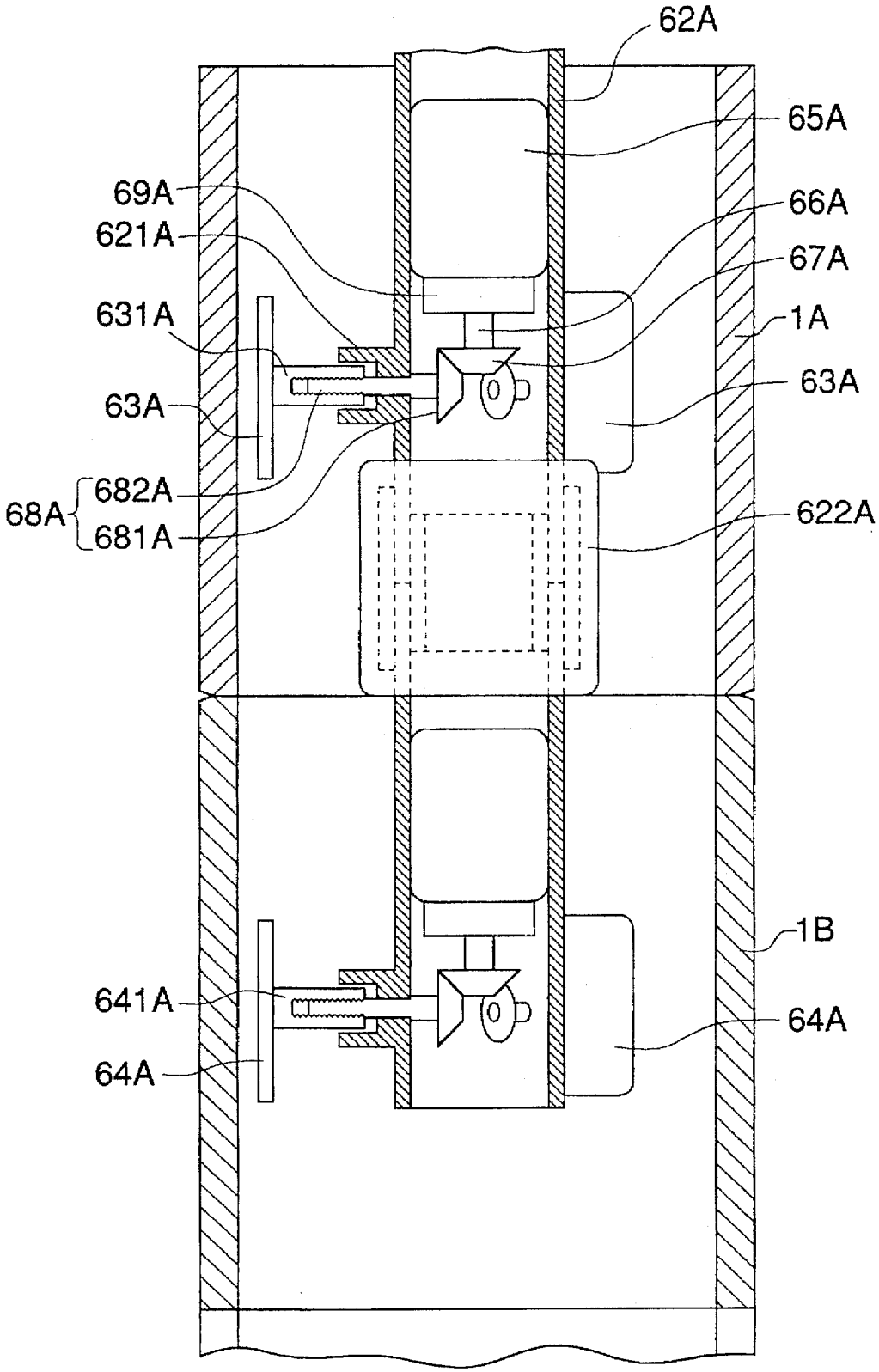
FIG. 40 is a sectional view showing the structure of the separation/discharging/holding means of aforesaid example.
Figure 41:
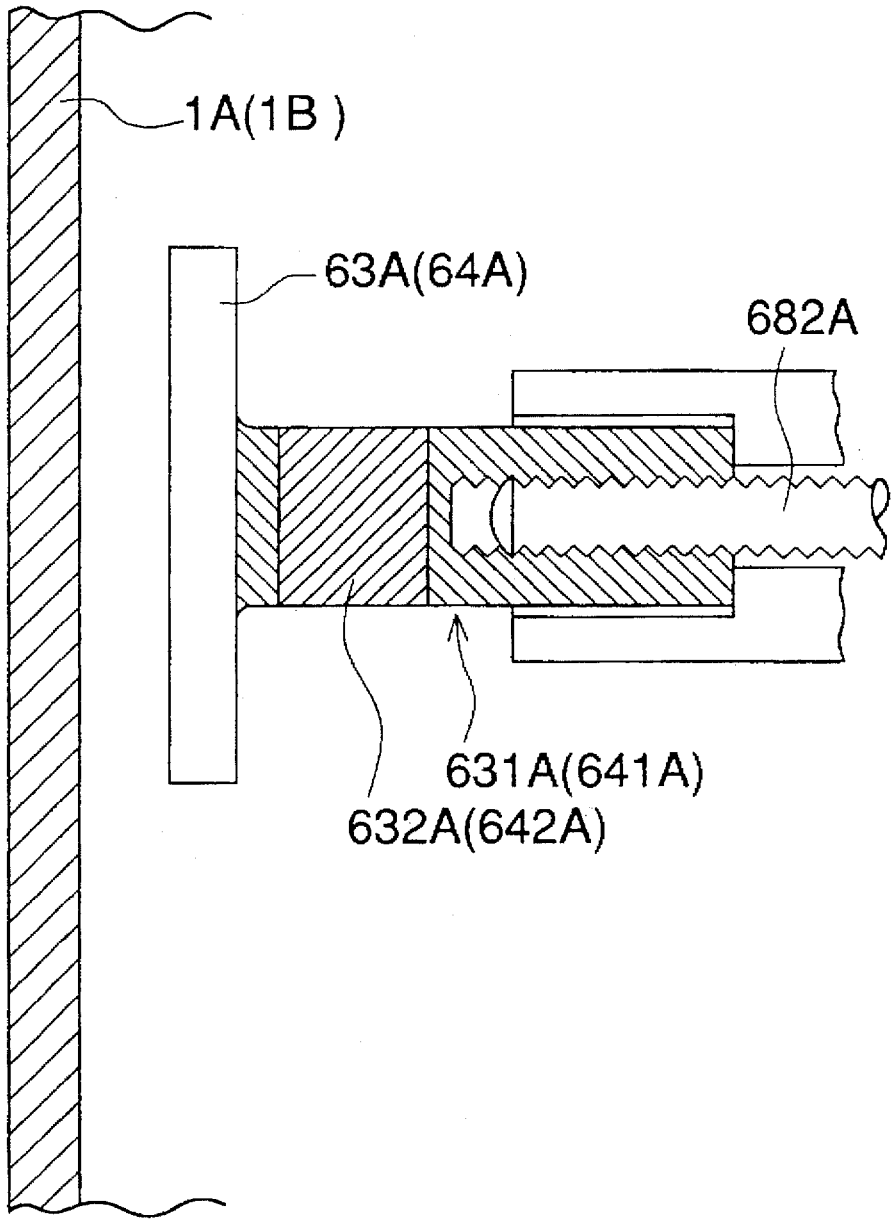
FIG. 41 is an outside drawing of primary parts of the separation/discharging/holding means of aforesaid example.

FIG. 41 shows an example in which a spring buffer mechanism is provided as a buffer mechanism that operates when the holding shoe grasps a cylindrical base material, wherein a sponge member is used in each of holding arms 631A and 641A provided on holding shoes 63A and 64A explained in FIG. 40, as spring buffer mechanisms 632A and 642A. In this example, a pulse motor is used in place of servomotor 65A in FIG. 40, and by establishing conditions in advance that spring buffer mechanisms 632A and 642A are compressed slightly, and the motor stops when appropriate contact conditions are attained, the holding shoe does not scratch the cylindrical base material when the holding shoe hits it, and when releasing that holding, the chock therefrom is not given to the lower cylindrical base material.

Incidentally, as a spring buffer mechanism, a metallic spring, an air spring and others are available, and a metallic coil spring or a sponge is preferable. It is also preferable that the spring buffer mechanism shown in FIG. 41 is used in combination with a reduction mechanism shown in FIG. 40.

Figure 42:
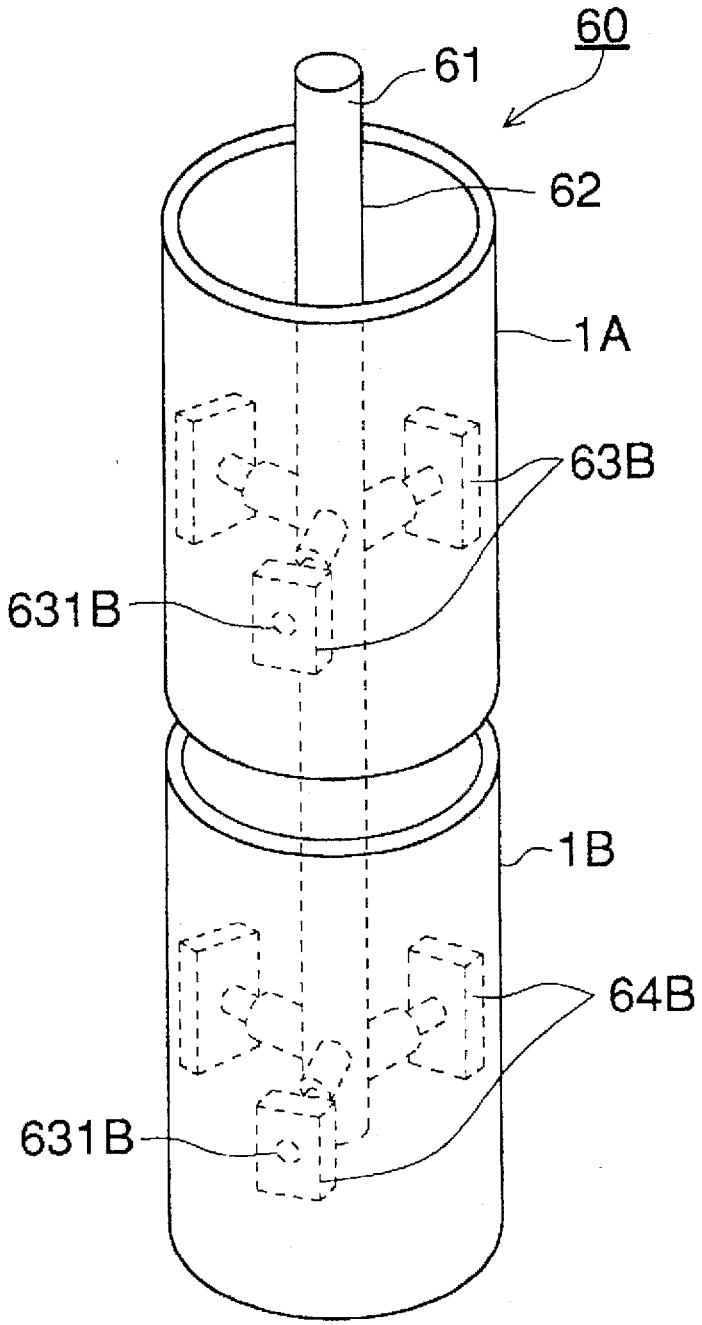
FIG. 42 is a perspective view showing another example of the separation/discharging/holding means.
Figure 43:
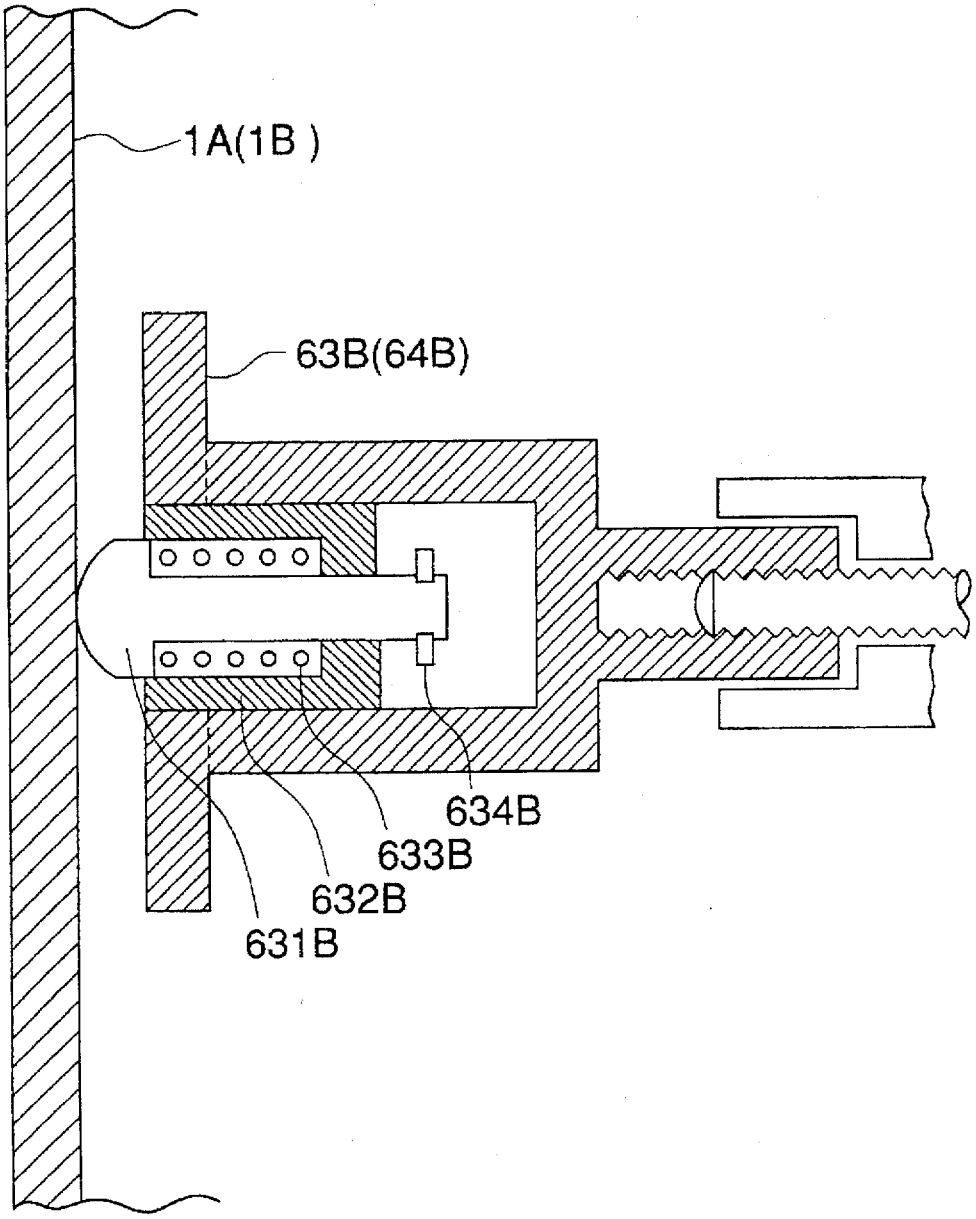
FIG. 43 is a sectional view showing the a holding shoe portion in aforesaid example.

Next, there will be explained an example wherein a pin portion is provided on a holding shoe of a holding device whose outer surface comes in contact with a inner surface of a cylindrical base material. As shown on a perspective view in FIG. 42, pin portions 631B and 641B operating in their pushing out direction are provided, as a pushing pin, respectively on upper chuck (upper holding shoe) 63 and lower chuck (lower holding shoe) 64 of separating/ejecting/holding means 60 explained already, and a sectional view of the aforesaid portion is shown in FIG. 43. At the portion on the holding shoe 63B (64B) where cylindrical base material 1A (1B) comes in contact with the holding shoe, there are provided singular or plural pin portions 631B capable of operating in pushing out direction, pin guide portion 632B that guides the pin portion 631B in the radial direction, spring 633B that urges the pin portion 631B in its pushing out direction, and slip-prevention ring 634B that prevents the pin portion 631B from slipping out in the pushing out direction. In the holding shoe 63B (64B) having the constitution mentioned above, when the holding shoe 63B (64B) holds cylindrical base material 1A (1B), the pin portion 631B comes in contact slightly with the inner surface of the cylindrical base material 1A (1B) first, and then, the holding shoe 63B (64B) touches and holds the cylindrical base material. Therefore, it is possible to avoid a shock. In the case of releasing the holding of the holding shoe 63B (64B), even when the inner surface of the base material is sticking to the contact surface of the holding shoe 63B (64B), they are easily separated by the spring force of spring 633B that urges the pin portion 631B, thus the releasing of holding can be performed smoothly.

In this case, hard materials such as ceramic, metal and hard polymer are preferable as materials used for the pin portion 631B. As materials used for a holding portion of the holding shoe 63B (64B), polymers such as polycarbonate, PBT, urethane rubber, natural rubber and synthetic rubber, for example, are preferable, and among them, elastomer such as rubber is preferable. Owing to the pin portion used, it is possible to use an adhesive elastomer, resulting in advantages such as transmission of a holding force, absorption of a shock and a buffer function. For the separating/ejecting/holding device of the invention, it is necessary to cut a coated layer at the joint portion between adjoining drums, and for this purpose, it has become possible to obtain both sufficient holding force and buffer function needed for cutting the coated layer, because it has become possible to use elastomer material which trnasmits surely the holding force for the holding portion. FIG. 44(A) shows an example wherein a separating device is structured with a 3-direction chuck, while FIG. 44(B) shows an example of the structure of a 4-direction chuck.

What is claimed is:

1. An apparatus for coating a cylinder with a solution, said apparatus comprising:

(i) a coater including:

a body having a circular hole through which the cylinder passes;

a coating surface provided on a wall of the circular hole so as to surround an outer surface of the cylinder as the cylinder passes through the circular hole;

a solution chamber provided in the body for storing the solution;

a slit provided in the body for distributing the solution from the solution chamber to the coating surface;

a feeding port provided on a periphery of the body; and a feeding conduit provided in the body for connecting the feeding port and the solution chamber so that the solution is fed from the feeding port to the solution chamber; and (ii) a conveyor for conveying the cylinder through the circular hole of the coater so that the outer surface of the cylinder is coated with the solution when the cylinder passes the coating surface provided on the wall of the circular hole;

wherein the solution chamber has a height H2 of 5 mm to 50 mm, the slit has a slit gap distance HI, and a ratio of H2/H1 is 10 to 1000, wherein the solution chamber is ring-shaped, and the slit is disc-shaped and provided between the ring-shaped solution chamber and the coating surface, and wherein the body has a first side at which the feeding port is provided and a second side opposite to the first side, and a height H3 of the ring-shaped solution chamber located at the first side of the body is different from a height H4 of the ring-shaped solution chamber located at the second side of the body.

2. The apparatus of claim 1, wherein a ratio of H4/H3 is 1.01 to 5.

3. The apparatus of claim 1, further comprising an air vent hole provided in the ring-shaped solution chamber.

4. The apparatus of claim 3, wherein the air vent hole is provided in a portion of the ring-shaped solution chamber located at the second side of the body.

5. The apparatus of claim 1, wherein a volume of the ring-shaped solution chamber is 20 cc to 1000 cc.

6. The apparatus of claim 1, wherein the slit gap distance H1 is 30 μm to 1 mm.

7. The apparatus of claim 1, wherein the slit is slanted upwardly toward the coating surface with an angle of 10° to 80°.

8. The apparatus of claim 1, wherein the solution is fed at a velocity of 0.01 m/sec to 1.0 m/sec at the feeding port.

9. The apparatus of claim 1, wherein a viscosity of the solution is 1.0 millipascal·sec to 10.0 millipascal·sec, a coating gap distance between the coating surface and the outer surface of the cylinder is 30 μm to 200 μm, and the slit gap distance H1 is 50 μm to 200 μm.

10. The apparatus of claim 1, wherein a viscosity of the solution is 10.0 millipascal·sec to 600.0 millipascal·sec, a coating gap distance between the coating surface and the outer surface of the cylinder is 50 μm to 500 μm, and the slit gap distance H1 is 50 μm to 500 μm.

11. The apparatus of claim 10, wherein the conveyor conveys the cylinder at a speed of 5 mm/sec to 30 mm/sec.

12. An apparatus for coating a cylinder with a solution, said apparatus comprising:

(i) a coater including:

a body having a circular hole through which the cylinder passes;

a coating surface provided on a wall of the circular hole so as to surround an outer surface of the cylinder as the cylinder passes through the circular hole;

a solution chamber provided in the body for storing the solution;

a slit provided in the body for distributing the solution from the solution chamber to the coating surface;

a feeding port provided on a periphery of the body; and a feeding conduit provided in the body for connecting the feeding port and the solution chamber so that the solution is fed from the feeding port to the solution chamber; and (ii) a conveyor for conveying the cylinder through the circular hole of the coater so that the outer surface of the cylinder is coated with the solution when the cylinder passes the coating surface provided on the wall of the circular hole;

wherein the solution chamber has a height H2 of 5 mm to 50 mm, the slit has a slit gap distance HI, and a ratio of H2/H1 is 10 to 1000, wherein the solution chamber has an outlet port connected with the slit, wherein a height h between a center of the outlet port and a floor of the solution chamber, and a height H of the solution chamber are related such that:

$$(1/3\times H)<h<(2/3\times H),$$

and wherein the solution chamber has an inlet port connected with the feeding conduit, and the inlet port is positioned not higher than the outlet port.

13. The apparatus of claim 12, wherein the inlet port is provided on the floor of the solution chamber.

14. An apparatus for coating a cylinder with a solution, said apparatus comprising:

(i) a coater including:

a body having a circular hole through which the cylinder passes;

a coating surface provided on a wall of the circular hole so as to surround an outer surface of the cylinder as the cylinder passes through the circular hole;

a solution chamber provided in the body for storing the solution;

a slit provided in the body for distributing the solution from the solution chamber to the coating surface;

a feeding port provided on a periphery of the body; and a feeding conduit provided in the body for connecting the feeding port and the solution chamber so that the solution is fed from the feeding port to the solution chamber; and (ii) a conveyor for conveying the cylinder through the circular hole of the coater so that the outer surface of the cylinder is coated with the solution when the cylinder passes the coating surface provided on the wall of the circular hole;

wherein the solution chamber has a height H2 of 5 mm to 50 mm, the slit has a slit gap distance HI, and a ratio of H2/H1 is 10 to 1000, and wherein the coating surface is hopper-shaped, and the slit forms a circular discharging port on the hopper-shaped coating surface.

15. The apparatus of claim 14, wherein the body of the coater includes a plurality of respective sets of said feeding port, said feeding conduit, said solution chamber and said slit, and wherein the respective slits form a plurality of discharging ports at different positions on the hopper-shaped coating surface so that a plurality of different solution layers can be simultaneously coated on the cylinder.

16. The apparatus of claim 14, comprising a plurality of said coaters separately arranged so that a plurality of different solution layers can be sequentially coated on the cylinder.

17. A coater for coating a cylinder with a coating solution, wherein an axis of the cylinder is vertically arranged and the cylinder is conveyed through the coater in an axial direction, said coater comprising:

a coater body having a cylindrical hole through which the cylinder passes;

a circumferential coating surface provided on a cylindrical wall of the cylindrical hole so as to surround an outer surface of the cylinder as the cylinder passes through the cylindrical hole;

a ring-shaped solution chamber provided in the coater body for storing the coating solution;

a feeding port provided on a periphery of the body;

a feeding conduit provided in the body for connecting the feeding port and the ring-shaped solution chamber so that the coating solution is fed from the feeding port through the feeding conduit to the ring-shaped solution chamber; and a disc-shaped slit connecting the ring-shaped solution chamber and the circumferential coating surface so that the coating solution is distributed from the ring-shaped solution chamber to the circumferential coating surface, wherein the disc-shaped slit includes a circular outlet port through which the coating solution is discharged to form a coating solution layer on the circumferential coating surface so that the cylinder is coated with the coating solution layer when the cylinder passes the circumferential coating surface, and wherein the disc-shaped slit has a slit gap distance H1 between a ceiling of the disc-shaped slit and a floor of the disc-shaped slit, the ring-shaped solution chamber has a chamber height H2 of 5 mm to 50 mm between a ceiling of the ring-shaped solution chamber and the floor of the disc-shaped slit, and a ratio of H2/H1 is 10 to 1000.

18. The coater of claim 17, wherein the body has a first side at which the feeding port is provided and a second side opposite to the first side, and a height H3 of the ring-shaped solution chamber located at the first side of the body is different from a height H4 of the ring-shaped solution chamber located at the second side of the body.

19. The apparatus of claim 18, wherein a ratio of H4/H3 is 1.01 to 5.

20. The apparatus of claim 18, further comprising an air vent hole provided in the ring-shaped solution chamber.

21. The apparatus of claim 20, wherein the air vent hole is provided in a portion of the ring-shaped solution chamber located at the second side of the body.

22. The apparatus of claim 17, wherein a volume of the solution chamber is 20 cc to 1000 cc.

23. The apparatus of claim 17, wherein the slit gap distance H1 to 30 μm to 1 mm.

* * * * *